US009785077B2

(12) United States Patent
Abe et al.

(10) Patent No.: US 9,785,077 B2
(45) **Date of Patent: *Oct. 10, 2017**

(54) TONER

(71) Applicant: CANON KABUSHIKI KAISHA, Tokyo (JP)

(72) Inventors: Koji Abe, Numazu (JP); Yuhei Terui, Numazu (JP); Katsuyuki Nonaka, Mishima (JP); Tsuneyoshi Tominaga, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/509,239

(22) Filed: Oct. 8, 2014

(65) Prior Publication Data

US 2015/0099220 A1 Apr. 9, 2015

(30) Foreign Application Priority Data

Oct. 9, 2013 (JP) ..... 2013-212259

(51) Int. Cl.

| | |
|---|---|
| ***G03G 9/087*** | (2006.01) |
| ***G03G 9/093*** | (2006.01) |
| ***G03G 9/08*** | (2006.01) |

(52) U.S. Cl.

CPC ..... *G03G 9/09328* (2013.01); *G03G 9/0804* (2013.01); *G03G 9/0825* (2013.01); *G03G 9/08711* (2013.01); *G03G 9/08755* (2013.01); *G03G 9/08773* (2013.01)

(58) Field of Classification Search

CPC ..... G03G 9/08755; G03G 9/08773

See application file for complete search history.

(56) References Cited

U.S. PATENT DOCUMENTS

| | | | | |
|---|---|---|---|---|
| 5,153,089 | A | 10/1992 | Ong et al. | |
| 6,358,658 | B1 | 3/2002 | Tazawa et al. | |
| 8,778,581 | B2 | 7/2014 | Nonaka et al. | |
| 8,916,319 | B2 | 12/2014 | Ikeda et al. | |
| 8,980,517 | B2 * | 3/2015 | Kawaguchi ..... | G03G 9/09775 430/110.1 |
| 2010/0159375 | A1 | 6/2010 | Zhou et al. | |

(Continued)

FOREIGN PATENT DOCUMENTS

| | | |
|---|---|---|
| EP | 1 003 080 A1 | 5/2000 |
| JP | 3-89361 A | 4/1991 |

(Continued)

OTHER PUBLICATIONS

European Search Report dated Feb. 23, 2015 in European Application No. 14003457.0.

*Primary Examiner* — Hoa V Le

(74) *Attorney, Agent, or Firm* — Fitzpatrick Cella Harper and Scinto

(57) ABSTRACT

The present invention provides a toner having a toner particle that contains a binder resin and an organic silicon polymer, wherein the organic silicon polymer has a specific structure, the proportion of the specific structure to the number of a silicon atom in the organic silicon polymer contained in the toner particle is at least 5.0%, the toner particle contain a polyester resin of from at least 1.0% by mass to less than 80% by mass, and the polyester resin is a specific polymer.

18 Claims, 4 Drawing Sheets

(56) References Cited

U.S. PATENT DOCUMENTS

| | | | | |
|---|---|---|---|---|
| 2010/0159376 | A1 | 6/2010 | Zhou et al. | |
| 2013/0273469 | A1* | 10/2013 | Akutagawa | G03G 9/08755 430/109.3 |
| 2014/0186762 | A1* | 7/2014 | Abe | G03G 9/09 430/108.21 |
| 2015/0099222 | A1* | 4/2015 | Terui | G03G 9/08708 430/109.3 |
| 2015/0099224 | A1 | 4/2015 | Abe et al. | |

FOREIGN PATENT DOCUMENTS

| | | | |
|---|---|---|---|
| JP | 9-179341 | A | 7/1997 |
| JP | 2001-75304 | A | 3/2001 |
| JP | 2006-146056 | A | 6/2006 |

* cited by examiner

TONER

BACKGROUND OF THE INVENTION

Field of the Invention

The present invention relates to a toner for developing electrostatic images (electrostatic latent images) used in image-forming methods in the manner of electrophotography and electrostatic printing.

Description of the Related Art

Due to the development of computers and multimedia in recent years, there is a desire for a means of outputting high-definition full-color images in a wide range of fields from the office to the home.

In addition, there is a demand for high durability without decreasing quality even when copying or printing large numbers of prints during use in offices where copying or printing is carried out frequently. On the other hand, in the case of use in small offices or at home, image-forming apparatuses are being required to be more compact in addition to allowing the obtaining of high-quality images from the viewpoints of saving on space, saving on energy and reducing weight. In order to response to these demands, there is a need to further improve toner performance in terms of environmental stability, contamination of members, low-temperature fixability, development durability and storage stability.

In the case of full-color images in particular, since images are formed by superimposing color toners, color reproducibility decreases and uneven coloring ends up occurring unless each color of toner is developed in the same way. In the case pigments and dyes used as toner colorants have precipitated on the surface of toner particles, they end up having an effect on development and may end up causing uneven coloring.

Moreover, fixing performance and color mixability during fixation are important in the forming of full-color images in particular. Although a binder resin suitable for low-temperature fixability is selected in order to achieve desired energy savings, this binder resin also has a considerable effect on the developability and durability of color toner.

Moreover, there is also a desire for a means of outputting high-definition full-color images capable of being used for a long period of time in various environments subject to different temperatures and humidity. In order to respond to such needs, it is necessary to resolve problems such as changes in the amount of toner electric charge or changes in the surface properties of toner particles that occur due to factors affecting the usage environment such as temperature and humidity. In addition, it is also necessary to resolve the problem of contamination of members such as the developing roller, charging roller, regulating blade and photosensitive drum. Accordingly, there is a need for the development of a toner that has stable charging performance even when stored for long period of time in various environments as well as stable development durability so as to prevent the occurrence of contamination of members.

One example of a factor responsible for fluctuations in toner storage stability or amount of electric charge caused by temperature and humidity is the occurrence of a phenomenon in which toner release agent and resin components exude from inside toner particles onto the surface (to also be referred to as bleeding), and this bleeding causes a change in the surface properties of toner particles.

A method consisting of covering the surface of toner particles with resin is one method for solving such problems.

Japanese Patent Application Laid-open No. 2006-146056 discloses a toner that strongly adheres inorganic fine particles to the surface thereof as a toner that demonstrates superior high-temperature storability as well as durability in normal temperature, normal humidity environments and high temperature, high humidity environments during image output.

However, even though inorganic fine particles are strongly adhered to the toner particles, there is a need for further improvement with respect to durability and contamination of members in harsh environments due to the occurrence of bleeding, by which release agent and resin composition exude from the gaps between inorganic fine particles, and the release of inorganic fine particles due to deterioration with time.

In addition, Japanese Patent Application Laid-open No. H03-089361 discloses a method for producing a polymerized toner obtained by adding a silane coupling agent to the reaction system in order to obtain a toner having a narrow charge distribution and little charge humidity-dependency without exposing colorant or polar substances on the surface of the toner particles.

However, in this method, since the amount of silane compound that precipitates on the surface of the toner particles and hydrolysis and condensation polymerization of the silane compound are inadequate, further improvement is required with respect to environmental stability and development durability.

Moreover, Japanese Patent Application Laid-open No. H09-179341 discloses a method for using a polymerized toner containing a silicon compound provided in the form of a continuous thin film on a surface portion as a method for controlling the amount of toner charge and forming high-quality output images without being influenced by temperature or humidity.

However, due to the large polarity of the organic functional groups, the amount of silane compound that precipitates on the surface of the toner particles and hydrolysis and condensation polymerization of the silane compound are inadequate, the degree of crosslinking is weak, and further improvement is required with respect to changes in image density caused by changes in charging performance at high temperature and high humidity as well as contamination of members caused by deterioration with time.

Moreover, Japanese Patent Application Laid-open No. 2001-75304 discloses a polymerized toner having a coated layer formed by mutually adhering blocks of particles containing a silicon compound as a toner for improving flowability, release of fluidizing agent, low-temperature fixability and blocking.

However, further improvement is required with respect to the occurrence of bleeding by which release agent and resin components exude from between the blocks of particles containing the silicon compound, inadequate amount of silicon compound that precipitates onto the surface of the toner particles and inadequate hydrolysis and condensation polymerization of the silane compound, changes in image density caused by changes in charging performance at high temperature and high humidity, and contamination of members caused by melt adhesion of toner.

SUMMARY OF THE INVENTION

The present invention provides a toner having superior development durability, storage stability, environmental stability, resistance to contamination of members and low-temperature fixability.

The present invention provides a toner comprising a toner particle that contains a binder resin and an organic silicon polymer, wherein the organic silicon polymer has a structure represented by the following formula (T3), a proportion of the structure represented by the following formula (T3) to the number of a silicon atom in the organic silicon polymer is at least 5.0%, the toner particle contains a polyester resin of from at least 1.0% by mass to less than 80% by mass, and the polyester resin is at least one polymer selected from the group consisting of:

a polymer obtained by condensation polymerization of an alcohol component containing at least 50.0 mol % of an aliphatic diol having from 2 to 16 carbon atoms in an alcohol component, and a carboxylic acid component containing at least 50.0 mol % of an aliphatic dicarboxylic acid having from 2 to 16 carbon atoms in a carboxylic acid component, a polymer obtained by condensation polymerization of an alcohol component containing at least 50 mol % of an aliphatic dial having from 2 to 16 carbon atoms in an alcohol component, and a carboxylic acid component containing at least 50 mol % of an aromatic dicarboxylic acid having from 2 to 16 carbon atoms in a carboxylic acid component, and a polymer obtained by condensation polymerization of an alcohol component containing at least 50.0 mol % of an aromatic diol in an alcohol component, and a carboxylic acid component containing at least 50.0 mol % of an aliphatic dicarboxylic acid having from 2 to 16 carbon atoms in a carboxylic acid component:

[Chemical Formula 1]

$$Rf—SiO_{3/2} \quad (T3)$$

(wherein, Rf represents a hydrocarbon group having from 1 to 6 carbon atoms or aryl group).

According to the present invention, a toner can be provided that has superior development durability, storage stability, environmental stability, resistance to contamination of members and low-temperature fixability.

Further features of the present invention will become apparent from the following description of exemplary embodiments (with reference to the attached drawings).

DESCRIPTION OF THE EMBODIMENTS

Figure 1:
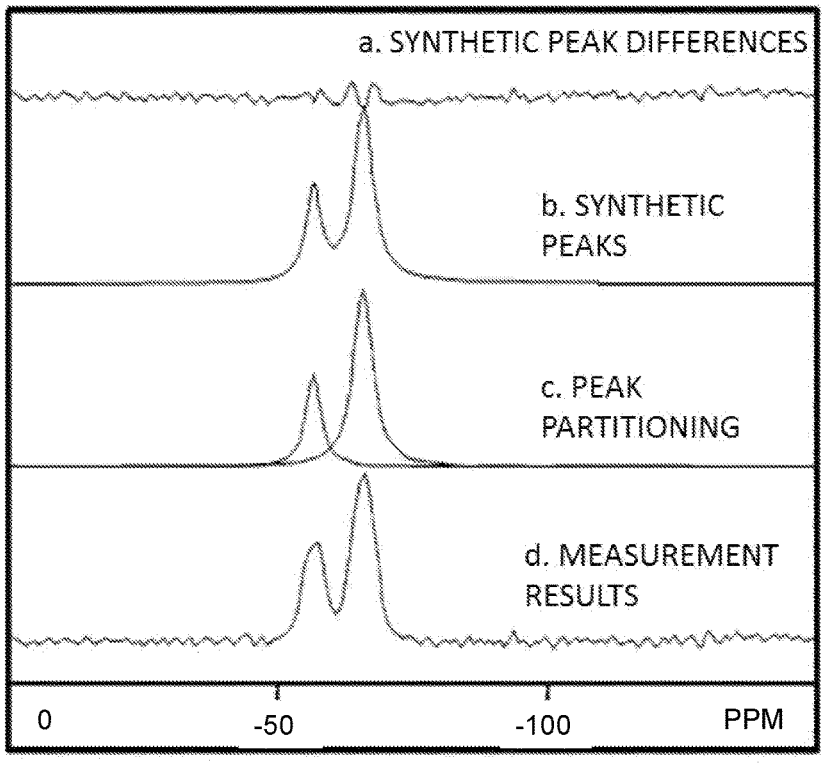
FIG. 1 is a $^{29}$Si-NMR measurement chart of toner particles of the present invention.

Although the following provides a detailed explanation of the present invention, the present invention is not limited thereto.

The toner of the present invention is a toner comprising a toner particle that contains a binder resin and an organic silicon polymer, wherein the organic silicon polymer has a structure represented by the following formula (T3) (to also be referred to as a "T unit structure"), a proportion of the structure represented by the following formula (T3) (to also be referred to as "ST3") to the number of a silicon atom in the organic silicon polymer contained in the toner particle is at least 5.0%, the toner particle contains a polyester resin of from at least 1.0% by mass to less than 80% by mass, and the polyester resin is at least one polymer selected from the group consisting of:

a polymer obtained by condensation polymerization of an alcohol component containing at least 50.0 mol % of an aliphatic diol having from 2 to 16 carbon atoms in an alcohol component, and a carboxylic acid component containing at least 50.0 mol % of an aliphatic dicarboxylic acid having from 2 to 16 carbon atoms in a carboxylic acid component, a polymer obtained by condensation polymerization of an alcohol component containing at least 50 mol % of an aliphatic diol having from 2 to 16 carbon atoms in an alcohol component, and a carboxylic acid component containing at least 50 mol % of an aromatic dicarboxylic acid having from 2 to 16 carbon atoms in a carboxylic acid component, and a polymer obtained by condensation polymerization of an alcohol component containing at least 50.0 mol % of an aromatic diol in an alcohol component, and a carboxylic acid component containing at least 50.0 mol % of an aliphatic dicarboxylic acid having from 2 to 16 carbon atoms in a carboxylic acid component:

[Chemical Formula 2]

$$Rf—SiO_{3/2} \quad (T3)$$

(wherein, Rf represents a hydrocarbon group having from 1 to 6 (both inclusive) carbon atoms or aryl group).

(Organic Silicon Polymer and Polyester Resin)

The toner particle demonstrate a superior effect on environmental stability, low-temperature fixability and storage stability as a result of containing an organic silicon polymer having a structure represented by the above-mentioned formula (T3) and a polyester resin formed from a specific alcohol component and carboxylic acid component.

In addition, the polyester resin containing an aliphatic compound as a constituent thereof tends to demonstrate a decrease in charging performance in a specific environment since resistance is low in comparison with a polyester resin in which an aromatic compound is a main component of the constitution thereof. This is thought to be due to it being easy for electron migration to occur between polyester molecules due to the aliphatic compounds overlapping. In addition, as a result of the aliphatic compounds of the polyester resin overlapping, the polyester resin instantaneously melts at a specific temperature, thereby resulting in improved storage stability and low-temperature fixability.

The present invention provides a toner that stipulates the number of carbon atoms of Rf in the above-mentioned formula (T3), the number of carbon atoms of the aliphatic component that composes the polyester resin, and the constituent ratio thereof in order to realize improvement of charging performance of the organic silicon polymer having a structure represented by the above-mentioned formula (T3) and improvement of charging performance of the polyester resin containing an aliphatic compound as a constituent thereof.

Environmental stability, low-temperature fixability and storage stability are particularly improved as a result of using the above-mentioned constitution.

Bleeding of resin and release agent that easily exude from the inside is suppressed due to the hydrophobicity of the hydrocarbon group or aryl group represented by Rf in the structure represented by the above-mentioned formula (T3) contained in the organic silicon polymer, thereby allowing the obtaining of a toner having superior storage stability and development durability. In addition, a toner having superior environmental stability can be obtained due to the charging performance of the hydrocarbon group or aryl group represented by Rf in the above-mentioned formula (T3).

In the present invention, the hydrocarbon group represented by Rf in the above-mentioned formula (T3) is a hydrocarbon group other than an aryl group. In addition, the number of carbon atoms of the hydrocarbon group represented by Rf in the above-mentioned formula (T3) is preferably from 1 to 3 in order to further improve charging performance and inhibition of fogging. Preferable examples of hydrocarbon groups having from 1 to 3 carbon atoms include a methyl group, ethyl group, and propyl group, and preferable example of aryl groups include phenyl group.

More preferably, the hydrocarbon group represented by Rf in the above-mentioned formula (T3) is a methyl group from the viewpoints of environmental stability and storage stability.

In the present invention, the proportion (ST3) of the structure represented by the above-mentioned formula (T3) to the number of silicon atom in the organic silicon polymer contained in the above-mentioned toner particle is at least 5.0%. As a result of the proportion of the structure represented by the above-mentioned formula (T3) being at least 5.0%, storage stability and development durability improve. When this proportion is less than 5.0%, long-term storage stability decreases.

The proportion of the structure represented by the above-mentioned formula (T3) is preferably at least 10.0% and more preferably at least 20%. The proportion of the structure represented by the above-mentioned formula (T3) is preferably not more than 100.0%, more preferably not more than 90.0% and even more preferably not more than 80.0% from the viewpoints of charging performance and durability.

Furthermore, the proportion of the above-mentioned T unit structure can be controlled according to the type and amount of organic silicon compound used to form the organic silicon polymer, and the reaction temperature, reaction time, reaction solvent and pH when producing the organic silicon polymer.

(Polyester Resin)

The toner particle used in the present invention contains at least 1.0% by mass to less than 80.0% by mass of a polyester resin. The toner particle preferably contains at least 2.5% by mass to less than 75.0% by mass of the polyester resin and more preferably at least 5.0% by mass to less than 70.0% by mass of the polyester resin.

As a result of containing a specific amount of the specific polymer indicated below in the toner particle, toner can be obtained that has superior low-temperature fixability, storage stability, environmental stability and development durability.

The above-mentioned polyester resin is at least one polymer selected from the group consisting of:

a polymer obtained by condensation polymerization of an alcohol component containing at least 50.0 mol % of an aliphatic diol having from 2 to 16 (both inclusive) carbon atoms in an alcohol component, and a carboxylic acid component containing at least 50.0 mol % of an aliphatic dicarboxylic acid having from 2 to 16 (both inclusive) carbon atoms in a carboxylic acid component, a polymer obtained by condensation polymerization of an alcohol component containing at least 50 mol % of an aliphatic diol having from 2 to 16 (both inclusive) carbon atoms in an alcohol component, and a carboxylic acid component containing at least 50 mol % of an aromatic dicarboxylic acid having from 2 to 16 (both inclusive) carbon atoms in a carboxylic acid component, and a polymer obtained by condensation polymerization of an alcohol component containing at least 50.0 mol % of an aromatic dial in an alcohol component, and a carboxylic acid component containing at least 50.0 mol % of an aliphatic dicarboxylic acid having from 2 to 16 (both inclusive) carbon atoms in a carboxylic acid component.

As has been previously described, a toner can be obtained that has superior low-temperature fixability as a result of being a polymer containing a specific amount of an aliphatic diol having from 2 to 16 carbon atoms or an aliphatic dicarboxylic acid having from 2 to 16 carbon atoms.

In the case the number of carbon atoms of the aliphatic diol or aliphatic dicarboxylic acid is less than 2, storage stability tends to decrease, while in the case the number of carbon atoms exceeds 16, low-temperature fixability tends to decrease. The number of carbon atoms of the above-mentioned aliphatic diol or aliphatic dicarboxylic acid is preferably from 4 to 12 (both inclusive) and more preferably from 6 to 8 (both inclusive).

On the other hand, a toner having superior low-temperature fixability can be obtained by containing at least 50 mol % of an aliphatic dicarboxylic acid having from 2 to 16 carbon atoms in a carboxylic acid component. In addition, a toner having superior low-temperature fixability can be obtained by containing at least 50 mol % of an aliphatic diol having from 2 to 16 carbon atoms in an alcohol component.

In the case the content of the aliphatic diol having from 2 to 16 carbon atoms in the alcohol component is less than 50 mol %, there are cases in which storage stability decreases. In addition, in the case the content of the aliphatic dicarboxylic acid having from 2 to 16 carbon atoms in the carboxylic acid component is less than 50 mol %, there are cases in which storage stability decreases.

A toner having superior environmental stability can be obtained by containing at least 50 mol % of an aromatic dicarboxylic acid having from 2 to 16 carbon atoms in a carboxylic acid component. In addition, a toner having superior environmental stability can be obtained by containing at least 50 mol % of an aromatic diol in an alcohol component.

In the case the content of the aromatic diol in the alcohol component is less than 50 mol %, there are cases in which storage stability decreases. In addition, in the case the content of the aromatic dicarboxylic acid having from 2 to 16 carbon atoms in the dicarboxylic acid component is less than 50 mol %, there are cases in which storage stability decreases.

Furthermore, details, production methods and the like of each component that composes the above-mentioned polyester resin will be subsequently described.

(Organic Silicon Polymer)

A typical production example of the organic silicon polymer used in the present invention is a production method referred to as the sol-gel method.

The sol-gel method is a method that consists of carrying out hydrolysis and condensation polymerization in a solvent using, as a starting material, a metal alkoxide M(OR)n (wherein, M represents a metal, O represents oxygen, R represents a hydrocarbon and n represents the oxidation number of the metal) followed by gelling by going through a sol state, and is used in the synthesis of glass, ceramics, organic-inorganic hybrids and nanocomposites. The use of this production method enables various forms of functional materials such as surface layers, fibers, bulk forms or microparticles to be produced from the liquid phase at low temperatures.

More specifically, the organic silicon polymer contained in the toner particle is preferably formed by hydrolysis and condensation polymerization of a silicon compound represented by an alkoxysilane.

In addition, in one preferable aspect, a surface layer containing the organic silicon polymer is uniformly provided on the surface of the toner particle. As a result of a surface layer containing the organic silicon polymer being uniformly provided on the surface of the toner particle, environmental stability improves without having to carry out adhesion or adherence of inorganic fine particles as carried out in the toner of the related art, it is difficult for a decrease in toner performance to occur during long-term use, and a toner can be obtained that has superior storage stability.

Moreover, since the sol-gel method consists of forming a material by starting from a solution and then gelling that solution, various microstructures and shapes can be created. In the case of producing toner particles in an aqueous medium in particular, the organic silicon compound is easily made to be present on the surface of the toner particles due to hydrophilicity generated by hydrophilic groups in the manner of silanol groups of the organic silicon compound.

However, in the case the hydrophobicity of the organic silicon compound is large (such as in the case of the organic silicon compound having a functional group having high hydrophobicity), since it becomes difficult to make the organic silicon compound present on the surface layer of the toner particles, it becomes difficult for the toner particles to form a surface layer containing the organic silicon polymer as a result thereof. On the other hand, since hydrophobicity becomes excessively weak in the case the number of carbon atoms of the hydrocarbon group of the organic silicon compound is 0, toner charged state stability trends to decrease. The above-mentioned microstructure and shape can be adjusted according to the reaction temperature, reaction time, reaction solvent or pH as well as the type and added amount of the organic silicon compound.

The organic silicon polymer used in the present invention is preferably an organic silicon polymer obtained by polymerizing an organic silicon compound having a structure represented by the following formula (Z).

[Chemical Formula 3]

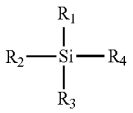

(Z)

$R_1$ represents a hydrocarbon group having from 1 to 6 (both inclusive) carbon atoms or aryl group. The hydrocarbon group represented by $R_1$ in the above-mentioned formula (Z) is a hydrocarbon group other than an aryl group. As a result of $R_1$ being a hydrocarbon group or aryl group, the hydrophilicity of the resulting organic silicon polymer can be improved and a toner having superior environmental stability can be obtained. In the case the hydrophilicity of $R_1$ is large, since fluctuations in the amount of charge in various environments tend to become large, the number of carbon atoms of $R_1$ is preferably from 1 to 3 in consideration of environmental stability. Preferable examples of hydrocarbon groups having from 1 to 3 carbon atoms include a methyl group, ethyl group, and propyl group, and preferable example of aryl groups include phenyl group. In this case, charging performance and inhibition of fogging are favorable. More preferably, $R_1$ is a methyl group from the viewpoints of environmental stability and storage stability.

$R_2$ to $R_4$ respectively and independently represent a halogen atom, hydroxyl group, acetoxy group or alkoxy group (to also be referred to as "reaction groups") and these reaction groups form a crosslinked structure by undergoing hydrolysis, addition polymerization and condensation polymerization, thereby allowing the obtaining of a toner having superior resistance to contamination of members and development durability. Hydrolysis properties are mild at room temperature, and a methoxy group or ethoxy group is preferable from the viewpoint of precipitation and coating the surface of the toner particles. In addition, hydrolysis, addition polymerization and condensation polymerization of $R_2$ to $R_4$ can be controlled according to reaction temperature, reaction time, reaction solvent and pH.

One type or a plurality of types of an organic silicon compound having three reaction groups ($R_2$, $R_3$ and $R_4$) in a molecule thereof (to also be referred to as "trifunctional silane"), excluding $R_1$ in formula (Z) indicated above, is used alone or in combination to obtain the organic silicon polymer used in the present invention.

In addition, in the present invention, the content of the organic silicon polymer in the toner particle is preferably from at least 0.5% by mass to not more than 50% by mass and more preferably from at least 0.75% by mass to not more than 40.0% by mass.

The following lists examples of compounds represented by the above-mentioned formula (Z):

trifunctional methylsilanes in the manner of methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane or methyldiethoxyhydroxysilane, trifunctional silanes in the manner of ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane or hexyltrihydroxysilane, and trifunctional phenylsilanes in the manner of phenyltrimethoxysilane, phenyltriethoxysilane, phenyltrichlorosilane, phenyltriacetoxysilane or phenyltrihydroxysilane.

trifunctional vinylsilanes in the manner of vinyltrimethoxysilane, vinyltriethoxysilane, vinyldiethoxymethoxysilane, vinylethoxydimethoxysilane, vinyltrichlorosilane, vinylmethoxydichlorosilane, vinylethoxydichlorosilane, vinyldimethoxychlorosilane, vinylmethoxyethoxychlorosilane, vinyldiethoxychlorosilane, vinyltriacetoxysilane, vinyldiacetoxymethoxysilane, vinyldiacetoxyethoxysilane, vinylacetoxydimethoxysilane, vinylacetoxymethoxyethoxysilane, vinylacetoxydiethoxysilane, vinyltrihydroxysilane, vinylmethoxydihydroxysilane, vinylethoxydihydroxysilane, vinyldimethoxyhydroxysilane, vinylethoxymethoxyhydroxysilane or vinyldiethoxyhydroxysilane, and trifunctional allylsilanes in the manner of allyltrimethoxysilane, allyltriethoxysilane, allyltrichlorosilane, allyltriacetoxysilane or allyltrihydroxysilane.

In the organic silicon polymer used in the present invention, the content of the organic silicon compound having a structure represented by formula (Z) is preferably at least 50 mol % and more preferably at least 60 mol % in the organic silicon polymer. Toner environmental stability can be further improved by making the content of the organic silicon compound that satisfies formula (Z) to be at least 50 mol %.

In addition, in the present invention, an organic silicon polymer may be used that is obtained by combining the use of the organic silicon compound having a structure represented by formula (Z) with an organic silicon compound having four reaction groups in a molecule thereof (tetrafunctional silane), an organic silicon compound having three reaction groups in a molecule thereof (trifunctional silane), an organic silicon compound having two reaction groups in a molecule thereof (bifunctional silane), or an organic silicon compound having a single reaction group in a molecule thereof (monofunctional silane), to a degree that does not impair the effects of the present invention. Examples of organic silicon compounds that may be used in combination include:

dimethyldiethoxysilane, tetraethoxysilane, hexamethyldisilazane, 3-glycidoxypropyltrimethoxysilane, 3-glycidoxypropylmethyldiethoxysilane, 3-glycidoxypropyltriethoxysilane, p-styryltrimethoxysilane, 3-methacryloxypropylmethyldimethoxysilane, 3-methacryloxypropylmethyldiethoxysilane, 3-methacryloxypropyltriethoxysilane, 3-acryloxypropyltrimethoxysilane, 3-aminopropyltrimethoxysilane, 3-aminopropyltriethoxysilane, 3-(2-aminoethyl)aminopropyltrimethoxysilane, 3-(2-aminoethyl)aminopropyltriethoxysilane, 3-phenylaminopropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, 3-glycidoxypropyltrimethoxysilane, 3-glycidoxypropylmethyldimethoxysilane, 3-glycidoxypropylmethyldiethoxysilane, hexamethyldisiloxane, tetraisocyanate silane, methyltriisocyanate silane or vinyltriisocyanate silane.

In general, the bonding state of siloxane bonds formed according to the degree of acidity of the reaction medium is known to change in sol-gel reactions. More specifically, in the case the reaction medium is acidic, hydrogen ions are electrophilically added to oxygen of a single reaction group (such as an alkoxy group (—OR group)). Next, oxygen atoms in water molecules coordinate to silicon atoms and become hydrosilyl groups by a substitution reaction. In the case adequate water is present, since a single oxygen of a reaction group (such as an alkoxy group (—OR group)) is attacked by a single H+, when the content of H+ in the reaction medium is low, the substitution reaction to a hydroxyl group becomes slow. Accordingly, all reaction groups bound to silicon atom undergo a condensation polymerization reaction prior to hydrolysis, thereby resulting in one-dimensional linear polymers and two-dimensional polymers being formed comparatively easily.

On the other hand, in the case the reaction medium is alkaline, hydroxide ions go through a pentacoordinated intermediate by being added to silicon. Consequently, all reaction groups (such as alkoxy groups (—OR group)) are easily eliminated and easily substituted with silanol groups. In the case of using a silicon compound having three or more reaction groups in the same silicon atom in particular, hydrolysis and condensation polymerization occur three-dimensionally and an organic silicon polymer is formed that has numerous three-dimensional crosslinking bonds. In addition, the reaction is completed in a short period of time.

Thus, in order to form the organic silicon polymer, it is preferable to carry out a sol-gel reaction with the reaction medium in an alkaline state, and specifically in the case of producing in an aqueous medium, the pH is preferably 8.0 or higher. As a result, an organic silicon polymer can be formed that demonstrates higher strength and superior durability. In addition, the sol-gel reaction is preferably carried out at a reaction temperature of 90° C. or higher and the reaction time is preferably 5 hours or longer.

As a result of carrying out this sol-gel reaction at the above-mentioned reaction temperature and reaction time, the formation of coalesced particles, formed by the mutual bonding of silane compounds in the state of a sol or gel on the surface of the toner particles, can be inhibited.

Moreover, an organic titanium compound or organic aluminum compound may also be used with the above-mentioned organic silicon compound to a degree that does not impair the effects of the present invention.

The following lists examples of organic titanium compounds: titanium methoxide, titanium ethoxide, titanium n-propoxide, tetra-i-propoxytitanium, tetra-n-butoxytitanium, titanium isobutoxide, titanium butoxide dimer, titanium tetra-2-ethylhexoxide, titanium diisopropoxybis(acetylacetonate), titanium tetraacetylacetonate, titanium di-2-ethylhexoxybis(2-ethyl-3-hydroxyhexoxide), titanium diisopropoxybis(ethylacetoacetate), tetrakis(2-ethylhexyloxy) titanium, di-i-propoxybis(acetylacetonate) titanium, titanium lactate, titanium methacrylate isopropoxide, triisopropoxy titanate, titanium methoxypropoxide and titanium stearyl oxide.

The following lists examples of organic aluminum compounds:

aluminum (III)-n-butoxide, aluminum (III) s-butoxide, aluminum (III) s-butoxide bis(ethylacetoacetate), aluminum (III) t-butoxide, aluminum (III) di-s-butoxide ethylacetoacetate, aluminum (III) diisopropoxide ethylacetoacetate, aluminum (III) ethoxide, aluminum (III) ethoxyethoxyethoxide, aluminum hexafluoropentanedionate, aluminum (III) 3-hydroxy-2-methyl-4-pyronate, aluminum (III) isopropoxide, aluminum 9-octadecenylacetoacetate diisopropoxide, aluminum (III) 2,4-pentanedionate, aluminum phenoxide and aluminum (III) 2,2,6,6-tetramethyl-3,5-heptanedionate.

Furthermore, these compounds may be used alone or a plurality of types may be used in combination. Charge quantity can be adjusted by suitably combining these compounds or changing the added amounts thereof.

In the toner of the present invention, the ratio (dSi/[dC+dO+dSi+dS]) of the density of silicon atom dSi to the total density (dC+dO+dSi+dS) of the density of carbon atom dC, the density of oxygen atom do, the density of silicon atom dSi and the density of sulfur atom dS in the surface layer of toner particle as determined by measuring the surface layer (top layer, outermost layer) of the toner particle using X-ray photoelectron spectroscopic analysis (Electron Spectroscopy for Chemical Analysis (ESCA)) is preferably at least 1.0 atom %, more preferably at least 2.5 atom %, even more preferably at least 5.0 atom % and particularly preferably at least 15.0 atom %.

The above-mentioned ESCA consists of carrying out an elementary analysis of the surface layer present at thickness of several nm in the center (midpoint of the long axis) of toner particle from the surface of the toner particle. As a result of the ratio (dSi/[dC+dO+dSi+dS]) of the density of silicon atom in the surface layer of toner particle being at least 1.0 atom %, the surface free energy of the surface layer can be reduced. By adjusting the above-mentioned silicon atom density to be 1.0 atom % or more, flowability can be further improved and the occurrence of contamination of members and fogging can be more effectively inhibited.

On the other hand, the above-mentioned ratio of the density of silicon atom (dSi/[dC+dO+dSi+dS]) in the surface layer of toner particle is preferably not more than 33.3 atom % and more preferably not more than 28.6 atom % from the viewpoint of charging performance.

The above-mentioned density of silicon atom in the surface layer of toner particle can be controlled according to the structure of Rf in the above-mentioned formula (T3), the method used to produce toner particle, reaction temperature, reaction time, reaction solvent and pH when forming the organic silicon polymer. In addition, the above-mentioned density of silicon atom can also be controlled according to the content of the organic silicon polymer. Furthermore, the surface layer of toner particle in the present invention refers to the layer present at a thickness of at least 0.0 nm to not more than 5.0 nm moving from the surface of the toner particle towards the center of the toner particle (midpoint of the long axis).

In the toner of the present invention, the ratio [dSi/dC] of the density of silicon atom dSi (atom %) to the density of carbon atom dC (atom %), as determined by measuring the surface layer of toner particles using X-ray photoelectron spectroscopic analysis (Electron Spectroscopy for Chemical Analysis (ESCA)), is preferably at least 0.15 to not more than 5.00. As a result of making [dSi/dC] to be within the above-mentioned range, free surface energy can be reduced, thereby resulting in the effect of improving resistance to contamination of members and development durability. The ratio [dSi/dC] is more preferably at least 0.20 to not more than 4.00 and even more preferably 0.30 or more in order to further improve resistance to contamination of members and development durability.

In addition, in the case the ratio [dSi/dC] of the density of silicon atom dSi (atom %) to the density of carbon atom dC (atom %) is less than 0.15, the amount of carbon in the surface layer of toner particle becomes relatively high, and since this results in an increase in free surface energy, aggregation of particles and affinity with members becomes stronger and contamination of members tends to worsen. On the other hand, in the case [dSi/dC] exceeds 5.00, hydrophobicity attributable to carbon atom becomes excessively low and environmental stability and development durability tend to decrease.

The ratio [dSi/dC] of the surface layer of toner particle containing the organic silicon polymer can be controlled according to the structure of Rf in the above-mentioned formula (T3), the number of hydrophilic groups and the reaction temperature, reaction time, reaction solvent and pH of addition polymerization and condensation polymerization. In addition, the ratio can also be controlled by the amount of the organic silicon polymer.

In the present invention, when observing a cross-section of a toner particle using a transmission electron microscope (TEM), the toner particle cross-section is equally divided into 16 sections centering on the intersection of the long axis L of the toner particle cross-section and an axis L90 that passes through the center of the long axis L and is perpendicular thereto, and when dividing axes from the above-mentioned center to the surface of the toner particle are respectively designated as An (n =1 to 32), then the average thickness Dav. of the surface layer of a toner particle that contains the organic silicon polymer at 32 locations on the above-mentioned dividing axes (to also be referred to as "surface layer average thickness Dav.") is preferably at least 5.0 nm to not more than 150.0 nm. As a result, the occurrence of bleeding attributable to resin components, release agent and the like present inside from the surface layer of toner particle is inhibited, and a toner can be obtained that has superior storage stability, environmental stability and development durability. The surface layer average thickness Dav. of the toner particle is preferably at least 7.5 nm to not more than 125.0 nm and more preferably at least 10.0 nm to not more than 100.0 nm from the viewpoint of storage stability. When the surface layer average thickness Dav. of the toner particle is less than 5.0 nm, bleeding attributable to resin components, release agent and the like present in the toner particle occurs easily. Consequently, the surface properties of the toner particle change and environmental stability and development durability tend to worsen. In the case the surface layer average thickness Dav. of the toner particle exceeds 150.0 nm, low-temperature fixability tends to worsen.

The surface layer average thickness Dav. of toner particle containing the organic silicon polymer can be controlled according to the structure of Rf in the above-mentioned formula (T3), the number of hydrophilic groups and the reaction temperature, reaction time, reaction solvent and pH of addition polymerization and condensation polymerization. In addition, the surface layer average thickness Dav. can also be controlled with the amount of organic silicon polymer.

(Toner Particle Production Method)

The following provides an explanation of a method for producing the toner particle.

Although the following provides an explanation of a specific mode in which the organic silicon polymer is contained within the toner particle and in the surface layer thereof, the present invention is not limited thereto.

An example of a first production method consists of a mode in which toner particles are obtained by forming (granulating), in an aqueous medium, particles of a polymerizable monomer composition containing an organic silicon compound for obtaining an organic silicon polymer, a polymerizable monomer for forming a binder resin, and the above-mentioned polyester resin followed by polymerizing the polymerizable monomer (to also be referred to as "suspension polymerization").

An example of a second production method consists of a mode in which, after preliminarily obtaining a parent body of toner particles, the parent body of the toner particles is placed in an aqueous medium and a surface layer of an organic silicon polymer is formed on the parent body of the toner particles in an aqueous medium. The parent body of the toner particles maybe obtained by melting and kneading a binder resin and the above-mentioned polyester resin followed by pulverizing, by aggregating binder resin particles and particles of the above-mentioned polyester resin in an aqueous medium and allowing them to associate, or by dissolving a binder resin, an organic silicon compound for obtaining an organic silicon polymer and the above-mentioned polyester resin in an organic solvent, suspending the resulting organic phase dispersion in an aqueous medium to form (granulate) particles and polymerizing followed by removing the organic solvent.

An example of a third production method consists of a mode in which toner particles are obtained by dissolving a binder resin, an organic silicon compound for obtaining an organic silicon polymer and the above-mentioned polyester resin in an organic solvent, suspending the resulting organic phase dispersion in an aqueous medium, forming (granulating) particles and polymerizing followed by removing the organic solvent.

An example of a fourth production method consists of a mode in which toner particles are formed (granulated) by aggregating binder resin particles, particles of the above-mentioned polyester resin, and particles containing an organic silicon compound for obtaining an organic silicon polymer in the form of a sol or gel, in an aqueous medium and allowing to associate therein.

An example of a fifth production method consists of a mode in which an organic silicon polymer is formed in the surface layer of toner particles by spraying a solvent containing an organic silicon compound for obtaining an organic silicon polymer (which may also be polymerized to a certain degree) onto the surface of a parent body of toner particles by a spray drying method, and polymerizing or drying the surface with hot air current or by cooling. The parent body of the toner particles may be obtained by melting and kneading a binder resin and the above-mentioned polyester resin followed by pulverizing, by aggregating binder resin particles and particles of the above-mentioned polyester resin in an aqueous medium and allowing them to associate, or by dissolving a binder resin, an organic silicon compound for obtaining an organic silicon polymer and the above-mentioned polyester resin in an organic solvent, suspending the resulting organic phase dispersion in an aqueous medium to form (granulate) particles, and polymerizing followed by removing the organic solvent.

Toner particles produced according to these production methods have favorable environmental stability (and favorable charging performance under harsh conditions in particular) since an organic silicon polymer is formed within or near the surface layer of the toner particles. In addition, changes in the surface status of toner particles caused by bleeding of the resin present within the toner and the release agent added as necessary are inhibited even in harsh environments.

In the present invention, the resulting toner or toner particles may be subjected to surface treatment using hot air current. As a result of carrying out surface treatment of the toner particles or toner using hot air current, condensation polymerization of the organic silicon polymer near the surface of the toner particles can be accelerated and environmental stability and development durability can be improved.

Any means maybe used for the above-mentioned surface treatment using hot air current provided the surface of the toner particles or toner can be treated with hot air current and the toner particles or toner treated with hot air current can be cooled with cold air.

Examples of apparatuses used to carry out surface treatment using hot air current include a hybridization system (Nara Machinery Co., Ltd.), Mechano-Fusion system (Hosokawa Micron Ltd.), Faculty (Hosokawa Micron Ltd.) and Meteo Rainbow MR type (Nippon Pneumatic Mfg. Co., Ltd.).

Examples of the aqueous medium in the above-mentioned production methods are listed below:

water, alcohols in the manner of methanol, ethanol or propanol, and mixed solvents thereof.

Among the previously described production methods, the suspension polymerization method of the first production method is preferable for the production method of the toner particles of the present invention. In the suspension polymerization method, the organic silicon polymer easily precipitates uniformly on the surface of the toner particles, adhesion between the surface layer and interior of the toner particles is superior, and storage stability, environmental stability and development durability are favorable. The following provides a further explanation of the suspension polymerization method.

A colorant, release agent, polar resin and low-molecular weight resin may be added as necessary to the previously described polymerizable monomer composition. In addition, following completion of the polymerization step, particles formed are washed and recovered by filtration and drying to obtain toner particles. Furthermore, the temperature may be raised during the latter half of the above-mentioned polymerization step. Moreover, in order to remove unreacted polymerizable monomer or by-products, a portion of the dispersion medium can be distilled off from the reaction system during the latter half of the polymerization step or following completion of the polymerization step.

Furthermore, the materials described below are not only applied to a suspension polymerization method, but can also be applied to other of the previously described production methods.

(Low-Molecular Weight Resin)

The following resins can be used for the above-mentioned low-molecular weight resin within a range that does not have an effect on the effects of the present invention:

homopolymers of styrene and derivatives thereof in the manner of polystyrene or polyvinyltoluene, styrene-based copolymers in the manner of styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer or styrene-maleic acid ester copolymer, and polymethyl methacrylate, polybutyl methacrylate, polyvinyl acetate, polyethylene, polypropylene, polyvinyl butyral, silicone resin, polyester resin, polyamide resin, epoxy resin, polyacrylic resin, rosin, modified rosin, terpene resin, phenol resin, aliphatic or alicyclic hydrocarbon resin or aromatic petroleum resin. These can be used alone or as a mixture thereof.

In the above-mentioned low-molecular weight resin, the resin may have a polymerizable functional group for the purpose of improving changes in viscosity of the toner at high temperatures. Examples of polymerizable functional groups include a vinyl group, isocyanato group, epoxy group, amino group, carboxyl group (carboxylic acid group) and hydroxyl group.

Furthermore, the weight-average molecular weight (Mw) of the tetrahydrofuran (THF)-soluble matter of the above-mentioned low-molecular weight resin as measured by gel permeation chromatography (GPC) is preferably at least 2,000 to not more than 6,000.

The above-mentioned low-molecular weight resin is used for the purpose of improving toner particle shape, dispersibility and fixing performance of materials, or image characteristics. Since the monomer is water-soluble, when desiring to introduce into toner particles a monomer component containing a hydrophilic group in the manner of an amino group, carboxyl group, hydroxyl group, sulfo group (sulfonic acid group), glycidyl group or nitrile group, which cannot be used in aqueous suspensions as a result of dissolving and causing emulsion polymerization, the low-molecular weight resin can be used in the form of a copolymer in the manner of a random copolymer, block copolymer or graft copolymer of these monomer components, and vinyl compounds in the manner of styrene or ethylene, condensation polymers in the manner of polyester or polyamide, or addition polymers in the manner of polyether or polyimine.

(Polyester Resin)

Examples of the alcohol component that composes the polyester resin used in the present invention include the following aliphatic diols having from 2 to 16 carbon atoms and aromatic diols indicated below. Two or more types of the following alcohol components may also be used in combination:

ethylene glycol, 1,2-propylene glycol, 1,3-propylene glycol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,15-pentadecanediol, 1,16-hexadecanediol and the like, and, aromatic diols such as bisphenol A or alkylene oxide adducts of bisphenol A.

Here, an α,ω-linear alkanediol is preferable, 1,4-butanediol or 1,6-hexanediol is more preferable, and 1,4-butanediol is even more preferable for obtaining a polyester resin having a melting point.

The content of the aliphatic diol having from 2 to 16 carbon atoms or aromatic diol in the alcohol component is 50 mol % or more. The content is preferably from at least 80 mol % to not more than 100 mol % and more preferably from at least 90 mol % to not more than 100 mol % in order to further improve low-temperature fixability due to sudden changes in viscosity.

In addition, in the present invention, a polyvalent alcohol other than the above-mentioned aliphatic diol having from 2 to 16 carbon atoms or aromatic diol may also be used for the alcohol component in combination therewith. Examples of the polyvalent alcohol component include alcohols having a valence of 3 or more such as glycerin, pentaerythritol or trimethylolpropane. Two or more types of these alcohol components may also be used in combination.

Examples of the carboxylic acid component that composes the polyester resin used in the present invention include the aromatic dicarboxylic acids and aliphatic dicarboxylic acids indicated below. Two or more types of the following carboxylic acid components may also be used in combination.

Examples of aromatic dicarboxylic acids having from 2 to 16 carbon atoms include aromatic dicarboxylic acids such as phthalic acid, isophthalic acid or terephthalic acid, anhydrides of these acids and alkyl esters (wherein the alky group has from 1 to 3 carbon atoms) thereof. Examples of the above-mentioned alkyl group include a methyl group, ethyl group, propyl group and isopropyl group. Terephthalic acid or alkyl esters of terephthalic acid (wherein the alkyl group has from 1 to 3 carbon atoms) are preferable since they improve charged state stability of the toner.

Examples of aliphatic dicarboxylic acids having from 2 to 16 carbon atoms include malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid and 1,14-tetradecanedicarboxylic acid. In addition, additional examples include anhydrides of these acids and alkyl esters (wherein the alkyl group has from 1 to 3 carbon atoms) of these acids.

The aliphatic dicarboxylic acid having from 2 to 16 carbon atoms may also be an unsaturated aliphatic dicarboxylic acid having from 2 to 16 carbon atoms, and examples thereof include fumaric acid and maleic acid.

The content of the above-mentioned aromatic dicarboxylic acid having from 2 to 16 carbon atoms in the carboxylic acid component is at least 50 mol %, preferably at least 50 mol % to not more than 70 mol % and more preferably at least 50 mol % to not more than 60 mol %.

The content of the above-mentioned aliphatic dicarboxylic acid having from 2 to 16 carbon atoms in the carboxylic acid component is at least 50 mol %, preferably at least 70 mol % to not more than 100 mol % and more preferably at least 90 mol % to not more than 100 mol %.

Furthermore, in the case the above-mentioned aliphatic dicarboxylic acid having from 2 to 16 carbon atoms is an unsaturated aliphatic dicarboxylic acid having from to 16 carbon atoms, the content of the unsaturated aliphatic dicarboxylic acid having from 2 to 16 carbon atoms in the carboxylic acid component is preferably less than 50 mol %, more preferably at least 0.01 mol % to not more than 25.0 mol % and even more preferably at least 0.10 mol % to not more than 10.0 mol %. Low-temperature fixability improves as a result of the content of the unsaturated aliphatic dicarboxylic acid having from 2 to 16 carbon atoms in the carboxylic acid component being less than 50 mol %.

In addition, in the present invention, a carboxylic acid component having a valence of 3 or more may also be used for the carboxylic acid component in addition to the aromatic dicarboxylic acid component having from 2 to 16 carbon atoms or the aliphatic dicarboxylic acid having from 2 to 16 carbon atoms.

Examples of polyvalent dicarboxylic acids having a valence of 3 or more include trimellitic acid, tri-n-ethyl 1,2,4-benzenetricarboxylic acid, tri-n-butyl 1,2,4-benzenetricarboxylic acid, tri-n-hexyl 1,2,4-benzenetricarboxylic acid, triisobutyl 1,2,4-benzenetricarboxylic acid, tri-n-octyl 1,2,4-benzenetricarboxylic acid, tri-2-ethylhexyl 1,2,4-benzenetricarboxylic acid and lower alkyl esters of tricarboxylic acids. Among these polyvalent carboxylic acid compounds having a valence of 3 or more, trimellitic acid and trimellitic acid anhydride are preferable because they are inexpensive and allow the reaction to be easily controlled.

In addition, monovalent carboxylic acids or monovalent alcohols may also be used as necessary. More specifically, examples thereof include monovalent carboxylic acids in the manner of benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid or stearic acid, and monovalent alcohols in the manner of n-butanol, isobutanol, sec-butanol, n-hexanol, n-octanol, lauryl alcohol, 2-ethylhexanol, decanol, cyclohexanol, benzyl alcohol or dodecyl alcohol. Two or more types of these carboxylic acid components and alcohol components can also be used in combination.

In the polyester resin used in the present invention, the ratio of the total of all aliphatic dicarboxylic acid components and all aliphatic diol components to the total of all carboxylic acid components and all alcohol components (100 mol %) is preferably 25 mol % or more. This ratio is more preferably 50 mol % or more in order to improve low-temperature fixability.

The above-mentioned polyester resin can be produced by an ordinary polyester synthesis method. More specifically, the polyester resin is obtained by subjecting a polyvalent carboxylic acid and polyvalent alcohol to an esterification or transesterification reaction and then subjecting the polyvalent alcohol having a low boiling point to a condensation polymerization reaction in accordance with ordinary methods under reduced pressure or by introducing nitrogen gas. An ordinary esterification catalyst or transesterification catalyst in the manner of sulfuric acid, titanium butoxide, dibutyltin oxide, manganese acetate or magnesium acetate can be used as necessary when carrying out an esterification or transesterification reaction. In addition, a known polymerization catalyst in the manner of titanium butoxide, dibutyltin oxide, tin acetate, zinc acetate, tin disulfide, antimony trioxide or germanium dioxide can be used with respect to polymerization. In addition, there are no particular limitations on the polymerization temperature or amount of catalyst, and may be arbitrarily selected as necessary.

(Vinyl-Modified Polyester Resin)

In a preferable mode of the present invention, the above-mentioned polyester resin is a vinyl-modified polyester resin that has been modified by a vinylic monomer.

This vinyl-modified polyester resin has a structure in which a polyester segment is bound to a vinylic polymer, low-temperature fixability is imparted by the polyester skeleton, and charged state stability and storage stability can be improved by the vinylic polymer.

The above-mentioned vinyl-modified polyester resin is preferably that in which a vinylic polymer, obtained by addition polymerization of an aromatic vinyl monomer and acrylic acid ester monomer, and a polyester segment are chemically bonded, or that in which a vinylic polymer, obtained by addition polymerization of an aromatic vinyl monomer and methacrylic acid ester monomer, and a polyester segment are chemically bonded.

In addition, the vinyl-modified polyester resin can be formed by a transesterification reaction between a hydroxyl group contained in the polyester segment and the acrylic acid ester or methacrylic acid ester contained in the vinylic polymer, or by an esterification reaction between a hydroxyl group contained in the polyester segment and a carboxyl group contained in the vinylic polymer.

In the present invention, the above-mentioned polyester segment of the vinyl-modified polyester resin is at least one polymer selected from the group consisting of:

a polymer obtained by condensation polymerization of an alcohol component containing at least 50.0 mol % of an aliphatic diol having from 2 to 16 carbon atoms in an alcohol component, and a carboxylic acid component containing at least 50.0 mol % of an aliphatic dicarboxylic acid having from 2 to 16 carbon atoms in a carboxylic acid component, a polymer obtained by condensation polymerization of an alcohol component containing at least 50 mol % of an aliphatic diol having from 2 to 16 carbon atoms in an alcohol component, and a carboxylic acid component containing at least 50 mol % of an aromatic dicarboxylic acid having from 2 to 16 carbon atoms in a carboxylic acid component, and a polymer obtained by condensation polymerization of an alcohol component containing at least 50.0 mol % of an aromatic diol in an alcohol component, and a carboxylic acid component containing at least 50.0 mol % of an aliphatic dicarboxylic acid having from 2 to 16 carbon atoms in a carboxylic acid component.

The above-mentioned vinyl-modified polyester resin preferably contains at least 1.0% by mass to not more than 60.0% by mass, more preferably at least 2.5% by mass to not more than 50.0% by mass and even more preferably at least 5.0% by mass to not more than 20.0% by mass of monomer that composes the resin in the form of vinylic monomer. Charging performance and low-temperature fixability can be further improved by making the content of the vinylic monomer to be within the above-mentioned ranges.

A particularly preferable vinyl-modified polyester resin preferably contains 50 mol % or more of a linear alkyl diol having from 2 to 16 carbon atoms as the alcohol component that composes the resin with respect to the total amount of alcohol (100 mol %). In addition, the vinyl-modified polyester resin preferably contains 50 mol % or more of linear chain type aryl dicarboxylic acid having from 2 to 16 carbon atoms and/or a linear alkyl dicarboxylic acid having from 2 to 16 carbon atoms as the carboxylic acid component that composes the resin based on 100 mol % for the total amount of carboxylic acid.

Examples of vinylic monomers that can be used to form the above-mentioned vinyl-modified polyester resin include vinylic polymerizable monomers capable of being copolymerized with styrene. Examples of such vinylic polymerizable monomers include the vinylic polymerizable monomers to be subsequently described.

In addition, in the case of forming a vinyl-modified polyester resin, the polymerizable group that bonds the vinylic polymer and polyester segment is preferably contained in at least any of a polyester segment, vinylic polymer, monomer that composes a polyester and vinylic polymerizable monomer. Examples of monomers composing the polyester segment that are capable of reacting with the vinylic polymer include unsaturated dicarboxylic acids such as fumaric acid, maleic acid, citraconic acid or itaconic acid or anhydrides thereof. Examples of monomers composing the vinylic polymer include those having a carboxyl group or hydroxyl group and acrylic acid or methacrylic acid.

An example of a method for producing the above-mentioned vinyl-modified polyester resin includes the production methods indicated in (1) to (4) below.

(1) A method consisting of forming a vinylic polymer followed by forming a vinyl-modified polyester resin while polymerizing a polyester segment in the presence of the vinylic polymer. An organic solvent can be used as is suitable.

(2) A method consisting of forming a polyester segment followed by producing a vinyl-modified polyester resin while polymerizing a vinylic polymerizable monomer in the presence of the polyester segment.

(3) A method consisting of forming a vinylic polymer and a polyester segment followed by producing a vinyl-modified polyester resin by adding a vinylic polymerizable monomer and/or monomer that composes the polyester segment (such as an alcohol or carboxylic acid) in the presence of these polymers. In this case as well, an organic solvent can be used as is suitable.

(4) A method consisting of respectively forming a vinylic polymer and a polyester segment followed by producing a vinyl-modified polyester resin by bonding the two by ester bonding or amide bonding and the like. In this case as well, an organic solvent can be used as is suitable.

In the production methods described in (1) to (4) above, the reactions may also be carried out in the presence of a low softening point compound. Among the production methods described in (1) to (4) above, the production method described in (2) is particularly preferable since it is easy to control the molecular weight of the vinylic polymer.

Moreover, a vinyl-modified polyester resin having a block form in which the vinylic polymer is bound to the end terminal of the polyester segment can be obtained by introducing a vinyl group only onto the end terminal of the polyester segment and polymerizing the vinylic monomer, using the production method described in (2) above. The above-mentioned vinyl-modified polyester resin is particularly preferable from the viewpoints of low-temperature fixability and charged state stability.

In the present invention, the content of the above-mentioned vinyl-modified polyester resin (content of the polyester segment in the vinyl-modified polyester resin) in the toner particle is at least 1.0% by mass to less than 80.0% by mass, preferably at least 2.5% by mass to less than 75.0% by mass and more preferably at least 5.0% by mass to less than 70.0% by mass.

The polyester resin used in the present invention is preferably a polyester resin having a melting point. In addition, the melting point of the above-mentioned polyester resin is preferably from at least 20.0° C. to not more than 90.0° C. The melting point of the above-mentioned polyester resin is more preferably from at least 40.0° C. to not more than 70.0° C. and even more preferably from at least 50.0° C. to not more than 65.0° C. from the viewpoints of storage stability and low-temperature fixability.

In the present invention, the weight-average molecular weight (Mw) of tetrahydrofuran (THF)-soluble matter of the above-mentioned polyester resin and the above-mentioned vinyl-modified polyester resin as measured by gel permeation chromatography (GPC) is preferably from at least 2,000 to not more than 50,000. Blocking resistance, development durability and low-temperature fixability can be realized by making the weight-average molecular weight (Mw) of the polyester resin and vinyl-modified polyester resin to be within the above-mentioned range. Furthermore, in the present invention, the weight-average molecular weight (Mw) of the polyester resin and vinyl-modified polyester resin can be adjusted according to the reaction temperature, reaction time, amount of catalyst, amount of crosslinking agent and type of monomer used when producing the polyester resin and vinyl-modified polyester resin.

In the present invention, in the molecular weight distribution of tetrahydrofuran (THF)-soluble matter of the above-mentioned polyester resin and the above-mentioned vinyl-modified polyester resin as measured by gel permeation chromatography (GPC), the ratio [Mw/Mn] of the weight-average molecular weight (Mw) to the number-average molecular weight (Mn) is preferably from at least 5.0 to not more than 100.0 and more preferably from at least 5.0 to not more than 50.0. The size of the fixable temperature range can be increased by making the ratio [Mw/Mn] to be within the above-mentioned ranges.

(Polyester Resin A)

The above-mentioned toner particle can contain another polyester resin (to be referred to as "polyester resin A") in addition to the above-mentioned polyester resin.

A polyester resin other than a polyester in the form of:

a polymer obtained by condensation polymerization of an alcohol component containing at least 50.0 mol % of an aliphatic diol having from 2 to 16 carbon atoms in an alcohol component, and a carboxylic acid component containing at least 50.0 mol % of an aliphatic dicarboxylic acid having from 2 to 16 carbon atoms in a carboxylic acid component, a polymer obtained by condensation polymerization of an alcohol component containing at least 50 mol % of an aliphatic diol having from 2 to 16 carbon atoms in an alcohol component, and a carboxylic acid component containing at least 50 mol % of an aromatic dicarboxylic acid having from 2 to 16 carbon atoms in a carboxylic acid component, or a polymer obtained by condensation polymerization of an alcohol component containing at least 50.0 mol % of an aromatic dial in an alcohol component, and a carboxylic acid component containing at least 50.0 mol % of an aliphatic dicarboxylic acid having from 2 to 16 carbon atoms in a dicarboxylic acid component is used for polyester resin A. Furthermore, the above-mentioned other polyester resin (polyester resin A) can also be used as a resin binder.

The polyester resin A can be produced by a known production method from a polyvalent alcohol component and a polyvalent carboxylic acid component. Examples of the above-mentioned polyvalent alcohol component and polyvalent carboxylic acid component include the compounds or derivatives thereof indicated below.

Examples of the polyvalent alcohol component that composes the polyester resin A include bisphenol A-ethylene oxide adducts and bisphenol A-propylene oxide adducts. These polyvalent alcohols may be used alone or may be used as a mixture. However, the polyvalent alcohol is not limited thereto, but rather other alcohols having a valence of 3 or more can be used as crosslinking components.

Examples of the polyvalent carboxylic acid component that composes the polyester resin A include naphthalenedicarboxylic acid, phthalic acid, isophthalic acid, terephthalic acid, dicarboxylic acid anhydrides in the manner of phthalic anhydride and ester compounds of dicarboxylic acids in the manner of dimethyl terephthalate. Polyester resin A may be crosslinked by using the following carboxylic acids having a valence of 3 or more: trimellitic acid, tri-n-ethyl 1,2,4-tricarboxylic acid, tri-n-butyl 1,2,4-tricarboxylic acid, tri-n-hexyl 1,2,4-tricarboxylic acid, triisobutyl 1,2,4-benzenetricarboxylic acid, tri-n-octyl 1,2,4-benzenetricarboxylic acid, tri-2-ethylhexyl 1,2,4-benzenetricarboxylic acid and lower alkyl esters of tricarboxylic acids. However, the polyvalent carboxylic acid component is not limited thereto, but rather other carboxylic acids having a valence of 3 or more or lower alkyl esters of carboxylic acids having a valence of 3 or more can be used as crosslinking components.

In addition, monovalent carboxylic acids or monovalent alcohols may also be used. More specifically, examples thereof include monovalent carboxylic acids in the manner of benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid or stearic acid, and monovalent alcohols in the manner of n-butanol, isobutanol, sec-butanol, n-hexanol, n-octanol, lauryl alcohol, 2-ethylhexanol, decanol, cyclohexanol, benzyl alcohol or dodecyl alcohol.

In the present invention, the weight-average molecular weight (Mw) of tetrahydrofuran (THF)-soluble matter of the polyester resin A as measured by gel permeation chromatography (GPC) is preferably from at least 2,000 to not more than 50,000. Blocking resistance, development durability and environmental stability can be realized by making the weight-average molecular weight (Mw) of the polyester resin A to be within the above-mentioned range. Furthermore, in the present invention, the weight-average molecular weight (Mw) of the polyester resin A can be adjusted according to the reaction temperature, reaction time, amount of catalyst, amount of crosslinking agent and type of monomer of the polyester resin A.

In the present invention, in the molecular weight distribution of tetrahydrofuran (THF)-soluble matter of the above-mentioned polyester resin A as measured by gel permeation chromatography (GPC), the ratio [Mw/Mn] of the weight-average molecular weight (Mw) to the number-average molecular weight (Mn) is preferably from at least 5.0 to not more than 100.0 and more preferably from at least 5.0 to not more than 50.0. The size of the fixable temperature range can be increased by making the ratio [Mw/Mn] to be within the above-mentioned ranges.

(Polymerizable Monomer)

Preferable examples of the polymerizable monomer in the above-mentioned suspension polymerization method include the following vinylic polymerizable monomers: styrene, styrene derivatives in the manner of α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene or p-phenylstyrene, acrylic polymerizable monomers in the manner of methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethyl acrylate, diethylphosphate ethyl acrylate, dibutylphosphate ethyl acrylate or 2-benzoyloxy ethyl acrylate, methacrylic polymerizable monomers in the manner of methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethyl methacrylate or dibutylphosphate ethyl methacrylate, methylene aliphatic monocarboxylic acid esters, vinyl esters in the manner of vinyl acetate, vinyl propionate, vinyl benzoate, vinyl butyrate, or vinyl formate, vinyl ethers in the manner of vinyl methyl ether, vinyl ethyl ether or vinyl isobutyl ether, and vinyl ketones in the manner of vinyl methyl ketone, vinyl hexyl ketone or vinyl isopropyl ketone.

(Polymerization Initiator)

A polymerization initiator may be added during polymerization of the above-mentioned polymerizable monomer. Examples of polymerization initiators are as follows:

azo-based or diazo-based polymerization initiators in the manner of 2,2'-azobis-(2,4-divaleronitrile), 2,2'-azobisisobutyronitrile, 1,1'-azobis(cyclohexane-1-carbonitrile), 2,2'-azobis-4-methoxy-2,4-dimethylvaleronitrile or azobisisobutyronitrile, and peroxide-based polymerization initiators in the manner of benzoyl peroxide, methyl ethyl ketone peroxide, diisopropylperoxycarbonate, cumene hydroperoxides, 2,4-dichlorobenzoyl peroxide or lauroyl peroxide. These polymerization initiators are preferably added to the polymerizable monomer at 0.5% by mass to 30.0% by mass and may be used alone or in combination.

A chain transfer agent may be added during polymerization of the polymerizable monomer in order to control the molecular weight of the binder resin that composes the toner particles. The added amount of chain transfer agent is preferably 0.001% by mass to 15.000% by mass of the polymerizable monomer.

On the other hand, a crosslinking agent may be added during polymerization of the polymerizable monomer in order to control the molecular weight of the binder resin that composes the toner particles. The following lists examples of crosslinking agents:

divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, respective diacrylates of polyethylene glycol #200, #400 and #600, dipropylene glycol diacrylate, polypropylene glycol diacrylate, polyester type diacrylate (trade name: Manda, Nippon Kayaku Co., Ltd.) and those in which acrylate has been changed to methacrylate.

In addition, the following lists examples of polyfunctional crosslinking agents:

pentaerythritol triacrylate, trimethylolethane triacrylate, trimethylolpropane triacrylate, tetramethylolmethane tetraacrylate, oligoester acrylates and methacrylates thereof, 2,2-bis(4-methacryloxy-polyethoxyphenyl)propane, diacryl phthalate, triallyl cyanurate, triallyl isocyanurate, triallyl trimellitate and diallyl chlorendate. The added amount of crosslinking agent is preferably 0.001% by mass to 15.000% by mass with respect to the polymerizable monomer.

In the case the medium used during polymerization of the above-mentioned polymerizable monomer is an aqueous medium, the compounds indicated below can be used as dispersion stabilizers in an aqueous medium of particles of the polymerizable monomer composition.

Examples of inorganic dispersion stabilizers include tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

In addition, examples of organic dispersion stabilizers include polyvinyl alcohol, gelatin, methyl cellulose, methyl hydroxypropyl cellulose, ethyl cellulose, carboxymethyl cellulose sodium salt and starch.

Moreover, commercially available nonionic, anionic and cationic surfactants can also be used. The following lists examples of such surfactants:

sodium dodecyl sulfate, sodium tetradecyl sulfate, sodium pentadecyl sulfate, sodium octyl sulfate, sodium oleate, sodium laurate and potassium stearate.

In the present invention, in the case of preparing an aqueous medium using a poorly soluble inorganic dispersion stabilizer, the added amount of these dispersion stabilizers is preferably from at least 0.2 parts by mass to not more than 2.0 parts by mass based on 100 parts by mass of the polymerizable monomer composition. In addition, an aqueous medium is preferably prepared using from at least 300 parts by mass to not more than 3,000 parts by mass of water based on 100 parts by mass of the polymerizable monomer composition.

In the present invention, in the case of preparing an aqueous medium in which a poorly soluble inorganic dispersion stabilizer has been dispersed as described above, a commercially available dispersion stabilizer may be used as it is. In addition, a poorly soluble inorganic dispersing agent may be formed while stirring at high speed in a liquid medium such as water in order to obtain a dispersion stabilizer having a fine, uniform particle size. More specifically, in the case of using tricalcium phosphate for the dispersion stabilizer, a preferable dispersion stabilizer can be obtained by mixing an aqueous sodium phosphate solution and an aqueous calcium chloride solution while stirring at high speed to form fine particles of tricalcium phosphate.

(Binder Resin)

The binder resin that composes the toner particle preferably comprises a vinylic resin. The vinylic resin is formed by polymerization of the previously described vinylic polymerizable monomer. Vinylic resins have superior environmental stability. In addition, the use of a vinylic resin is preferable since it is superior for acquiring precipitation onto the surface of toner particles, surface uniformity and long-term storage stability of the organic silicon polymer obtained by polymerizing the organic silicon compound having a structure represented by the above-mentioned formula (Z).

Among these vinylic resins, styrene resin, styrene-acrylic resin or styrene-methacrylic resin is preferable. The use of these resins results in favorable adhesion with the organic silicon polymer and further improves storage stability and development durability.

(Colorant)

In the present invention, the toner particle may also contain a colorant as necessary. There are no particular limitations on the above-mentioned colorant and a known colorant indicated below can be used.

Condensed azo compounds such as yellow iron oxide, Naples yellow, naphthol yellow S, hansa yellow G, hansa yellow 10G, benzidine yellow G, benzidine yellow GR, quinoline yellow lake, permanent yellow NCG or tartrazine lake, isoindolinone compounds, anthraquinone compounds, azo metal complexes, methine compounds and allylamide compounds are used as yellow pigment. Specific examples thereof include the following:

C.I. pigment yellow 12, C.I. pigment yellow 13, C.I. pigment yellow 14, C.I. pigment yellow 15, C.I. pigment yellow 17, C.I. pigment yellow 62, C.I. pigment yellow 74, C.I. pigment yellow 83, C.I. pigment yellow 93, C.I. pigment yellow 94, C.I. pigment yellow 95, C.I. pigment yellow 109, C.I. pigment yellow 110, C.I. pigment yellow 111, C.I. pigment yellow 128, C.I. pigment yellow 129, C.I. pigment yellow 147, C.I. pigment yellow 155, C.I. pigment yellow 168 and C.I. pigment yellow 180.

The following lists examples of orange pigment:

permanent orange GTR, pyrazolone orange, Vulcan orange, benzidine orange G, indanthrene brilliant orange RK and indanthrene brilliant orange GK.

Examples of red pigment include condensed azo compounds such as bengala, permanent red 4R, lithol red, pyrazolone red, watching red calcium salt, lake red C, lake red D, brilliant carmine 6B, brilliant carmine 3B, eosin lake, rhodamine lake B or alizalin lake, diketopyrrolopyrole compounds, anthraquinone, quinacridone compounds, basic dye lake compounds, naphthol compounds, benzimidazolone compounds, thioindigo compounds and perylene compounds. Specific examples thereof include the following:

C.I. pigment red 2, C.I. pigment red 3, C.I. pigment red 5, C.I. pigment red 6, C.I. pigment red 7, C.I. pigment red 23, C.I. pigment red 48:2, C.I. pigment red 48:3, C.I. pigment red 48:4, C.I. pigment red 57:1, C.I. pigment red 81:1, C.I. pigment red 122, C.I. pigment red 144, C.I. pigment red 146, C.I. pigment red 166, C.I. pigment red 169, C.I. pigment red 177, C.I. pigment red 184, C.I. pigment red 185, C.I. pigment red 202, C.I. pigment red 206, C.I. pigment red 220, C.I. pigment red 221 and C.I. pigment red 254.

Examples of blue pigments include copper phthalocyanine compounds and derivatives thereof such as alkali blue lake, Victoria blue lake, phthalocyanine blue, metal-free phthalocyanine blue, phthalocyanine blue partial chloride, fast sky blue or indanthrene blue BG, anthraquinone compounds an basic dye lake compounds. Specific examples thereof include the following:

C.I. pigment blue 1, C.I. pigment blue 7, C.I. pigment blue 15, C.I. pigment blue 15:1, C.I. pigment blue 15:2, C. I. pigment blue 15:3, C. I. pigment blue 15:4, C. I. pigment blue 60, C.I. pigment blue 62 and C.I. pigment blue 66.

Examples of violet pigments include fast violet B and methyl violet lake.

Examples of green pigments include pigment green B, malachite green lake and final yellow green G. Examples of white pigments include zinc oxide, titanium oxide, antimony oxide and zinc sulfide.

Examples of black pigments include carbon black, aniline black, nonmagnetic ferrite, magnetite, and black pigments adjusted to black color using the above-mentioned yellow colorants, red colorants and blue colorants. These colorants can be used alone or as a mixture and can further be used in the state of a solid solution.

In addition, it is necessary to pay attention to the polymerization inhibitory properties and dispersion medium migration properties of colorants depending on the method used to produce the toner. Surface modification may be carried out as necessary by subjecting the colorant to surface treatment with a substance that does not inhibit polymerization. Particular caution is required when using dyes and carbon black since there are many that have polymerization inhibitory properties.

In addition, an example of a preferable method for treating dyes consists of polymerizing the polymerizable monomer in advance in the presence of dye followed by adding the resulting colored polymer to the polymerizable monomer composition. On the other hand, with respect to carbon black, in addition to treatment similar to that carried out on the above-mentioned dye, carbon black may be treated with a substance that reacts with a surface functional group of the carbon black (such as an organosiloxane).

Furthermore, the content of colorant is preferably from 3.0 parts by mass to 15.0 parts by mass based on 100.0 parts by mass of binder resin or polymerizable monomer.

(Release Agent)

In the present invention, a release agent is preferably contained as one of the materials that compose the toner particle. Examples of release agents able to be used in the above-mentioned toner particle include petroleum-based waxes and derivatives thereof in the manner of paraffin wax, microcrystalline wax or petrolatum, montan wax and derivatives thereof, hydrocarbon waxes obtained by the Fischer-Tropsch process and derivatives thereof, polyolefin waxes and derivatives thereof in the manner of polyethylene or polypropylene, natural waxes and derivatives thereof in the manner of carnauba wax and candelilla wax, higher aliphatic alcohols, fatty acids or compounds thereof in the manner of stearic acid or palmitic acid, acid amide waxes, ester waxes, ketones, hydrogenated castor oil and derivatives thereof, vegetable waxes, animal waxes and silicone resin.

Furthermore, derivatives include oxides, block copolymers and graft modification products with vinylic monomers.

Furthermore, the content of the release agent is preferably from 5.0 parts by mass to 20.0 parts by mass based on 100.0 parts by mass of the binder resin or polymerizable monomer.

(Charge Control Agent)

In the present invention, the toner particle may contain a charge control agent as necessary. A known agent can be used for the charge control agent. A charge control agent that has a rapid charging speed and is able to stably maintain a constant amount of charge is particularly preferable. Moreover, in the case of producing the toner particles by a direct polymerization method, a charge control agent that has a low degree of polymerization inhibition and is substantially free of substances that are soluble in an aqueous medium is particularly preferable.

Examples of charge control agents that control toner particles to a negative charge include the following:

organic metal compounds and chelate compounds such as monoazo metal compounds, acetylacetone metal compounds, aromatic oxycarboxylic acids, aromatic dicarboxylic acids or oxycarboxylic acid- and dicarboxylic acid-based metal compounds. In addition, other examples include aromatic oxycarboxylic acids, aromatic mono- and polycarboxylic acids and metal salts thereof, anhydrides, esters and phenol derivatives such as bisphenol. Moreover, additional examples include urea derivatives, metal-containing salicylic acid-based compounds, metal-containing naphthoic acid-based compounds, boron compounds, quaternary ammonium salts and calixarene.

On the other hand, examples of charge control agents that control toner particles to a positive charge include the following:

nigrosine modification products obtained from nigrosine and compounds in the manner of fatty acid metal salts, guanidine compounds, imidazole compounds, quaternary ammonium salts in the manner of tributylbenzylammonium-1-hydroxy-4-naphthosulfonate or tetrabutylammonium tetrafluoroborate and analogues thereof in the form of onium salts and lake pigments thereof in the manner of phosphonium salts, triphenylmethane dyes and lake pigments thereof (with examples of laking agents including phosphotungstic acid, phosphomolybdic acid, phosphotungstomolybdic acid, tannic acid, lauric acid, gallic acid, ferricyanides and ferrocyanides), metal salts of higher fatty acids and resin-based charge control agents.

These charge control agents can be used alone or two or more types can be used in combination. Among these charge control agents, metal-containing salicylic acid-based compounds are preferable, and the metal thereof is preferably aluminum or zirconium in particular. The most preferable examples of charge control agents are aluminum 3,5-di-tert-butyl salicylate compounds.

In addition, a polymer having a sulfonic acid-based functional group is preferable as a resin-based charge control agent. Polymers having a sulfonic acid-based functional group refer to polymers or copolymers having a sulfo group, sulfonate group or sulfonic acid ester group.

Examples of polymers or copolymers having a sulfo group, sulfonate group or sulfonic acid ester group include highly polymerized compounds having a sulfo group in aside chain thereof. Highly polymerized compounds that are styrene and/or styrene(meth)acrylic acid ester copolymers containing a sulfo group-containing (meth) acrylamide-based monomer at a copolymerization ratio of 2% by mass or more and preferably 5% by mass or more, and have a glass transition temperature (Tg) of from 40° C. to 90° C. are preferable. Charged state stability improves at high humidity.

The above-mentioned sulfo group-containing (meth)acrylamide-based monomer is preferably a monomer represented by the following formula (X), and specific examples thereof include 2-acrylamido-2-methylpropanesulfonate and 2-methacrylamido-2-methylpropanesulfonate:

[Chemical Formula 4]

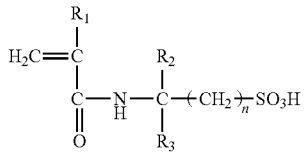

(X)

(wherein, $R_1$ represents a hydrogen atom or methyl group, $R_2$ and $R_3$ respectively and independently represent a hydrogen atom or alkyl group, alkenyl group, aryl group or alkoxy group having 1 to 10 carbon atoms, and n represents an integer of 1 to 10).

As a result of the above-mentioned polymer having a sulfo group contained in the toner particles at from 0.1 parts by mass to 10.0 parts by mass based on 100 parts by mass of the binder resin, the charged state of the toner particles can be further improved.

The added amount of these charge control agents is preferably from 0.01 parts by mass to 10.00 parts by mass based on 100.00 parts by mass of the binder resin or polymerizable monomer.

(Organic Fine Particles, Inorganic Fine Particles)

The toner of the present invention can be a toner having various types of organic fine particles or inorganic fine particles externally added to the toner particle for the purpose of imparting various properties. The above-mentioned organic fine particles or inorganic fine particles preferably have a particle diameter that is 1/10 or less the weight-average particle diameter of the toner particle in consideration of durability when adding to the toner particle.

The following fine particles are used for the organic fine particles or inorganic fine particles:

(1) fluidity-imparting agents: silica, alumina, titanium oxide, carbon black and carbon fluoride;

(2) abrasives: strontium titanate, metal oxides in the manner of cerium oxide, alumina, magnesium oxide or chromium oxide, nitrides in the manner of silicon nitride, carbides in the manner of silicon carbide and metal salts in the manner of calcium sulfate, barium sulfate or calcium carbonate;

(3) lubricants: fluorine-based resin powders in the manner of vinylidene fluoride or polytetrafluoroethylene, and fatty acid metal salts in the manner of zinc stearate or calcium stearate; and, (4) charge controlling particles: metal oxides in the manner of tin oxide, titanium oxide, zinc oxide, silica or alumina and carbon black.

Organic fine particles or inorganic fine particles are used to treat the surface of the toner particle in order to improve toner flowability and unify toner charge. Since subjecting the organic fine particles or inorganic fine particles to hydrophobic treatment makes it possible to adjust toner charging performance and achieve improvement of charging characteristics in high humidity environments, organic fine particles or inorganic fine particles that have undergone hydrophobic treatment are used preferably. Examples of treatment agents used in hydrophobic treatment of the organic fine particles or inorganic fine particles include unmodified silicone varnish, various types of modified silicone varnish, unmodified silicone oil, various types of modified silicone oil, silane compounds, silane coupling agents, other organic silicon compounds and organic titanium. compounds. These treatment agents may be used alone or in combination.

Among these, inorganic fine particles treated with silicone oil are preferable. More preferably, inorganic fine particles are treated with silicone oil either simultaneous or subsequent to hydrophobic treatment with a coupling agent. Hydrophobically treated inorganic fine particles treated with silicone oil maintain a high amount of toner charge even in high humidity environments, and are preferable in terms of reducing selective development.

The added amount of these organic fine particles or inorganic fine particles is preferably from 0.00 parts by mass to 10.00 parts by mass, more preferably from 0.01 parts by mass to 10.00 parts by mass, even more preferably from 0.05 parts by mass to 5.00 parts by mass, and particularly preferably from 0.10 parts by mass to 3.00 parts by mass based on 100.00 parts by mass of toner particle. Adjusting to the proper added amount improves contamination of members caused by the organic fine particles or inorganic fine particles becoming embedded in or released from the toner particles. These organic fine particles or inorganic fine particles may be used alone or a plurality thereof may be used in combination.

In the present invention, the BET specific surface area of the organic fine particles or inorganic fine particles is preferably from 10 $m^2/g$ to 450 $m^2/g$.

The BET specific surface area of the organic fine particles or inorganic fine particles can be determined by low-temperature gas absorption using the dynamic constant pressure method in accordance with the BET method (and preferably the BET multipoint method). For example, BET specific surface area ($m^2/g$) can be calculated by allowing nitrogen gas to be adsorbed onto the surface of a sample and measuring according to the BET multipoint method using the "Gemini 2375 Ver. 5.0" specific surface area measuring instrument (Shimadzu Corp.).

The organic fine particles or inorganic fine particles may be strongly adhered or attached to the surface of the toner particle. Examples of externally added mixers for strongly adhering or attaching the organic fine particles or inorganic fine particles to the surface of the toner particle include a Henschel mixer, mechano-fusion mixer, cyclomixer, turbulizer, flexomix mixer, hybridization mixer, mechanohybrid mixer and nobilta mixer. In addition, the organic fine particles or inorganic fine particles can be strongly adhered or attached by increasing rotating speed or prolonging treatment time.

The following provides an explanation of physical properties of the toner.

In the toner of the present invention, viscosity at 80° C. as measured with a capillary rheometer of the constant load extrusion type is preferably from at least 1,000 Pa·s to not more than 40,000 Pa·s. The toner has superior low-temperature fixability as a result of the viscosity at 80° C. being from at least 1,000 Pa·s to not more than 40,000 Pa·s. The viscosity at 80° C. is more preferably from at least 2,000 Pa·s to not more than 20,000 Pa·s. Furthermore, in the present invention, the above-mentioned viscosity at 80° C. can be adjusted according to the added amount of low-molecular weight resin, type of monomer used during production of binder resin, amount of initiator, reaction temperature and reaction time during production of binder resin.

The viscosity of the toner at 80° C. as measured with a capillary rheometer of the constant load extrusion type can be determined according to the method indicated below.

Measurement is carried out under the following conditions using the CFT-500D Flow Tester (Shimadzu Corp.) for the apparatus.

Sample: Approximately 1.0 g of toner is weighed out followed by molding for 1 minute using a pressure molding machine at a load of 100 $kg/cm^2$.

Die opening diameter: 1.0 mm

Die length: 1.0 mm

Cylinder pressure: $9.807\times10^5$ (Pa)

Measurement mode: Temperature ramp method

Ramp rate: 4.0° C./min

According to the above-mentioned method, viscosity at 80° C. (Pa·s) is determined by measuring toner viscosity (Pa·s) over a range of 30° C. to 200° C. That value is the viscosity at 80° C. as measured with a capillary rheometer of the constant load extrusion type.

The weight-average particle diameter (D4) of the toner of the present invention is preferably from 4.0 μm to 9.0 μm, more preferably from 5.0 μm to 8.0 μm, and even more preferably from 5.0 μm to 7.0 μm.

The glass transition temperature (Tg) of the toner of the present invention is preferably from at least 35° C. to not more than 100° C., more preferably from at least 40° C. to not more than 80° C., and even more preferably from at least 45° C. to not more than 70° C. As a result of the glass transition temperature being within the above-mentioned ranges, blocking resistance, cold offset resistance and transparency of transmitted images of overhead projector film can be further improved.

The content of tetrahydrofuran (THF)-insoluble matter of the toner of the present invention is preferably less than 50.0% by mass, more preferably from at least 0.0% by mass to less than 45.0% by mass, and even more preferably from at least 5.0% by mass to less than 40.0% by mass of toner components other than the toner colorant and inorganic fine particles. Low-temperature fixability can be improved by making the content of THF-insoluble matter to be less than 50.0% by mass.

The above-mentioned content of THF-insoluble matter of the toner refers to the mass ratio of ultra-high-molecular weight polymer component (substantially cross-linked polymer) that has become insoluble in THF solvent. In the present invention, the content of THF-insoluble matter of the toner refers to the value measured as indicated below.

1.0 g of toner is weighed out (W1 g), placed in a filter paper thimble (No. 86R (trade name), Toyo Roshi Kaisha Ltd.), placed in a Soxhlet extractor and extracted for 20 hours using 200 mL of THF as solvent to concentrate the soluble matter extracted by the solvent, followed by vacuum-drying for several hours at 40° C. and weighing the amount of the THF-soluble resin component (W2 g). The weight of components other than the resin component such as colorant in the toner particles is designated as (W3 g). The content of THF-insoluble matter is then determined from the equation indicated below.

$$\text{Content of THF-insoluble matter (mass \%)}=\{(W1-(W3+W2))/(W1-W3)\}\times100$$

The content of THF-insoluble matter in the toner can be adjusted according to the degree of polymerization and degree of crosslinking of the binder resin.

In the present invention, the weight-average molecular weight (Mw) of tetrahydrofuran (THF)-soluble matter of the toner (to also be referred to as a "weight-average molecular weight of the toner") as measured by gel permeation chromatography (GPC) is preferably from at least 5,000 to not more than 50,000. Blocking resistance and development durability as well as low-temperature fixability and high image gloss can be realized by making the weight-average molecular weight (Mw) of the toner to be within the above-mentioned range. Furthermore, in the present invention, the weight-average molecular weight (Mw) of the toner can be adjusted with the amount added and weight-average molecular weight (Mw) of the low-molecular weight resin, and the reaction temperature, reaction time, amount of polymerization initiator, amount of chain transfer agent and amount of crosslinking agent during production of toner particles.

In the present invention, in the molecular weight distribution of tetrahydrofuran (THF)-soluble matter of the toner as measured by gel permeation chromatography (GPC), the ratio [Mw/Mn] of the weight-average molecular weight (Mw) to the number-average molecular weight (Mn) is preferably from at least 5.0 to not more than 100.0 and more preferably from at least 5.0 to not more than 30.0. The size of the fixable temperature range can be increased by making the ratio [Mw/Mn] to be within the above-mentioned ranges.

(Methods for Measuring Physical Properties of Toner or Toner Particle)

(Preparation of Tetrahydrofuran (THF)-Insoluble Matter of Toner Particle)

Tetrahydrofuran (THF)-insoluble matter of the toner particle was prepared as indicated below.

10.0 g of toner particle was weighed out, placed in a filter paper thimble (No. 86R (trade name), Toyo Roshi Kaisha Ltd.), placed in a Soxhlet extractor and extracted for 20 hours using 200 mL of THF as solvent, followed by vacuum-drying the residue in the filter paper thimble for several hours at 40° C. and using the resulting dried residue as THF-insoluble matter of the toner particle for use in NMR measurement.

Furthermore, in the present invention, in the case the above-mentioned organic fine particles or inorganic fine particles have been added externally to the toner, the toner particle is obtained after removing the above-mentioned organic fine particles or inorganic fine particles according to the method indicated below.

160 g of sucrose (Kishida Chemical Co., Ltd.) are added to 100 mL of ion exchange water followed by dissolving while heating the ion exchange water to prepare a concentrated sucrose solution. 31.0 g of the above-mentioned concentrated sucrose solution and 6 mL of Contaminon N (trade name) (10% by mass aqueous solution of neutral detergent for cleaning precision measuring instruments having a pH of 7 and composed of a nonionic surfactant, anionic surfactant and an organic builder, Wako Pure Chemical Industries, Ltd.) are placed in a centrifuge tube to produce a dispersion. 1.0 g of toner is added to this dispersion and clumps of the toner are broken up with a spatula.

The centrifuge tube is shaken for 20 minutes with a shaker at 350 strokes per minute (spm). After shaking, the solution is transferred to a glass tube (50 mL) for a swing rotor and separated with a centrifugal separator for 30 minutes at 3500 rpm. After visually confirming that the toner and aqueous solution have adequately separated, the toner separated in the uppermost layer is collected with a spatula and the like. After filtering the collected toner with a vacuum filter, the toner is dried for 1 hour or more with a dryer. The dried product is crushed with a spatula to obtain toner particle.

(Confirmation of Structure Represented by Formula (T3))

The following method is used to confirm the structure represented by the above-mentioned formula (T3) in the organic silicon polymer contained in the toner particle.

The presence or absence of a hydrocarbon group or aryl group represented by Rf in the above-mentioned formula (T3) was confirmed by $^{13}$C-NMR and $^{29}$Si-NMR.

In addition, the detailed structure of the above-mentioned formula (T3) was confirmed by $^{1}$H-NMR, $^{13}$C-NMR and $^{29}$Si-NMR. The apparatus and measurement conditions used are indicated below.

(Measurement Conditions)

Apparatus: Bruker Avance III 500

Probe: 4 mm MAS BB/1H

Measuring temperature: Room temperature

Sample rotating speed: 6 kHz

Sample: 150 mg of measurement sample (the above-mentioned THF-insoluble matter of toner particle for NMR measurement) were placed in a sample tube having a diameter of 4 mm.

The presence or absence of a hydrocarbon group or aryl group represented by Rf in the above-mentioned formula (T3) was confirmed by this method. When a signal was confirmed, the structure represented by the above-mentioned formula (T3) was determined to be "present".

($^{13}$C-NMR (Solid) Measurement Conditions)

Measured nucleus frequency: 125.77 MHz

Standard substance: Glycine (external standard: 176.03 ppm)

Observation width: 37.88 kHz

Measurement method: CP/MAS

Contact time: 1.75 msec

Repetition time: 4 sec

Cumulative number: 2048

LB value: 50 Hz ($^{29}$Si-NMR (Solid) Measurement Conditions)

(Measurement Conditions)

Apparatus: Bruker Avance III 500

Probe: 4 mm MAS BB/1H

Measuring temperature: Room temperature

Sample rotating speed: 6 kHz

Sample: 150 mg of measurement sample (THF-insoluble matter of toner particle for NMR measurement) were placed in a sample tube having a diameter of 4 mm.

Measured nucleus frequency: 99.36 MHz

Standard substance: DSS (external standard: 1.534 ppm)

Observation width: 29.76 kHz

Measurement method: DD/MAS, CP/MAS $^{29}$Si 90°

Pulse width: 4.00 μsec @−1 dB

Contact time: 1.75 msec to 10 msec

Repetition time: 30 sec (DD/MAS), 10 sec (CP/MAS)

Cumulative number: 2048

LB value: 50 Hz (Calculation of Proportion of Structure Represented by Formula (T3) (T Unit Structure, T3 Structure) to Number of Silicon Atom of Organic Silicon Polymer Contained in Toner Particle)

The proportion [ST3](%) of the structure represented by the above-mentioned formula (T3) to the number of silicon atom in the organic silicon polymer contained in the toner particle is determined in the manner indicated below.

In $^{29}$Si-NMR measurement of tetrahydrofuran (THF)-insoluble matter of the toner particle, when the area obtained by subtracting silane monomer from the total peak area of the organic silicon polymer is defined as SS, and the peak area of structures represented by the above-mentioned formula (T3) is designated as S(T3), then ST3(%) is represented by the equation indicated below.

$$ST3(\%)=\{S(T3)/SS\}\times 100$$

Following $^{29}$ Si-NMR measurement of THF-insoluble matter of the toner particle, peaks were resolved to an X4 structure, in which the number of $O_{1/2}$ bound to silicon represented by the following general formula (X4) is 4.0, X3 structure, in which the number of $O_{1/2}$ bound to silicon represented by the following general formula (X3) is 3.0, X2 structure, in which the number of $O_{1/2}$ bound to silicon represented by the following general formula (X2) is 2.0, X1 structure, in which the number of $O_{1/2}$ bound to silicon represented by the following general formula (X1) is 1.0, and structure represented by formula (T3) by curve-fitting a plurality of silane components having different substituents and linking groups in the toner particle, followed by calculating the mol percentage (mol %) of each component from the area ratio of each peak:

[Chemical Formula 5]

(X4)

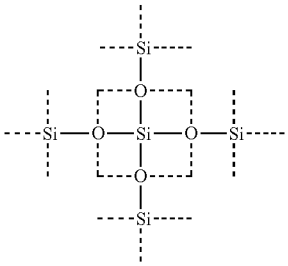

[Chemical Formula 6]

(X3)

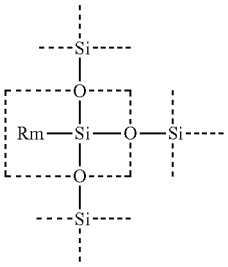

(wherein, Rm represents an organic group, halogen atom, hydroxyl group or alkoxy group bound to silicon),

[Chemical Formula 7]

(X2)

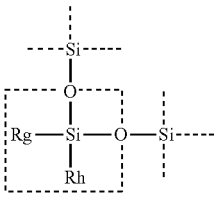

(wherein, Rg and Rh represent organic groups, halogen atoms, hydroxyl groups or alkoxy groups bound to silicon),

[Chemical Formula 8]

(X1)

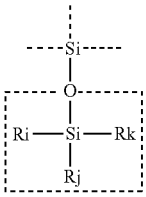

(wherein, Ri, Rj and Rk represent organic groups, halogen atoms, hydroxyl groups or alkoxy groups bound to silicon).

Excalibur for Windows (trade name) Version 4.2 (EX series) software for the JNM-EX400 manufactured by JEOL Ltd. is used for curve fitting. Measurement data is imported by clicking "1D Pro" from the menu icon. Next, "Curve fitting function" is selected from "Command" in the menu bar to carryout curve fitting. An example thereof is shown in FIG. 1. Peak partitioning is carried out so that the peaks in the synthetic peak differences (a), which are the differences between the synthetic peaks (b) and the measurement results (d), become the smallest.

The area of the X1 structure, the area of the X2 structure, the area of the X3 structure and the area of the X4 structure are determined followed by determining SX1, SX2, SX3 and SX4 from the equations indicated below.

(Confirmation of Partial Structures of T3, X1, X2, X3 and X4)

The partial structures of T3, X1, X2, X3 and X4 can be confirmed by $^{1}$H-NMR, $^{13}$C-NMR and $^{29}$Si-NMR.

Following NMR measurement, the peaks were resolved to an X1 structure, X2 structure, X3 structure, X4 structure and T3 structure by curve fitting a plurality of silane components having different substituents and linking groups in the toner particle, followed by calculating the mol % of each component from the area ratio of each peak.

In the present invention, silane structure is determined based on chemical shift values, and in $^{29}$Si-NMR measurement of the toner particle, the total of the area of the X1 structure, the area of the X2 structure, the area of the X3 structure and the area of the X4 structure, obtained by excluding monomer components from total peak area, was taken to be the total peak area (SS) of the organic silicon polymer.

$$SX1+SX2+SX3+SX4=1.00$$

SX1={area of X1 structure/SS}
SX2={area of X2 structure/SS}
SX3={area of X3 structure/SS}
SX4={area of X4 structure/SS}
ST3={area of T3 structure/SS}

The chemical shift values of silicon in the X1 structure, X2 structure, X3 structure, X4 structure and T3 structure are indicated below.

Example of X1 structure (Ri=Rj=—$OC_2H_5$, Rk=—$CH_3$): −47 ppm

Example of X2 structure (Rg=—$OC_2H_5$, Rh=—$CH_3$): −56 ppm

Example of X3 structure and T3 structure (Rf=Rm=—$CH_3$): −65 ppm

In addition, the chemical shift value of silicon in the case an X4 structure is present is indicated below.

X4 structure: −108 ppm (Density of Silicon Atom Present in Surface Layer of Toner Particle (Atom %))

The density of a silicon atom [dSi] (atom %), the density of a carbon atom [dC] (atom %), the density of an oxygen atom [dO] (atom %) and the density of a sulfur atom [dS] (atom %) present in the surface layer of the toner particle were calculated by carrying out a surface composition analysis using an X-ray photoelectron spectroscopic analysis (ESCA: Electron Spectroscopy for Chemical Analysis).

In the present invention, the ESCA apparatus and measurement conditions are as indicated below.

Apparatus used: Quantum 2000, Ulvac-Phi Inc.

X-ray photoelectron spectrometer measurement conditions: X-ray source: Al Kα

X-rays: 100 μm, 25 W, 15 kV

Raster: 300 μm×200 μm

Pass energy: 58.70 eV

Step size: 0.125 eV

Neutralizing electron gun: 20 μA, 1 V

Ar ion gun: 7 mA, 10 V

Number of sweeps: 15 for Si, 10 for C, 5 for 0 and 5 for S

In the present invention, the density of the silicon atom [dSi], the concentration of the carbon atom [dC], the concentration of the oxygen atom [dO] and the concentration of the sulfur atom [dS] (all in atom %) present in the surface layer of the toner particle were calculated from the measured peak intensities of each element using the relative sensitivity factors provided by Ulvac-Phi Inc.

(Measurement of Proportion at which Surface Layer Thickness (FRAn) is 5.0 nm or Less and Surface Layer Average Thickness (Dav.) as Measured by Cross-Sectional Observation of Toner Particle Using Transmission Electron Microscope (TEM))

In the present invention, observation of cross-sections of the toner particle was carried out using the method indicated below.

The specific method used to observe toner particle cross-sections consists of dispersing the toner particles in normal temperature-curable epoxy resin followed by allowing to stand for 2 days in an atmosphere at 40° C. to allow the epoxy resin to cure. A thin section of sample is then cut out from the resulting cured product using a microtome equipped with a diamond blade. This sample is magnified at a magnification factor of 10,000 to 100,000 with a transmission electron microscope (trade name: Tecnai TF20XT, FEI Co.) (TEM) followed by observing a cross-section of the toner particles.

In the present invention, contrast is confirmed to become brighter as atomic weight increased by utilizing differences in atomic weights of atoms present in the binder resin and organic silicon polymer used. Moreover, staining with triruthenium tetraoxide and triosmium tetraoxide is used to generate contrast between materials. In the present invention, thinly sliced samples were placed in a chamber and stained at a density of 5 and staining time of 15 minutes using a vacuum electron staining apparatus (trade name: VSC4R1H, Filgen, Inc.).

Circle-equivalent diameter Dtem of the particle used in this measurement was determined from cross-section of the toner particle obtained from the above-mentioned TEM micrographs, and that value was taken to be contained within a width of ±10% of the weight-average particle diameter of the toner particle as determined by the method to be subsequently described.

(Measurement of Proportion at which Thickness of Surface Layer (FRAn) is 5.0 nm or Less)

Figure 2:
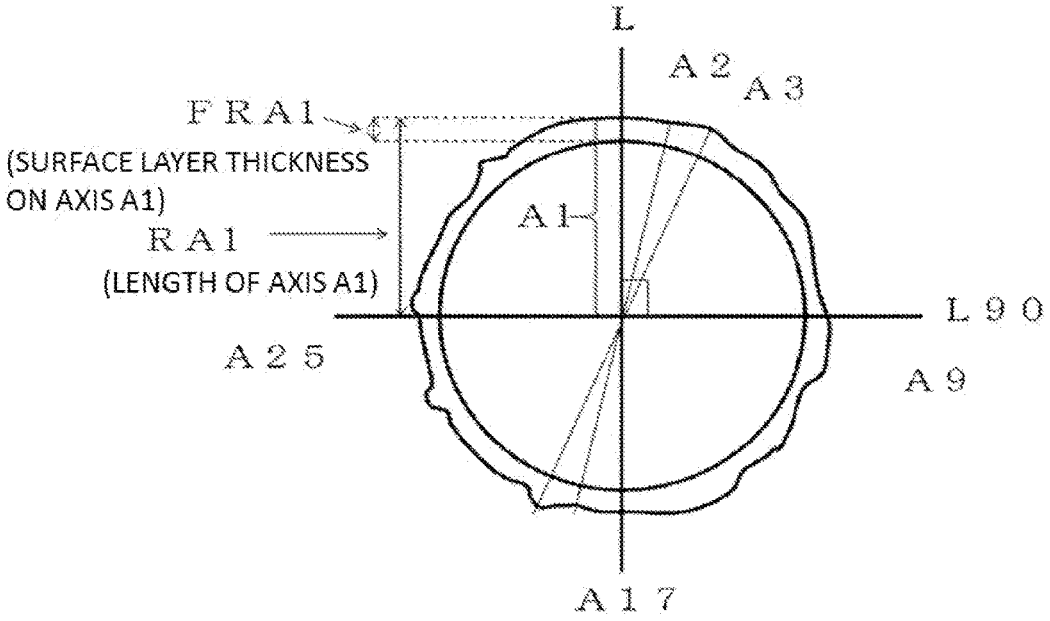
FIG. 2 is a drawing for explaining a cross-section of a toner particle obtained by TEM observation.

Bright field images of toner particle cross-sections are acquired at an accelerating voltage of 200 kV using a transmission electron microscope (trade name: Tecnai TF2OXT, FEI Co.) as was previously described. Next, EF mapping images are acquired of the Si—K edge (99 eV) according to the three window method using an EELS detector (trade name: GIF Tridiem, Gatan Corp.) to confirm the presence of the organic silicon polymer in the surface layer. Next, a toner particle cross-section is equally divided into 16 sections centering on the intersection of the long axis L of the toner particle cross-section and the axis L90 that passes through the center of the long axis L and is perpendicular thereto for a single toner particle in which the circle-equivalent diameter Dtem contained in a width of ±10% of the weight-average particle diameter of the toner particle (see FIG. 2). The dividing axes from the above-mentioned center to the surface layer of the toner particle are respectively designated as An (n=1 to 32), the length of the dividing axes is designated as RAn, and the thickness of the surface layer of the toner particle that contains the organic silicon polymer is designated as FRAn.

The proportion of the number of dividing axes for which the thickness (FRAn) of the surface layer is 5.0 nm or less was determined for each of the 32 dividing axes present. This becomes as indicated below when represented with an equation.

(Proportion at which surface layer thickness (FRAn) is 5.0 nm or less)={(Number of dividing axes for which surface layer thickness (FRAn) is 5.0 nm or less)/32}×100

This calculation was carried out for 10 toner particles, the average value of the proportion at which the surface layer thickness (FRAn) is 5.0 nm or less was determined for the resulting 10 toner particles, and that proportion was used as the proportion at which the surface layer thickness (FRAn) of the toner particles is 5.0 nm or less.

(Circle-Equivalent Diameter (Dtem) Determined from Cross-Section of Toner Particle Obtained from Transmission Electron Microscope (TEM) Micrograph)

Circle-equivalent diameter (Dtem) determined from cross-sections of toner particles obtained from TEM micrographs is determined using the method indicated below. First, circle-equivalent diameter Dtem determined from the cross-section of a single toner particle obtained from a TEM micrograph is determined in accordance with the equation indicated below.

[Circle-equivalent diameter (Dtem) determined from toner particle cross-section obtained from TEM micrograph]={(*RA*1+*RA*2+*RA*3+*RA*4+*RA*5+*RA*6+*RA*7+*RA*8+*RA*9+*RA*10+*RA*11+*RA*12+*RA*13+*RA*14+*RA*15+*RA*16+*RA*17+*RA*18+*RA*19+*RA*20+*RA*21 +*RA*22+*RA*23+*RA*24+*RA*25+*RA*26+*RA*27+*RA*28+*RA*29+*RA*30+*RA*31+*RA*32)}/16

Circle-equivalent diameter is determined for 10 toner particles, the average value per particle is calculated, and that value is taken to be the circle-equivalent diameter determined from cross-section of the toner particle.

(Measurement of Surface Layer Average Thickness (Dav.))

The average thickness (Dav.) of the surface layer of the toner particle is determined using the method indicated below.

First, the average thickness $D_{(n)}$ of the surface layer of a single toner particle is determined using the method indicated below.

$D(n)$=(total surface layer thickness at 32 locations on dividing axes)/32

This calculation is carried out for 10 toner particles, the average value per toner particle is calculated in accordance with the equation indicated below from the resulting average thickness $D_{(n)}$ (n=1 to 10) of the toner particles, and that value is taken to be the average thickness (Dav.) of the surface layer of the toner particle.

$$\text{Dav.}=\{D_{(1)}+D_{(2)}+D_{(3)}+D_{(4)}+D_{(5)}+D_{(6)}+D_{(7)}+D_{(8)}+D_{(9)}+D_{(10)}\}/10$$

(Measurement of Weight-Average Molecular Weight (Mw), Number Average Molecular Weight (Mn) and Main Peak Molecular Weight (Mp) of Toner (Particle) and Various Resins)

The weight-average molecular weight (Mw), number-average molecular weight (Mn) and main peak molecular weight (Mp) of toner (particle) and various resins are measured according to the following conditions using gel permeation chromatography (GPC).

(Measurement Conditions)

Column (Showa Denko K.K.): Seven columns consisting of the Shodex GPC KF-801, KF-802, KF-803, KF-804, KF-805, KF-806 and KF-807 (diameter: 8.0 mm, length: 30 cm)

Eluent: Tetrahydrofuran (THF)

Temperature: 40° C.

Flow rate: 0.6 mL/min

Detector: RI

Sample concentration and volume: 0.1% by mass, 10 μL (Sample Preparation)

0.04 g of the measurement target (toner (particle) or various types of resin) are dispersed and dissolved in 20 mL of tetrahydrofuran followed by allowing to stand undisturbed for 24 hours, filtering with a 0.2 μm filter (trade name: Myshori Disk H-25-2, Tosoh Corp.) and using the filtrate as sample.

A molecular weight calibration curve prepared using monodispersed polystyrene standard samples is used for the calibration curve. TSK standard polystyrenes manufactured by Tosoh Corp. consisting of F-850, F-450, F-288, F-128, F-80, F-40, F-20, F-10, F-4, F-2, F-1, A-5000, A-2500, A-1000 and A-500 are used as standard polystyrene samples for calibration curve preparation. At this time, standard polystyrene samples for at least ten locations on the calibration curve are used.

When preparing GPC molecular weight distribution, measurement is begun from the starting point where the chromatogram rises from the baseline on the high molecular weight side and is continued to a molecular weight of about 400 on the low molecular weight side.

(Measurement of Glass Transition Temperature (Tg), Melting Point and calorimetric Integral Value of Toner (Particle) and Various Resins)

The glass transition temperature (Tg), melting point and calorimetric integral value of the toner (particle) and various resins are measured according to the procedure indicated below using an M-DSC differential scanning calorimeter (DSC) (trade name: Q2000, TA Instruments Inc.). 3 mg of sample to be measured (toner (particle) or various resins) are accurately weighed. The sample is placed in an aluminum pan (pan made of aluminum), an empty aluminum pan is used as a reference, and measurement is carried out at normal temperature and normal humidity over a measuring temperature range of 20° C. to 200° C. at a ramp rate of 1° C./min. At this time, measurements are carried out at a modulation amplitude of ±0.5° C. and frequency of 1/min. Glass transition temperature (Tg: ° C.) is calculated from the resulting reversing heat flow curve. Tg is determined by defining the central value of the intersections of the baseline before and after absorption of heat and the tangent of the curve resulting from absorption of heat as Tg (° C.).

The temperature (° C.) at the top of the endothermic main peak on the endothermic chart when raising the measurement temperature by DSC is taken to be the melting point (° C.).

Figure 3:
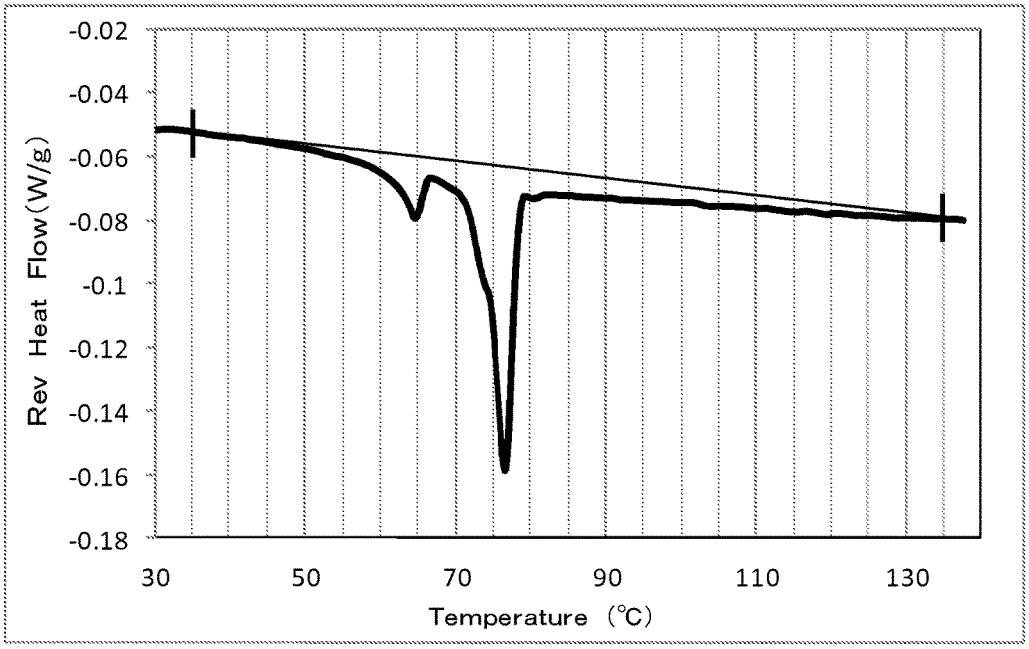
FIG. 3 is a drawing showing a reversing heat flow curve obtained by DSC of the toner of the present invention.

In addition, the calorimetric integral value (J/g) per gram of toner (particle) represented by the peak area of the endothermic main peak is measured on the endothermic chart when raising the measurement temperature by DSC. An example of a reversing heat flow curve obtained by DSC measurement of the toner (particle) is shown in FIG. 3.

The calorimetric integral value (J/g) is determined using a reversing heat flow curve obtained from the above-mentioned measurement. The Universal Analysis 2000 for Windows (trade name) 2000/XP Version 4.3A (TA Instruments Inc.) analytical software is used for calculations, and calorimetric integral value (J/g) is determined from the region surrounded by a line connecting measurement points at 35° C. and 135° C. and the endothermic curve using the Integral Peak Linear function.

Furthermore, in the case two or more compounds are present in the toner (particle) that have a melting point, the respective compounds are analyzed after separating and purifying by the re-precipitation method since their melting points may overlap. In addition, decomposition temperature and the structure of decomposition products based on the mass spectra thereof are determined by TGA-GC-MASS using a thermogravimetric analyzer equipped with a mass spectrometer. Moreover, detailed structures and compositions are determined by $^{1}$H-NMR, $^{13}$C-NMR, IR and MASS.

(Measurement of Weight-Average Particle Diameter (D4) and Number Average Particle Diameter (D1) of Toner (Particle))

The weight-average particle diameter (D4) and number-average particle diameter (D1) of the toner (particle) were calculated by measuring with 25,000 effective measurement channels using a precision particle size distribution analyzer according to the pore electrical resistance method equipped with a 100 μm aperture tube (trade name: Coulter Counter Multisizer 3, Beckman Coulter Inc.) and dedicated software provided with the analyzer for setting measurement conditions and analyzing measurement data (trade name: Beckman Coulter Multisizer 3 Version 3.51, Beckman Coulter Inc.) followed by analyzing the measurement data.

The electrolyte solution used in measurement consisted of special grade sodium chloride dissolved in ion exchange water to a concentration of about 1% by mass, and, for example, Isoton II (trade name) manufactured by Beckman Coulter Inc. can be used.

Furthermore, the above-mentioned dedicated software is set in the manner indicated below prior to carrying out measurement and analysis.

The total number of counts of the control mode is set to 50,000 particles on the "Change Standard Measurement Method (SOM) Screen" of the above-mentioned dedicated software, the number of measurements is set to 1, and the value obtained using "Standard particle: 10.0 μm" (Beckman Counter Inc.) is used for the Kd value. The threshold and noise level are set automatically by pressing the threshold/noise level measurement button. In addition, the current is set to 1600 μA, the gain is set to 2, the electrolyte is set to Isoton II (trade name), and a check is entered for flushing the aperture tube after measurement.

Bin interval is set to logarithmic particle diameter, particle diameter bin is set to the 256 particle diameter bin, and particle diameter range is set to 2 μn to 60 μm on the "Pulse to Particle Diameter Conversion Setting Screen" of the dedicated software.

A detailed description of the measurement method is provided below.

(1) About 200 mL of the above-mentioned electrolyte solution are placed in a glass, 250 mL round-bottom beaker for use with the Multisizer 3, the beaker is placed in a sample stand, and the contents are stirred by rotating the stirrer rod counter-clockwise at 24 revolutions/second. The inside of the aperture tube is cleaned and removed of air bubbles with the "Aperture Flush" function of the dedicated software.

(2) About 30 mL of the above-mentioned electrolyte solution are placed in a glass, 100 mL flat-bottom beaker followed by the addition of about 0.3 mL of a dispersing agent in the form of Contaminon N (trade name) (10% by mass aqueous solution of neutral detergent for cleaning precision measuring instruments having a pH of 7 and composed of a nonionic surfactant, anionic surfactant and an organic builder, Wako Pure Chemical Industries, Ltd.) diluted three-fold by mass with ion exchange water.

(3) A prescribed amount of ion exchange water is placed in the water tank of a ultrasonic disperser (trade name: Ultrasonic Dispersion System Tetora 150, Nikkaki Bios Co., Ltd.) having two internal oscillators having oscillation frequencies of 50 kHz shifted out of phase by 180° and an electrical output of 120 W, and about 2 mL of Contaminon N (trade name) are added to this water tank.

(4) The beaker described in (2) above is set in the beaker mounting hole of the above-mentioned ultrasonic disperser followed by operation of the ultrasonic disperser. The height of the beaker is adjusted so that the oscillating state of the liquid surface of the electrolyte solution in the beaker reaches a maximum.

(5) About 10 mg of toner (particle) are added a little at a time to the above-mentioned electrolyte solution with the ultrasonic waves radiating onto the electrolyte solution in the beaker described in (4) above, and are then dispersed. Ultrasonic dispersion treatment is further continued for 60 seconds. Furthermore, in carrying out ultrasonic dispersion, the water temperature of the water tank is suitably adjusted so as to be from 10° C. to 40° C.

(6) The electrolyte solution described in (5) above having the toner (particle) dispersed therein is dropped into the round-bottom beaker described in (1) above placed on the sample stand using a pipette, and the measured concentration is adjusted to about 5%. Measurement is then carried out until the number of measured particles reaches 50,000.

(7) Measurement data is analyzed with the above-mentioned dedicated software provided with the analyzer to calculate the weight-average molecular weight (D4). Furthermore, when the analyzer is set to graph/volume % with the dedicated software, the "average diameter" on the Analysis/Volumetric Statistical Value (Arithmetic Mean) screen corresponds to the weight-average molecular weight (D4), and when the analyzer is set to "graph/number %" with the dedicated software, the "average diameter" on the "Analysis/Number Statistical Value (Arithmetic Mean)" screen corresponds to the number-average particle diameter (D1).

(Measurement of Toner (Particle) Average Circularity)

Average circularity of the toner (particle) was measured under the measurement and analysis conditions used during calibration work using a flow particle image analyzer in the form of the "Model FPIA-3000" (Sysmex Corp.).

After adding a suitable amount of a dispersing agent in the form of the surfactant, alkylbenzene sulfonate, to 20 mL of ion exchange water, 0.02 g of measurement sample are added followed by carrying out dispersion treatment for 2 minutes using a desktop ultrasonic cleaner/disperser (trade name: VS-150, Velvo-Clear Co., Ltd.) having an oscillation frequency of 50 kHz and electrical output of 150 watts to obtain a dispersion for use in measurement. At that time, the temperature of the dispersion was suitably cooled to 10° C. to 40° C.

The above-mentioned flow particle image analyzer equipped with a standard objective lens (10X) is used for measurement, and the "PSE-900A" particle sheath (Sysmex Corp.) is used for the sheath liquid. The dispersion prepared in accordance with the above-mentioned procedure is introduced into the above-mentioned flow particle image analyzer, 3,000 toner (particle) are counted in the total count mode of the HPF measurement mode, the binarization threshold during particle analysis is set to 85%, and analyzed particle diameter is limited to a circle-equivalent diameter of 1.98 μm to 19.92 μm to determine average circularity of the toner (particle).

During measurement, the focal point is adjusted automatically prior to the start of measurement using standard latex particles (such as 5100A (trade name) manufactured by Duke Scientific Corp. diluted with ion exchange water). Subsequently, focal point is preferably adjusted every two hours from the start of measurement.

In addition, in the circularity distribution of the toner (particle), mode circularity of from 0.98 to 1.00 means that the majority of the toner (particle) has a shape that is nearly spherical. As a result, decreased adhesion of the toner (particle) to the photosensitive drum attributable to image force, Van der Waals force and the like becomes even more prominent and transfer efficiency increases, thereby making this preferable.

Here, mode circularity refers to circularity of the dividing range in which frequency value reaches a maximum in a circularity frequency distribution when circularity from 0.40 to 1.00 is divided into 61 seconds in 0.01 increments in the manner of 0.40 to less than 0.41, 0.41 to less than 0.42 . . . 0.99 to less than 1.00 and 1.00, and the circularity of each measured particle is assigned to each dividing range.

Although the following provides a more detailed explanation of the present invention by listing examples thereof, the present invention is not limited by these examples. Furthermore, the numbers of parts indicated in the following formulations indicate parts by mass unless specifically indicated otherwise.

The following provides a description of production examples of charge control resins used in the present invention.

(Production Example of Charge Control Resin 1)

250 parts by mass of methanol, 150 parts by mass of 2-butanol and 100 parts by mass of 2-propanol as solvent, and 88 parts by mass of styrene, 6.2 parts by mass of 2-ethylhexyl acrylate and 6.0 parts by mass of 2-acrylamide-2-methylpropanesulfonate as monomers were added to a reaction vessel equipped with a reflux condenser, stirrer, thermometer, nitrogen inlet tube, dropping device and pressure reducing device followed by stirring and heating while refluxing at normal pressure. A solution obtained by diluting 1.2 parts by mass of a polymerization initiator in the form of 2,2'-azobisisobutyronitrile with 20 parts by mass of 2-butanone was dropped in over the course of 30 minutes followed by continuing to stir for 5 hours. Moreover, a solution obtained by diluting 1.0 part by mass of 2,2'-azobisisobutyronitrile with 20 parts by mass of 2-butanone was dropped in over the course of 30 minutes followed by stirring for 5 hours while refluxing at normal pressure to complete polymerization.

Next, after distilling off the polymerization solvent under reduced pressure, the resulting polymer was coarsely pulverized to 100 μm or smaller with a cutter mill equipped with a 150 mesh screen and then finely pulverized with a jet mill. The fine particles were then classified with a 250 mesh sieve to separate and obtain particles of 60 μm or less. Next, the above-mentioned particles were dissolved by addition of methyl ethyl ketone to a concentration of 10%, and the resulting solution was re-precipitated by gradually adding to methanol at 20 times the amount of methyl ethyl ketone. The resulting precipitate was washed with one-half the amount of methanol used for re-precipitation, and the filtered particles were vacuum-dried at 35° C. for 48 hours.

Moreover, the above-mentioned vacuum-dried particles were re-dissolved by addition of methyl ethyl ketone to a concentration of 10%, and the resulting solution was re-precipitated by gradually adding to n-hexane at 20 times the amount of methyl ethyl ketone. The resulting precipitate was washed with one-half the amount of n-hexane used for re-precipitation, and the filtered particles were vacuum-dried for 48 hours at 35° C. The charge control resin obtained in this manner had a Tg of about 82° C., main peak molecular weight (Mp) of 19,500, number-average molecular weight (Mn) of 11,500, weight-average molecular weight (Mw) of 20,300 and acid value of 17.2 mgKOH/g. The resulting resin was designated as charge control resin 1.

(Production Example of Polyester Resin (1))

1,6-hexanediol: 400.0 parts by mass 1,4-butanedicarboxylic acid: 485.5 parts by mass The above-mentioned monomers were charged into an autoclave, a pressure reducing device, water separating device, nitrogen gas introduction device, temperature measuring device and stirring device were attached to the autoclave, a reaction was carried out for 5 hours at 190° C. in a nitrogen atmosphere, a reaction was carried out for 5 hours at 200° C., and a reaction was carried out for 1 hour at 160° C. and 9 kpa to obtain polyester resin (1). The weight-average molecular weight (Mw) was 16,000 and the number-average molecular weight (Mn) was 3,300. The physical properties are shown in Table 1 or Table 2.

(Production Example of Polyester Resins (2) to (7), (9), (11) and (12))

Polyester resins (2) to (7), (9), (11) and (12) were obtained in the same manner as Example 1 with the exception of changing to the raw materials shown in Table 1 or Table 2. The physical properties are shown in Table 1 or Table 2.

(Production Example of Polyester Resin A (1) to (3), (6) and (7))

Polyester resin A (1) to (3), (6) and (7) were obtained in the same manner as Example 1 with the exception of changing to the raw materials shown in Table 2. The physical properties are shown in Table 2.

(Production Example of Polyester Resin (8))

1,3-propanediol: 300.0 parts by mass

Fumaric acid: 448.8 parts by mass

Tertiary-butylcatechol: 10 parts by mass

The above-mentioned monomers were charged into an autoclave, a pressure reducing device, water separating device, nitrogen gas introduction device, temperature measuring device and stirring device were attached to the autoclave, a reaction was carried out for 5 hours at 190° C. in a nitrogen atmosphere, a reaction was carried out for 5 hours at 200° C. and a reaction was carried out for 1 hour at 160° C. and 9 kpa to obtain polyester resin (8). The weight-average molecular weight (Mw) was 24,500 and the number-average molecular weight (Mn) was 3,800. The physical properties are shown in Table 1.

(Production Example of Polyester Resin (10))

1,6-hexanediol: 200.0 parts by mass

Styrene: 140.0 parts by mass

The above-mentioned monomers were charged into an autoclave, and a pressure reducing device, water separating device, nitrogen gas introduction device, temperature measuring device and stirring device were attached to the autoclave followed by heating to 170° C. in a nitrogen atmosphere. Subsequently, 336.0 parts by mass of 1,8-octanedicarboxylic acid, 8.6 parts by mass of acrylic acid and 8.0 parts by mass of tertiary-butyl peroxide were added. Subsequently, a reaction was carried out for 5 hours at 190° C. by raising the temperature to 190° C., a reaction was further carried out for 5 hours at 200° C. Subsequently, a reaction was carried out for 1 hour at 160° C. and 9 kpa to obtain polyester resin (10). The weight-average molecular weight (Mw) was 18,000 and the number-average molecular weight (Mn) was 3,100. The physical properties are shown in Table 1.

(Production Example of Polyester Resin A (4))

(Synthesis of Isocyanate Group-Containing Prepolymer)

Bisphenol A ethylene oxide 2 mole adduct: 730 parts by mass

Phthalic acid: 295 parts by mass

Dibutyltitanium oxide: 3.0 parts by mass

After reacting for 7 hours by stirring at 220° C. and further reacting for 5 hours under reduced pressure, the reaction product was cooled to 80° C. and reacted for 2 hours with 190 parts by mass of isophorone diisocyanate in ethyl acetate to obtain an isocyanate group-containing polyester resin. 25 parts by mass of the isocyanate group-containing polyester resin and 1 part by mass of isophorone diamine were reacted for 2 hours at 50° C. to obtain polyester resin A (4) having polyester containing a urea group as the main component thereof. The weight-average molecular weight (Mw) of the resulting polyester resin A (4) was 24,300, the number-average molecular weight (Mn) was 3,080 and the peak molecular weight was 7,500. The physical properties are shown in Table 2.

(Production Example of Polyester Resin A (5))

Bisphenol A ethylene oxide 2 mole adduct: 100 parts by mass

Bisphenol A propylene oxide 2 mole adduct: 105 parts by mass

Terephthalic acid: 82 parts by mass

Dodecenylsuccinic acid: 65 parts by mass

The above-mentioned monomers were placed in a flask equipped with a stirring device, nitrogen inlet tube, temperature sensor and fractionating column following by raising the temperature to 195° C. in 1 hour and confirming that the contents of the reaction system were uniformly stirred.

0.7% by mass of tin distearate was added based on the total mass of these monomers. Moreover, the temperature was raised from 195° C. to 240° C. over the course of 5 hours while distilling off the water that formed followed by further carrying out a dehydration condensation reaction for 2 hours at 240° C. Next, the temperature was lowered to 190° C. followed by gradually adding 8 parts by mass of trimellitic anhydride and continuing to react for 1 hour at 190° C. As a result, polyester A (5) was obtained having a glass transition temperature of 55.2° C., acid value of 14.3 mgKOH/g, hydroxyl value of 24.1 mgKOH/g, weight-average molecular weight of 53,600, number-average molecular weight of 6,000 and softening point of 108° C.

(Production Example of Toner Particle 1)

700 parts by mass of ion exchange water, 1,000 parts by mass of 0.125 mol/L aqueous $Na_3PO_4$ solution and 24.0 parts by mass of 1.0 mol/L hydrochloric acid were added to a four-mouth vessel equipped with a reflux condenser, stirrer, thermometer and nitrogen inlet tube followed by holding at 60° C. while stirring at 12,000 rpm using a high-speed stirring device in the form of a TK Homomixer. 85 parts by mass of 1.25 mol/L aqueous calcium chloride solution were then gradually added thereto to prepare an aqueous dispersion medium containing a fine, poorly soluble dispersion stabilizer in the form of $Ca_3(PO_4)_2$.

Styrene: 74.0 parts by mass n-butylacrylate: 26.0 parts by mass

Methyltriethoxysilane: 5.0 parts by mass

Copper phthalocyanine pigment: 6.5 parts by mass (Pigment Blue 15:3) (P.B. 15:3)

Polyester resin (1): 10.0 parts by mass
Charge control agent 1: 0.5 parts by mass
(Aluminum compound of 3,5-di-tert-butylsalicylic acid)
Charge control resin 1: 0.4 parts by mass
Release agent: 10.0 parts by mass
(Fischer-Tropsch wax, melting point: 77.1° C.)

A polymerizable monomer composition 1, obtained by dispersing the above-mentioned materials for 3 hours with an attritor, was held for 20 minutes at 60° C. Subsequently, polymerizable monomer composition 1, obtained by further adding 16.0 parts by mass of a polymerization initiator in the form of t-butylperoxypivalate (50% toluene solution) to polymerizable composition 1, was charged into an aqueous medium followed by granulating for 10 minutes while maintaining the rotating speed of a high-speed stirring device at 12,000 rpm. Subsequently, the high-speed stirring device was replaced with a propeller-type stirrer and the internal temperature was raised to 70° C. followed by allowing to react for 4 hours while stirring slowly. Next, 10.0 parts by mass of 1.0 mol/L aqueous sodium hydroxide solution were added to adjust the pH to 8.0 followed by raising the temperature inside the vessel to 90° C. and holding at that temperature for 1.5 hours. Subsequently, 4.0 parts by mass of 10% hydrochloric acid and 50 parts by mass of ion exchange water were added to adjust the pH to 5.1. Next, 300 parts by mass of ion exchange water were added, the reflux condenser was removed and a distillation device was attached. Distillation was carried out for 5 hours at a temperature inside the vessel of 100° C. The amount of the distilled fraction was 300 parts by mass. Subsequently, a reaction was carried out for 2 hours at 65° C. at a cooling rate of 0.5° C./min to obtain a polymer slurry 1. After cooling to 30° C., dilute hydrochloric acid was added to the vessel containing the polymer slurry 1 followed by removal of the dispersion stabilizer. Moreover, toner particles having a weight-average particle diameter of 5.6 μm were obtained by further filtering, washing and drying. The toner particles were designated as toner particle 1. The formulation and conditions of toner particle 1 are shown in Table 3 and the physical properties are shown in Table 8. Silicon atoms were confirmed to be uniformly present in the surface layer by carrying out silicon mapping during TEM observations of the toner particle 1. Surface layers containing an organic silicon polymer were similarly confirmed by silicon mapping in the following examples and comparative examples as well. This was confirmed to not be a coat layer formed by adhesion of particulate clumps containing silicon compounds.

(Production Example of Toner Particle 2)

Toner particle 2 was obtained in the same manner as the production example of toner particle 1 with the exception of changing to 5.0 parts by mass of phenyltrimethoxysilane instead of 5.0 parts by mass of the methyltriethoxysilane used in the production example of toner particle 1. The formulation and conditions of the toner particle 2 are shown in Table 3 and the physical properties are shown in Table 8. Silicon atoms were confirmed to be uniformly present in the surface layer by carrying out silicon mapping during TEM observations of the toner particle 2. This was confirmed to not be a coat layer formed by adhesion of particulate clumps containing silicon compounds.

(Production Example of Toner Particle 3)

Toner particle 3 was obtained in the same manner as the production example of toner particle 1 with the exception of changing to 5.0 parts by mass of ethyltrimethoxysilane instead of 5.0 parts by mass of the methyltriethoxysilane used in the production example of toner particle 1. The formulation and conditions of the toner particle 3 are shown in Table 3 and the physical properties are shown in Table 8. Silicon atoms were confirmed to be uniformly present in the surface layer by carrying out silicon mapping during TEM observations of the toner particle 3. This was confirmed to not be a coat layer formed by adhesion of particulate clumps containing silicon compounds.

(Production Example of Toner Particle 4)

Toner particle 4 was obtained in the same manner as the production example of toner particle 1 with the exception of changing to 5.0 parts by mass of n-propyltriethoxysilane instead of 5.0 parts by mass of the methyltriethoxysilane used in the production example of toner particle 1. The formulation and conditions of the toner particle 4 are shown in Table 3 and the physical properties are shown in Table 8. Silicon atoms were confirmed to be uniformly present in the surface layer by carrying out silicon mapping during TEM observations of the toner particle 4. This was confirmed to not be a coat layer formed by adhesion of particulate clumps containing silicon compounds.

(Production Example of Toner Particle 5)

Toner particle 5 was obtained in the same manner as the production example of toner particle 1 with the exception of changing to 5.0 parts by mass of n-butyltriethoxysilane instead of 5.0 parts by mass of the methyltriethoxysilane used in the production example of toner particle 1. The formulation and conditions of the toner particle 5 are shown in Table 3 and the physical properties are shown in Table 8. Silicon atoms were confirmed to be uniformly present in the surface layer by carrying out silicon mapping during TEM observations of the toner particle 5. This was confirmed to not be a coat layer formed by adhesion of particulate clumps containing silicon compounds.

(Production Example of Toner Particle 6)

Toner particle 6 was obtained in the same manner as the production example of toner particle 1 with the exception of changing to 4.0 parts by mass of methyltriethoxysilane and 1.0 part by mass of methyltrichlorosilane instead of 5.0 parts by mass of the methyltriethoxysilane used in the production example of toner particle 1, and adjusting the pH to 5.1 with 1.0 part by mass of 1.0 mol/L aqueous sodium hydroxide solution. The formulation and conditions of the toner particle 6 are shown in Table 3 and the physical properties are shown in Table 8. Silicon atoms were confirmed to be uniformly present in the surface layer by carrying out silicon mapping during TEM observations of the toner particle 6. This was confirmed to not be a coat layer formed by adhesion of particulate clumps containing silicon compounds.

(Production Example of Toner Particle 7)

Toner particle 7 was obtained in the same manner as the production example of toner particle 1 with the exception of changing to 5.0 parts by mass of methyltrimethoxysilane instead of 5.0 parts by mass of the methyltriethoxysilane used in the production example of toner particle 1. The formulation and conditions of the toner particle 7 are shown in Table 3 and the physical properties are shown in Table 8. Silicon atoms were confirmed to be uniformly present in the surface layer by carrying out silicon mapping during TEM observations of the toner particle 7. This was confirmed to not be a coat layer formed by adhesion of particulate clumps containing silicon compounds.

(Production Example of Toner Particle 8)

Toner particle 8 was obtained in the same manner as the production example of toner particle 1 with the exception of changing to 5.0 parts by mass of methyldiethoxychlorosilane instead of 5.0 parts by mass of the methyltriethoxysilane used in the production example of toner particle 1. The formulation and conditions of the toner particle 8 are shown in Table 3 and the physical properties are shown in Table 8. Silicon atoms were confirmed to be uniformly present in the surface layer by carrying out silicon mapping during TEM observations of the toner particle 8. This was confirmed to not be a coat layer formed by adhesion of particulate clumps containing silicon compounds.

(Production Example of Toner Particle 9)

Toner particle 9 was obtained in the same manner as the production example of toner particle 1 with the exception of changing to 30.0 parts by mass of methyltriethoxysilane instead of 5.0 parts by mass of the methyltriethoxysilane used in the production example of toner particle 1. The formulation and conditions of the toner particle 9 are shown in Table 3 and the physical properties are shown in Table 8. Silicon atoms were confirmed to be uniformly present in the surface layer by carrying out silicon mapping during TEM observations of the toner particle 9. This was confirmed to not be a coat layer formed by adhesion of particulate clumps containing silicon compounds.

(Production Example of Toner Particle 10)

Toner particle 10 was obtained in the same manner as the production example of toner particle 1 with the exception of changing to 2.5 parts by mass of methyltriethoxysilane instead of 5.0 parts by mass of the methyltriethoxysilane used in the production example of toner particle 1. The formulation and conditions of the toner particle 10 are shown in Table 3 and the physical properties are shown in Table 8. Silicon atoms were confirmed to be uniformly present in the surface layer by carrying out silicon mapping during TEM observations of the toner particle 10. This was confirmed to not be a coat layer formed by adhesion of particulate clumps containing silicon compounds.

(Production Example of Toner Particle 11)

Toner particle 11 was obtained in the same manner as the production example of toner particle 1 with the exception of changing to 1.5 parts by mass of methyltriethoxysilane instead of 5.0 parts by mass of the methyltriethoxysilane used in the production example of toner particle 1. The formulation and conditions of the toner particle 11 are shown in Table 4 and the physical properties are shown in Table 9. Silicon atoms were confirmed to be uniformly present in the surface layer by carrying out silicon mapping during TEM observations of the toner particle 11. This was confirmed to not be a coat layer formed by adhesion of particulate clumps containing silicon compounds.

(Production Example of Toner Particle 12)

Toner particle 12 was obtained in the same manner as the production example of toner particle 1 with the exception of adjusting the pH to 10.0 by adding 15.0 parts by mass of 1.0 mol/L aqueous sodium hydroxide solution following completion of reaction 1 for 4 hours at 70° C. in the production example of toner particle 1, and adjusting the pH to 5.1 by adding 6.0 parts by mass of 10% hydrochloric acid to 50 parts by mass of ion exchange water instead of adjusting the pH to 5.1 by adding 4.0 parts by mass of 10% hydrochloric acid to 50 parts by mass of ion exchange water. The formulation and conditions of the toner particle 12 are shown in Table 4 and the physical properties are shown in Table 9. Silicon atoms were confirmed to be uniformly present in the surface layer by carrying out silicon mapping during TEM observations of the toner particle 12. This was confirmed to not be a coat layer formed by adhesion of particulate clumps containing silicon compounds.

(Production Example of Toner Particle 13)

Toner particle 13 was obtained in the same manner as the production example of toner particle 1 with the exception of changing to 1.0 part by mass of methyltriethoxysilane and 6.5 parts by mass of dimethyldiethoxysilane instead of 5.0 parts by mass of the methyltriethoxysilane used in the production example of toner particle 1. The formulation and conditions of the toner particle 13 are shown in Table 4 and the physical properties are shown in Table 9. Silicon atoms were confirmed to be uniformly present in the surface layer by carrying out silicon mapping during TEM observations of the toner particle 13. This was confirmed to not be a coat layer formed by adhesion of particulate clumps containing silicon compounds.

(Production Example of Toner Particle 14)

Toner particle 14 was obtained in the same manner as the production example of toner particle 1 with the exception of changing to 3.0 parts by mass of methyltriethoxysilane and 2.0 parts by mass of tetraethoxysilane instead of 5.0 parts by mass of the methyltriethoxysilane used in the production example of toner particle 1. The formulation and conditions of the toner particle 14 are shown in Table 4 and the physical properties are shown in Table 9. Silicon atoms were confirmed to be uniformly present in the surface layer by carrying out silicon mapping during TEM observations of the toner particle 14. This was confirmed to not be a coat layer formed by adhesion of particulate clumps containing silicon compounds.

(Production Example of Toner Particle 15)

Toner particle 15 was obtained in the same manner as the production example of toner particle 1 with the exception of changing to 10.0 parts by mass of polyester resin (2) instead of 10.0 parts by mass of the polyester resin (1) used in the production example of toner particle 1. The formulation and conditions of the toner particle 15 are shown in Table 4 and the physical properties are shown in Table 9. Silicon atoms were confirmed to be uniformly present in the surface layer by carrying out silicon mapping during TEM observations of the toner particle 15. This was confirmed to not be a coat layer formed by adhesion of particulate clumps containing silicon compounds.

(Production Example of Toner Particle 16)

Toner particle 16 was obtained in the same manner as the production example of toner particle 1 with the exception of changing to 29.6 parts by mass of styrene instead of the 74.0 parts by mass used in the production example of toner particle 1, changing to 10.4 parts by mass of n-butylacrylate instead of the 26.0 parts used in the production example of toner particle 1, changing to 70.0 parts by mass of polyester (1) instead of the 10.0 parts by mass used in the production example of toner particle 1, and adding 60.0 parts by mass of toluene to the polymerizable monomer composition. The formulation and conditions of the toner particle 16 are shown in Table 4 and the physical properties are shown in Table 9. Silicon atoms were confirmed to be uniformly present in the surface layer by carrying out silicon mapping during TEM observations of the toner particle 16. This was confirmed to not be a coat layer formed by adhesion of particulate clumps containing silicon compounds.

(Production Example of Toner Particle 17)

Toner particle 17 was obtained in the same manner as the production example of toner particle 1 with the exception of changing to 1.4 parts by mass of polyester resin (1) instead of 10.0 parts by mass of the polyester resin (1) used in the production example of toner particle 1. The formulation and conditions of the toner particle 17 are shown in Table 4 and the physical properties are shown in Table 9. Silicon atoms were confirmed to be uniformly present in the surface layer by carrying out silicon mapping during TEM observations of the toner particle 17. This was confirmed to not be a coat layer formed by adhesion of particulate clumps containing silicon compounds.

(Production Example of Toner Particle 18)

Toner particle 18 was obtained in the same manner as the production example of toner particle 1 with the exception of changing to 10.0 parts by mass of polyester resin (3) instead of 10.0 parts by mass of the polyester resin (1) used in the production example of toner particle 1. The formulation and conditions of the toner particle 18 are shown in Table 4 and the physical properties are shown in Table 9. Silicon atoms were confirmed to be uniformly present in the surface layer by carrying out silicon mapping during TEM observations of the toner particle 18. This was confirmed to not be a coat layer formed by adhesion of particulate clumps containing silicon compounds.

(Production Example of Toner Particle 19)

Toner particle 19 was obtained in the same manner as the production example of toner particle 1 with the exception of changing to 10.0 parts by mass of polyester resin (4) instead of 10.0 parts by mass of the polyester resin (1) used in the production example of toner particle 1. The formulation and conditions of the toner particle 19 are shown in Table 4 and the physical properties are shown in Table 9. Silicon atoms were confirmed to be uniformly present in the surface layer by carrying out silicon mapping during TEM observations of the toner particle 19. This was confirmed to not be a coat layer formed by adhesion of particulate clumps containing silicon compounds.

(Production Example of Toner Particle 20)

Toner particle 20 was obtained in the same manner as the production example of toner particle 1 with the exception of changing to 10.0 parts by mass of polyester resin (5) instead of 10.0 parts by mass of the polyester resin (1) used in the production example of toner particle 1. The formulation and conditions of the toner particle 20 are shown in Table 4 and the physical properties are shown in Table 9. Silicon atoms were confirmed to be uniformly present in the surface layer by carrying out silicon mapping during TEM observations of the toner particle 20. This was confirmed to not be a coat layer formed by adhesion of particulate clumps containing silicon compounds.

(Production Example of Toner Particle 21)

Toner particle 21 was obtained in the same manner as the production example of toner particle 1 with the exception of changing to 10.0 parts by mass of polyester resin (6) instead of 10.0 parts by mass of the polyester resin (1) used in the production example of toner particle 1. The formulation and conditions of the toner particle 21 are shown in Table 5 and the physical properties are shown in Table 10. Silicon atoms were confirmed to be uniformly present in the surface layer by carrying out silicon mapping during TEM observations of the toner particle 21. This was confirmed to not be a coat layer formed by adhesion of particulate clumps containing silicon compounds.

(Production Example of Toner Particle 22)

Toner particle 22 was obtained in the same manner as the production example of toner particle 1 with the exception of changing to 10.0 parts by mass of polyester resin (7) instead of 10.0 parts by mass of the polyester resin (1) used in the production example of toner particle 1. The formulation and conditions of the toner particle 22 are shown in Table 5 and the physical properties are shown in Table 10. Silicon atoms were confirmed to be uniformly present in the surface layer by carrying out silicon mapping during TEM observations of the toner particle 22. This was confirmed to not be a coat layer formed by adhesion of particulate clumps containing silicon compounds.

(Production Example of Toner Particle 23)

Toner particle 23 was obtained in the same manner as the production example of toner particle 1 with the exception of changing to 10.0 parts by mass of polyester resin (8) instead of 10.0 parts by mass of the polyester resin (1) used in the production example of toner particle 1. The formulation and conditions of the toner particle 23 are shown in Table 5 and the physical properties are shown in Table 10. Silicon atoms were confirmed to be uniformly present in the surface layer by carrying out silicon mapping during TEM observations of the toner particle 23. This was confirmed to not be a coat layer formed by adhesion of particulate clumps containing silicon compounds.

(Production Example of Toner Particle 24)

Toner particle 24 was obtained in the same manner as the production example of toner particle 1 with the exception of changing to 10.0 parts by mass of polyester resin (9) instead of 10.0 parts by mass of the polyester resin (1) used in the production example of toner particle 1. The formulation and conditions of the toner particle 24 are shown in Table 5 and the physical properties are shown in Table 10. Silicon atoms were confirmed to be uniformly present in the surface layer by carrying out silicon mapping during TEM observations of the toner particle 24. This was confirmed to not be a coat layer formed by adhesion of particulate clumps containing silicon compounds.

(Production Example of Toner Particle 25)

Toner particle 25 was obtained in the same manner as the production example of toner particle 1 with the exception of changing to 10.0 parts by mass of polyester resin (10) instead of 10.0 parts by mass of the polyester resin (1) used in the production example of toner particle 1. The formulation and conditions of the toner particle 25 are shown in Table 5 and the physical properties are shown in Table 10. Silicon atoms were confirmed to be uniformly present in the surface layer by carrying out silicon mapping during TEM observations of the toner particle 25. This was confirmed to not be a coat layer formed by adhesion of particulate clumps containing silicon compounds.

(Production Example of Toner Particle 26)

Polyester resin A (3): 55.0 parts by mass
Polyester resin A (4): 35.0 parts by mass
Polyester resin (1): 10.0 parts by mass
Copper phthalocyanine pigment (Pigment Blue 15:3): 6.5 parts by mass
Charge control agent 1: 0.5 parts by mass
(Aluminum compound of 3,5-di-tert-butylsalicylic acid)
Charge control resin 1: 0.6 parts by mass
Release agent: 10.0 parts by mass
(Fischer-Tropsch wax, melting point: 77.1° C.)

After mixing the above-mentioned materials with a Henschel mixer, melting and kneading were carried out with a twin-screw kneading extruder at 135° C. followed by cooling the kneaded product, coarsely pulverizing with a cutter mill, finely pulverizing by a pulverizer using a jet air flow, and further classifying using an air classifier to obtain toner parent body 26 having a weight-average particle diameter of 5.6 μm.

(Production of Toner Particle 26)

700 parts by mass of ion exchange water, 1,000 parts by mass of 0.1 mol/L aqueous $Na_3PO_4$ solution and 24.0 parts by mass of 1.0 mol/L hydrochloric acid were added to a four-mouth vessel equipped with a Liebig condenser followed by holding at 60° C. while stirring at 12,000 rpm using a high-speed stirring device in the form of a TK Homomixer. 85 parts by mass of 1.0 mol/L aqueous calcium chloride solution were then gradually added thereto to prepare an aqueous dispersion medium containing a fine, poorly soluble dispersion stabilizer in the form of $Ca_3(PO_4)_2$.

Next, after mixing 127.40 parts by mass of the toner parent body 26 and 5.00 parts by mass of methyltriethoxysilane with a Henschel mixer, the toner materials were added while stirring at 5,000 rpm with the TK Homomixer followed by stirring for 5 minutes.

Next, this mixture was held at 70° C. for 4 hours. Next, 10.0 parts by mass of 1.0 mol/L aqueous sodium hydroxide solution were added to adjust the pH to 8.0 followed by raising the temperature inside the vessel to 90° C. and holding at that temperature for 1.5 hours. Subsequently, 4.0 parts by mass of 10% hydrochloric acid and 50 parts by mass of ion exchange water were added to adjust the pH to 5.1. Subsequently, 300 parts by mass of ion exchange water at 90° C. were added, the reflux condenser was removed and a distillation device was attached. Next, distillation was carried out for 5 hours at a temperature inside the vessel of 100° C. Polymer slurry 26 was obtained by cooling to 65° C. at a cooling rate of 0.5° C./min and holding at that temperature for 2 hours. The amount of the distilled fraction was 310 parts by mass. Dilute hydrochloric acid was added to the vessel containing the polymer slurry 26 followed by removal of the dispersion stabilizer. Toner particles having a weight-average particle diameter of 5.6 μm were obtained by filtering, washing and drying. The toner particles were designated as toner particle 26.

The physical properties of the toner particle 26 are shown in Table 10. Silicon atoms were confirmed to be uniformly present in the surface layer by carrying out silicon mapping during TEM observations of the toner particle 26. This was confirmed to not be a coat layer formed by adhesion of particulate clumps containing silicon compounds.

(Production Example of Toner Particle 27)

Polyester resin A (3): 55.0 parts by mass

Polyester resin A (4): 35.0 parts by mass

Polyester resin (1): 10.0 parts by mass

Copper phthalocyanine pigment (Pigment Blue 15:3): 6.5 parts by mass

Charge control agent 1: 0.5 parts by mass (Aluminum compound of 3,5-di-tert-butylsalicylic acid)

Charge control resin 1: 0.4 parts by mass

Methyltriethoxysilane: 5.0 parts by mass

Release agent (behenyl behenate): 10.0 parts by mass

The above-mentioned materials were dissolved in 400 parts by mass of toluene to obtain a solution.

700 parts by mass of ion exchange water, 1,000 parts by mass of 0.125 mol/L aqueous $Na_3PO_4$ solution and 24.0 parts by mass of 1.25 mol/L hydrochloric acid were added to a four-mouth vessel equipped with a Liebig condenser followed by holding at 60° C. while stirring at 12,000 rpm using a high-speed stirring device in the form of a TK Homomixer. 85 parts by mass of 1.0 mol/L aqueous calcium chloride solution were then gradually added thereto to prepare an aqueous dispersion medium containing a fine, poorly soluble dispersion stabilizer in the form of $Ca_3(PO_4)_2$.

Next, 100 parts by mass of the above-mentioned solution were added while stirring at 12,000 rpm with the TK Homomixer followed by stirring for 5 minutes. Next, the mixture was held at 70° C. for 5 hours. Next, 10.0 parts by mass of 1.0 mol/L aqueous sodium hydroxide solution were added to adjust the pH to 8.0 followed by raising the temperature inside the vessel to 90° C. and holding at that temperature for 1.5 hours. Subsequently, 4.0 parts by mass of 10% hydrochloric acid and 50 parts by mass of ion exchange water were added to adjust the pH to 5.1. 300 parts by mass of ion exchange water were added, the reflux condenser was removed and a distillation device was attached. Next, distillation was carried out for 5 hours at a temperature inside the vessel of 100° C. to obtain a polymer slurry 27. The amount of the distilled fraction was 320 parts by mass. Dilute hydrochloric acid was added to the vessel containing the polymer slurry 27 followed by removal of the dispersion stabilizer. Toner particle 27 having a weight-average particle diameter of 5.6 μm was obtained by filtering, washing and drying. The physical properties of the toner particle 27 are shown in Table 10. Silicon atoms were confirmed to be uniformly present in the surface layer by carrying out silicon mapping during TEM observations of the toner particle 27. This was confirmed to not be a coat layer formed by adhesion of particulate clumps containing silicon compounds.

(Production Example of Toner Particle 28)

(Preparation of Resin Particle Dispersion (1))

Polyester resin (1): 100 parts by mass

Methyl ethyl ketone: 50 parts by mass

Isopropyl alcohol: 20 parts by mass

Methyl ethyl ketone and isopropyl alcohol were placed in a vessel. Subsequently, the above-mentioned resin was added gradually followed by stirring to completely dissolve and obtain a solution of polyester resin (1). The temperature of the vessel containing this solution of polyester resin (1) was set to 65° C., 10% aqueous ammonium solution was gradually dropped in to a total of 5 parts by mass while stirring, and 230 parts by mass of ion exchange water were gradually dropped in at the rate of 10 mL/min followed by phase reversal emulsification. Moreover, the solvent was removed under reduced pressure with an evaporator to obtain a resin particle dispersion (1) of the polyester resin (1). The volume-average particle diameter of the resin particles was 130 nm. In addition, the amount of the solid fraction of the resin particles was adjusted to 20% with ion exchange water.

(Preparation of Resin Particle Dispersion (2))

Polyester resin A (5): 100 parts by mass

Methyl ethyl ketone: 50 parts by mass

Isopropyl alcohol: 20 parts by mass

Methyl ethyl ketone and isopropyl alcohol were placed in a vessel. Subsequently, the above-mentioned resin was added gradually followed by stirring to completely dissolve and obtain a solution of polyester resin A (5). The temperature of the vessel containing this solution of polyester resin A (5) was set to 40° C., 10% aqueous ammonium solution was gradually dropped in to a total of 3.5 parts by mass while stirring, and 230 parts by mass of ion exchange water were gradually dropped in at the rate of 10 mL/min followed by phase reversal emulsification. Moreover, the solvent was removed under reduced pressure to obtain a resin particle dispersion (2) of the polyester resin A (5). The volume-average particle diameter of the resin particles was 140 nm. In addition, the amount of the solid fraction of the resin particles was adjusted to 20% with ion exchange water.

(Preparation of Sol-Gel Solution of Resin Particle Dispersion (1))

20.0 parts by mass of methyltriethoxysilane were added to 100 parts by mass of resin particle dispersion (1) (solid fraction: 20.0 parts by mass) and held at 70° C. for 1 hour while stirring followed by raising the temperature to 95° C. at the rate of 20° C./hour and holding at that temperature for 3 hours. Subsequently, a sol-gel solution of resin particle dispersion (1) in which the resin particles were coated with a sol-gel was obtained by cooling. The volume-average particle diameter of the resin particles was 200 nm. In addition, the amount of the solid fraction of the resin particles was adjusted to 20% with ion exchange water. The sol-gel solution of the resin particle dispersion (1) was stored at 10° C. or lower while stirring and used within 24 hours after preparation. The surface of the particles being in the state of a high viscosity sol or gel resulted in more favorable adhesion between particles, thereby making this preferable.

(Preparation of Colorant Particle Dispersion 1)

Copper phthalocyanine (Pigment Blue 15:3):
45 parts by mass
Ionic surfactant Neogen RK
(Daiichi Kogyo Seiyaku Co., Ltd.):
5 parts by mass
Ion exchange water: 190 parts by mass The above-mentioned components were mixed and dispersed for 10 minutes with a homogenizer (Ultratalax, IKA Co., Ltd.) followed by carrying out dispersion treatment for 20 minutes at a pressure of 250 MPa using an Ultimizer (opposed collision-type wet pulverizer: Sugino Machine Ltd.) to obtain a colorant particle dispersion 1 having a volume-average particle diameter of the colorant particles of 110 nm and a solid fraction of 20%.

(Preparation of Release Agent Particle Dispersion)

Olefin wax (melting point: 84° C.): 60 parts by mass
Ionic surfactant Neogen RK
(Daiichi Kogyo Seiyaku Co., Ltd.):
2.0 parts by mass
Ion exchange water: 240 parts by mass The above-mentioned components were heated to 100° C. and adequately dispersed with the Ultratalax T50 manufactured by IKA Co, Ltd. followed by carrying out dispersion treatment for 1 hour by heating to 115° C. with a pressure discharge type Gaulin homogenizer to obtain a release agent particle dispersion having a volume-average particle diameter of 150 nm and solid fraction of 20%.

(Preparation of Toner Particle 28)

Resin particle dispersion (1): 200 parts by mass
Resin particle dispersion (2): 400 parts by mass
Sol-gel solution of resin particle dispersion (1): 100 parts by mass
Colorant particle dispersion 1: 50 parts by mass
Release agent particle dispersion: 50 parts by mass 2.4 parts by mass of the ionic surfactant, Neogen RK, were added to a flask followed by adding the above-mentioned materials and stirring. After adjusting the pH to 3.8 by dropping in 1 mol/L aqueous nitric acid solution, 0.35 parts by mass of aluminum polysulfate were added thereto followed by dispersing with Ultratalax manufactured by IKA Co., Ltd. The flask was heated to 50° C. with a heating oil bath while stirring. After holding at 50° C. for 40 minutes, a mixed liquid of 300 parts by mass of the sol-gel solution of the resin particle dispersion (1) was gradually added thereto.

Subsequently, after adjusting the pH in the reaction system to 7.0 by adding 1 mol/L aqueous sodium hydroxide solution, the stainless steel flask was sealed, gradually heated to 90° C. while continuing to stir, and holding at 90° C. for 5 hours. The flask was further held at 95° C. for 8.0 hours. Subsequently, 2.0 parts by mass of the ionic surfactant, Neogen RK, were added followed by reacting for 5 hours at 100° C. Following completion of the reaction, 320 parts of a fraction were recovered at 85° C. by vacuum distillation. Subsequently, cooling, filtration and drying were carried out. The resulting product was re-dispersed in 5 L of ion exchange water at 40° C. followed by stirring with a stirring blade for 15 minutes (300 rpm) and filtering.

Re-dispersion, filtration and washing were repeated and washing was ended when electrical conductance reached 6.0 μS/cm or less to obtain toner particle 28. The physical properties of the toner particle 28 are shown in Table 10. Silicon atoms were confirmed to be uniformly present in the surface layer by carrying out silicon mapping during TEM observations of the toner particle 28. This was confirmed to not be a coat layer formed by adhesion of particulate clumps containing silicon compounds.

(Production Example of Toner Particle 29)

3.5 parts by mass of an organic silicon polymer solution obtained by reacting 10.0 parts by mass of toluene, 5.0 parts by mass of ethanol, 5.0 parts by mass of water and 5.0 parts by mass of methyltriethoxysilane for six hours at 90° C. was sprayed onto 100.0 parts by mass of toner parent body 26 while stirring in a Henschel mixer followed by uniformly mixing.

The particles were then circulated for 30 minutes in a fluidized bed dryer under conditions of an inlet temperature of 90° C. and outlet temperature of 45° C. to carry out drying and polymerization. The resulting treated toner was similarly sprayed with 3.5 parts by mass of the above-mentioned organic silicon polymer solution with respect to 100 parts by mass of the treated toner in a Henschel mixer followed by circulating for 30 minutes in a fluidized bed dryer under conditions of an inlet temperature of 90° C. and outlet temperature of 45° C.

Spraying and drying of the organic silicon polymer solution was similarly repeated 10 times to obtain toner particle 29. The physical properties of the toner particle 29 are shown in Table 10. Silicon atoms were confirmed to be uniformly present in the surface layer by carrying out silicon mapping during TEM observations of the toner particle 29. This was confirmed to not be a coat layer formed by adhesion of particulate clumps containing silicon compounds.

(Preparation Example of Toner Particle 30)

Toner particle 30 was obtained in the same manner as the production example of toner particle 1 with the exception of changing the 6.5 parts by mass of copper phthalocyanine in the production example of toner particle 1 to 10.0 parts by mass of carbon black. The formulation and conditions of the toner particle 30 are shown in Table 5. The physical properties are shown in Table 10. Silicon atoms were confirmed to be uniformly present in the surface layer by carrying out silicon mapping during TEM observations of the toner particle 30. This was confirmed to not be a coat layer formed by adhesion of particulate clumps containing silicon compounds.

(Production Example of Toner Particle 31)

Toner particle 31 was obtained in the same manner as the production example of toner particle 1 with the exception of changing the 74.0 parts by mass of styrene used in the production example of toner particle 1 to 63.0 parts by mass, changing the 26.0 parts by mass of n-butylacrylate to 37.0 parts by mass, changing the 5.0 parts by mass of methyltriethoxysilane to 4.0 parts by mass, and adding 1.0 part by mass of titanium tetra-n-butoxide. The formulation and conditions of the toner particle 31 are shown in Table 6 and the physical properties are shown in Table 11. Silicon atoms were confirmed to be uniformly present in the surface layer by carrying out silicon mapping during TEM observations of the toner particle 31. This was confirmed to not be a coat layer formed by adhesion of particulate clumps containing silicon compounds.

(Preparation of Toner Particle 32)

Toner particle 32 was obtained in the same manner as the production example of toner particle 1 with the exception of changing the 6.5 parts by mass of copper phthalocyanine (Pigment Blue 15:3) used in the production example of toner particle 1 to 8.0 parts by mass of Pigment Red 122 (P.R. 122). The formulation and conditions of the toner particle 32 are shown in Table 6 and the physical properties are shown in Table 11. Silicon atoms were confirmed to be uniformly present in the surface layer by carrying out silicon mapping during TEM observations of the toner particle 32. This was confirmed to not be a coat layer formed by adhesion of particulate clumps containing silicon compounds.

(Production Example of Toner Particle 33)

Toner particle 33 was obtained in the same manner as the production example of toner particle 1 with the exception of changing the 6.5 parts by mass of copper phthalocyanine (Pigment Blue 15:3) used in the production example of toner particle 1 to 6.0 parts by mass of Pigment Yellow 155 (P.Y. 155). The formulation and conditions of the toner particle 33 are shown in Table 6 and the physical properties are shown in Table 11. Silicon atoms were confirmed to be uniformly present in the surface layer by carrying out silicon mapping during TEM observations of the toner particle 33. This was confirmed to not be a coat layer formed by adhesion of particulate clumps containing silicon compounds.

(Production Example of Toner Particle 34)

Toner particle 34 was obtained in the same manner as the production example of toner particle 1 with the exception of changing to 10.0 parts by mass of polyester resin (11) instead of 10.0 parts by mass of the polyester resin (1) used in the production example of toner particle 1. The formulation and conditions of the toner particle 34 are shown in Table 6 and the physical properties are shown in Table 11. Silicon atoms were confirmed to be uniformly present in the surface layer by carrying out silicon mapping during TEM observations of the toner particle 34. This was confirmed to not be a coat layer formed by adhesion of particulate clumps containing silicon compounds.

(Production Example of Toner Particle 35)

Toner particle 35 was obtained in the same manner as the production example of toner particle 1 with the exception of changing to 10.0 parts by mass of polyester resin (12) instead of 10.0 parts by mass of the polyester resin (1) used in the production example of toner particle 1. The formulation and conditions of the toner particle 35 are shown in Table 6 and the physical properties are shown in Table 11. Silicon atoms were confirmed to be uniformly present in the surface layer by carrying out silicon mapping during TEM observations of the toner particle 35. This was confirmed to not be a coat layer formed by adhesion of particulate clumps containing silicon compounds.

(Production Example of Comparative Toner Particle 1)

Comparative toner particle 1 was obtained in the same manner as the production example of toner particle 1 with the exception of changing to 0.0 parts by mass of methyltriethoxysilane instead of 5.0 parts by mass of the methyltriethoxysilane used in the production example of toner particle 1. The formulation and conditions of the comparative toner particle 1 are shown in Table 7 and the physical properties are shown in Table 12. Silicon atoms were not present when silicon mapping was carried out during TEM observations of the comparative toner particle 1.

(Production Example of Comparative Toner Particle 2)

Comparative toner particle 2 was obtained in the same manner as the production example of comparative toner particle 1 with the exception of not adding the 10.0 parts by mass of polyester resin (1) used in the production example of comparative toner particle 1. The formulation and conditions of the comparative toner particle 2 are shown in Table 7 and the physical properties are shown in Table 12. Silicon atoms were not present when silicon mapping was carried out during TEM observations of the comparative toner particle 2.

(Production Example of Comparative Toner Particle 3)

Comparative toner particle 3 was obtained in the same manner as the production example of toner particle 1 with the exception of changing to 5.0 parts by mass of tetraethoxysilane instead of 5.0 parts by mass of the methyltriethoxysilane used in the production example of toner particle 1. The formulation and conditions of the comparative toner particle 3 are shown in Table 7 and the physical properties are shown in Table 12. A small number of silicon atoms were confirmed to be present in the surface layer by carrying out silicon mapping during TEM observations of the comparative toner particle 3.

(Production Example of Comparative Toner Particle 4)

Comparative toner particle 4 was obtained in the same manner as the production example of toner particle 1 with the exception of changing to 5.0 parts by mass of 3-methacryloxypropyltriethoxysilane instead of 5.0 parts by mass of the methyltriethoxysilane used in the production example of toner particle 1. The formulation and conditions of the comparative toner particle 4 are shown in Table 7 and the physical properties are shown in Table 12. A small number of silicon atoms were confirmed to be present in the surface layer by carrying out silicon mapping during TEM observations of the comparative toner particle 4.

(Production Example of Comparative Toner Particle 5)

Comparative toner particle 5 was obtained in the same manner as the production example of toner particle 1 with the exception of changing to 10.0 parts by mass of polyester resin A (1) instead of 10.0 parts by mass of the polyester resin (1) used in the production example of toner particle 1. The formulation and conditions of the comparative toner particle 5 are shown in Table 7 and the physical properties are shown in Table 12. A small number of silicon atoms were confirmed to be present in the surface layer by carrying out silicon mapping during TEM observations of the comparative toner particle 5.

(Production Example of Comparative Toner Particle 6)

Comparative toner particle 6 was obtained in the same manner as the production example of toner particle 1 with the exception of changing to 5.0 parts by mass of methyltrimethoxysilane instead of 5.0 parts by mass of the methyltriethoxysilane used in the production example of toner particle 1, and changing to 10.0 parts by mass of polyester resin A (2) instead of 10.0 parts by mass of polyester resin (1). The formulation and conditions of the comparative toner particle 6 are shown in Table 7 and the physical properties are shown in Table 12. A small number of silicon atoms were confirmed to be present in the surface layer by carrying out silicon mapping during TEM observations of the comparative toner particle 6.

(Production Example of Comparative Toner Particle 7)

Comparative toner particle 7 was obtained in the same manner as the production example of comparative toner particle 1 with the exception of changing to 10.0 parts by mass of polyester resin (9) instead of 10.0 parts by mass of the polyester resin (1) used in the production example of comparative toner particle 1. The formulation and conditions of the comparative toner particle 7 are shown in Table 7 and the physical properties are shown in Table 12. Silicon atoms were not present when silicon mapping was carried out during TEM observations of the comparative toner particle 7.

(Production Example of Comparative Toner Particle 8)

Comparative toner particle 8 was obtained in the same manner as the production example of comparative toner particle 1 with the exception of changing to 10.0 parts by mass of polyester resin (10) instead of 10.0 parts by mass of the polyester resin (1) used in the production example of comparative toner particle 1. The formulation and conditions of the comparative toner particle 8 are shown in Table 7 and the physical properties are shown in Table 12. Silicon atoms were not present when silicon mapping was carried out during TEM observations of the comparative toner particle 8.

(Production Example of Comparative Toner Particle 9)

Comparative toner particle 9 was obtained in the same manner as the production example of comparative toner particle 1 with the exception of changing to 10.0 parts by mass of polyester resin A (3) instead of 10.0 parts by mass of the polyester resin (1) used in the production example of comparative toner particle 1. The formulation and conditions of the comparative toner particle 9 are shown in Table 7 and the physical properties are shown in Table 12. Silicon atoms were not present when silicon mapping was carried out during TEM observations of the comparative toner particle 9.

(Production Example of Comparative Toner Particle 10)

Comparative toner particle 10 was obtained in the same manner as the production example of toner particle 1 with the exception of changing to 2.5 parts by mass of n-butyltri-t-butoxysilane instead of 5.0 parts by mass of the methyltriethoxysilane used in the production example of toner particle 1, and changing to 10.0 parts by mass of polyester resin A (3) instead of 10.0 parts by mass of polyester resin (1). The formulation and conditions of the comparative toner particle 10 are shown in Table 7 and the physical properties are shown in Table 12. A small number of silicon atoms were confirmed to be present in the surface layer by carrying out silicon mapping during TEM observations of the comparative toner particle 10.

(Production Example of Comparative Toner Particle 11)

Comparative toner particle 11 was obtained in the same manner as the production example of toner particle 1 with the exception of changing to 10.0 parts by mass of polyester resin A (6) instead of 10.0 parts by mass of the polyester resin (1) used in the production example of toner particle 1. The formulation and conditions of the comparative toner particle 11 are shown in Table 7 and the physical properties are shown in Table 12. Silicon atoms were present when silicon mapping was carried out during TEM observations of the comparative toner particle 11.

(Production Example of Comparative Toner Particle 12)

Comparative toner particle 12 was obtained in the same manner as the production example of toner particle 1 with the exception of changing to 10.0 parts by mass of polyester resin A (7) instead of 10.0 parts by mass of the polyester resin (1) used in the production example of toner particle 1. The formulation and conditions of the comparative toner particle 12 are shown in Table 7 and the physical properties are shown in Table 12. Silicon atoms were present when silicon mapping was carried out during TEM observations of the comparative toner particle 12.

(Production Example of Toner 1)

0.3 parts by mass of hydrophobic silica, having a specific surface area as determined by BET of 200 $m^2/g$ and subjected to hydrophobic treatment with 3.0% by mass of hexamethyldisilazane and 3% by mass of 100 cps silicone oil, and 0.1 part by mass of aluminum oxide, having a specific surface area as determined by BET of 50 $m^2/g$, were mixed with 100 parts by mass of toner particle 1 with a Henschel mixer (Mitsui Mining & Smelting Co., Ltd. (currently Nippon Coke & Engineering Co., Ltd.), and the resulting toner was designated as toner 1.

(Production Examples of Toners 2 to 35)

Toners 2 to 35 were obtained in the same manner as the production example of toner 1 with the exception of changing the toner particle 1 used in the production example of toner 1 to toner particles 2 to 35.

(Production Example of Comparative Toners 1 to 12)

Comparative toners 1 to 12 were obtained in the same manner as the production example of toner 1 with the exception of changing the toner particle 1 used in the production example of toner 1 to comparative toner particles 1 to 12.

(Evaluation of Physical Properties after Washing Toner 1)

160 g of sucrose (Kishida Chemical Co., Ltd.) were added to 100 mL of ion exchange water and dissolved while heating the ion exchange water to prepare a concentrated sucrose solution. 31.0 g of the above-mentioned concentrated sucrose solution and 6 mL of Contaminon N (trade name) (10% by mass aqueous solution of neutral detergent for cleaning precision measuring instruments having a pH of 7 and composed of a nonionic surfactant, anionic surfactant and an organic builder, Wako Pure Chemical Industries, Ltd.) were placed in a centrifuge tube to produce a dispersion. 1.0 g of toner was added to this dispersion and clumps of the toner were broken up with a spatula.

The centrifuge tube was shaken for 20 minutes with a shaker at 350 strokes per minute (spm). After shaking, the solution was transferred to a glass tube (50 mL) for a swing rotor and separated with a centrifugal separator for 30 minutes at 3500 rpm. After visually confirming that the toner and aqueous solution had adequately separated, the toner separated in the uppermost layer was collected with a spatula and the like. After filtering the collected toner with a vacuum filter, the toner was dried for 1 hour or more with a dryer. The dried product was crushed with a spatula to obtain washed toner particle 1.

When the resulted washed toner particle 1 were dried and their physical properties were measured, the washed toner particle 1 yielded nearly the same results as the toner physical properties of the toner particle 1.

(Evaluation of Physical Properties after Washing Toners 2 to 35 and Evaluation of Physical Properties after Washing Comparative Toners 1 to 12)

When physical properties after washing were evaluated in the same manner as the evaluation of physical properties after washing toner 1 with the exception of changing toner 1 to toner N (N=2 to 35) and comparative toner M (M=1 to 12), the washed toner particle N and the washed toner particle M respectively yielded nearly the same results as the toner physical properties of the toner particle N and the comparative toner particle M (Table 8 to 12).

EXAMPLE 1

Evaluations were carried out using toner 1. The evaluation results are shown in Table 18.

(Evaluation of Storage Stability)

(Evaluation of Storability)

10 g of toner 1 were placed in a 100 mL glass bottle and allowed to stand for 15 days at a temperature of 50° C. and humidity of 20% followed by a visual assessment of the toner.

A: No change

B: Some aggregates but soon broken up

C: Formation of aggregates that are difficult to break up

D: No flowability

E: Definite occurrence of caking (Evaluation of Long-Term Storability)

10 g of toner 1 were placed in a 100 mL glass bottle and allowed to stand for 3 months at a temperature of 45° C. and 95% humidity followed by a visual assessment of the toner.

A: No change

B: Some aggregates but soon broken up

C: Formation of aggregates that are difficult to break up

D: No flowability

E: Definite occurrence of caking (Evaluation of Environmental Stability and Development Durability)

Figure 4:
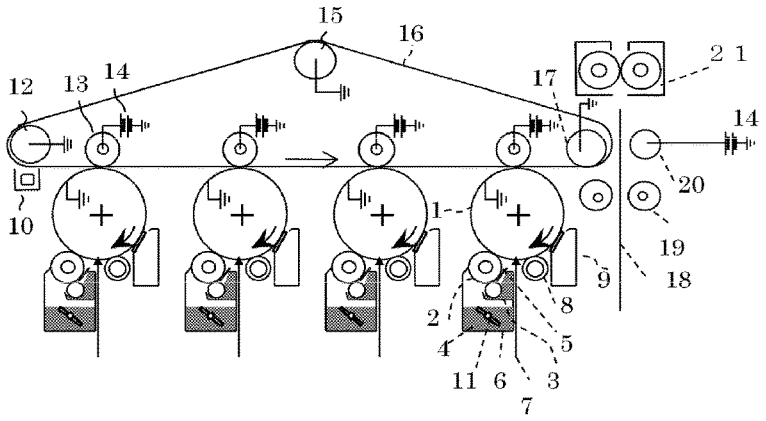
FIG. 4 is a schematic block diagram showing an example of an image-forming apparatus used in the present invention.

150 g of toner 1 were filled into a toner cartridge of the tandem-type Canon LBP7700C Laser Beam Printer having the structure shown in FIG. 4.

In FIG. 4, 1 represents a photosensitive member, 2 represents a developing roller, 3 represents a toner supplying roller, 4 represents a toner, 5 represents a regulating blade, 6 represents a developing assembly, 7 represents a laser light, 8 represents a charging assembly, 9 represents a cleaning assembly, 10 represents a charging assembly for cleaning, 11 represents a stirring blade, 12 represents a driver roller, 13 represents a transfer roller, 14 represents a bias supply, 15 represents a tension roller, 16 represents a transfer and transport belt, 17 represents a driven roller, 18 represents a paper, 19 represents a paper supplying roller, 20 represents an attracting roller, and 21 represents a fixing apparatus.

The toner cartridge was allowed to stand for 24 hours in respective environments consisting of a low temperature, low humidity L/L environment (10° C./15% RH), normal temperature, normal humidity N/N environment (25° C./50% RH) and high temperature, high humidity H/H environment (32.5° C./85% RH). After allowing to stand for 24 hours in each environment, the toner cartridge was installed in the above-mentioned LBP7700C and solid images were initially printed out (toner laid-on level: 0.40 mg/cm$^2$). Subsequently, 15,000 images having a print percentage of 1.0% were printed out. After printing out 15,000 images, a solid image was again printed out followed by evaluating the density and fogging of the initial solid image and the solid image printed out after printing out 15,000 images, and evaluating contamination of members after printing out the 15,000 images. 70 g/m$^2$ A4-size paper was used for the transfer paper and printing was carried out in the A4 horizontal direction.

In addition, 150 g of toner 1 were filled into the above-mentioned toner cartridge. The toner cartridge was then allowed to stand for 168 hours in a harsh environment (40° C./95% RH). Subsequently, the toner cartridge was further allowed to stand for 24 hours in super high temperature, high humidity SHH environment (32.5° C./90% RH). After standing for 24 hours in the super high temperature, high humidity environment, the toner cartridge was installed in the above-mentioned LBP7700C and a solid image was initially printed out. Subsequently, 15,000 images having a print percentage of 1.0% were printed out. A solid image was again printed out after printing out the 15,000 images followed by evaluating the density and fogging of the initial solid image and the solid image printed out after printing out 15,000 images, and evaluating contamination of members after printing out the 15,000 images.

(Evaluation of Image Density)

Image density of the portion where images were fixed was measured for an initial solid image and a solid image printed out after printing out 15,000 images using a Macbeth densitometer equipped with an SPI auxiliary filter (trade name: RD-914, Macbeth Corp.). Furthermore, the evaluation criteria for image density were as indicated below. 70 g/m$^2$ A4-size paper was used for the transfer paper and printing was carried out in the A4 horizontal direction.

A: 1.45 or more

B: 1.40 to less than 1.45

C: 1.30 to less than 1.40

D: 1.25 to less than 1.30

E: 1.20 to less than 1.25

F: Less than 1.20

(Evaluation of Fogging)

Fog density (%) was calculated from the difference between white background brightness of output images and transfer paper brightness as measured with a "Reflectometer" (Tokyo Denshoku Co., Ltd.) for an initial image having a print percentage of 0% and an image having a print percentage of 0% printed out after printing out 15,000 images. In addition, that fog density was evaluated as image fogging using the criteria indicated below. 70 g/m$^2$ A4-size paper was used for the transfer paper and printing was carried out in the A4 horizontal direction.

A: Less than 1.0%

B: 1.0% to less than 1.5%

C: 1.5% to less than 2.0%

D: 2.0% to less than 2.5%

E: 2.5% to less than 3.0%

F: 3.0% or more (Evaluation of Contamination of Members)

Contamination of members was evaluated in accordance with the following criteria by printing out images in which the first half of images was formed with a halftone image (toner laid-on level: 0.25 mg/cm$^2$) and the second half was formed with a solid image (toner laid-on level: 0.40 mg/cm$^2$) after printing out 15,000 images. 70 g/m$^2$ A4-size paper was used for the transfer paper and printing was carried out in the A4 horizontal direction.

A: Vertical streaks in the direction of paper ejection not visible on the developing roller, half tone portion or solid portion of images.

B: One to two narrow streaks present in the circumferential direction on both ends of the developing roller, but vertical streaks in the direction of paper ejection not visible on the halftone portion or solid portion of images.

C: Three to five narrow streaks present in the circumferential direction on both ends of the developing roller, and very few vertical streaks in the direction of paper ejection observed on the halftone portion or solid portion of images, but only observed to a degree that can be removed by image processing.

D: Six to twenty narrow streaks present in the circumferential direction on both ends of the developing roller, and several narrow streaks also observed on the halftone portion or solid portion of images that are unable to be removed by image processing.

E: Twenty one or more streaks observed on the developing roller and the halftone portion of images and are unable to be removed by image processing.

(Measurement of Toner Triboelectric Charge Quantity)

The triboelectric charge quantity of toner was determined according to the method indicated below. First, the toner and a standard carrier for a negatively charged polar toner (trade name: N-01, Imaging Society of Japan) were respectively allowed to stand for a prescribed amount of time in the environments indicated below.

(1) Allowed to stand for 24 hours in a low temperature, low humidity environment (10° C./15% RH), normal temperature, normal humidity environment (25° C./50% RH) and high temperature, high humidity environment (32.5° C./85% RH).

(2) Allowed to stand for 168 hours in a harsh environment (40° C./95% RH) followed by allowing to stand for hours in a super high temperature, high humidity environment (32.5° C./90% RH).

Following the above-mentioned standing, the toner and standard carrier were mixed for 120 seconds using a turbula mixer in each of the environments so that the amount of the toner was 5% by mass to obtain a two-component developer. Next, the two-component developer was placed in a metal container having an electrically conductive screen having a pore size of 20 μm attached to the bottom thereof in an environment at normal temperature and normal humidity (25° C./50% RH) within 1 minute after mixing the two-component developer followed by aspirating with an aspirator and measuring the difference in mass before and after aspiration and the electrical potential that accumulated in a capacitor connected to the container. At this time, the aspiration pressure was 4.0 kPa. Triboelectric charge quantity of the toner was calculated using the following equation from the difference in mass before and after aspiration, the accumulated electrical potential, and the capacity of the capacitor.

Furthermore, the standard carrier for negatively charged polar toner (trade name: N-01, Imaging Society of Japan) used in the measurement was used after passing through a 250 mesh sieve.

$$Q=(A\times B)/(W1-W2)$$

Q (mC/kg): Toner triboelectric charge quantity

A (μF): Capacity of capacitor

B (V): Electrical potential difference accumulated in capacitor

W1−W2 (kg): Mass difference before and after aspiration (Evaluation of Low-Temperature Fixability (Temperature at Completion of Cold Offset))

The fixing unit of the LBP7700C laser beam printer manufactured by Canon Inc. was modified to enable adjustment of fixation temperature. The modified LBP7700C was then used to form fixed images on image receiving paper by hot-pressing unfixed images onto image receiving paper in the absence of oil at a process speed of 250 mm/sec and toner laid-on level of 0.40 mg/cm$^2$.

Fixing performance was evaluated by rubbing the fixed images ten times with a Kimwipe (trade name: S-200, Nippon Paper Crecia Co., Ltd.) while applying a load of 75 g/cm$^2$ and taking the temperature at which the rate of decrease in density before and after rubbing was less than 5% to be the temperature at completion of cold offset. This evaluation was carried out at normal temperature and normal humidity (25° C., 50% RH).

In the present invention, temperature at completion of cold offset is preferably at a level of 125° C. or lower. A temperature at completion of offset that exceeds 125° C. is not preferable from the viewpoint of saving energy.

EXAMPLES 2 to 35

Evaluations were carried out in the same manner as Example 1 with the exception of changing toner 1 of Example 1 to toners 2 to 35. The results are shown in Tables 18, 19, 20 and 21.

Comparative Examples 1 to 12

Evaluations were carried out in the same manner as Example 1 with the exception of changing toner 1 of Example 1 to comparative toners 1 to 12. The results are shown in Table 22.

EXAMPLE 36

Evaluation was carried out in the same manner as Example 1 with the exception of changing toner 1 of Example 1 to toner particle 1. The results are shown in Table 21. The evaluation results for toner particle 1 were comparable to those of toner 1.

TABLE 1

| | | Molecular weight | Polyester resin | (1) | (2) | (3) | (4) | (5) | (6) | (7) | (8) | (9) | (10) |
|---|---|---|---|---|---|---|---|---|---|---|---|---|---|
| Aliphatic diols | 1,3-propanediol | 76.1 | mass parts | | | | | 300.0 | 100.0 | | 300.0 | | |
| | | | mol % | | | | | 100.0 | 100.0 | | 100.0 | | |
| | 1,4-butanediol | 90.1 | mass parts | | | | | | | | | | |
| | | | mol % | | | | | | | | | | |
| | 1,6-hexanediol | 118.2 | mass parts | 400.0 | 339.1 | | | | | 400.0 | | | 200.0 |
| | | | mol % | 100.0 | 105.0 | | | | | 100.0 | | | 100.0 |
| | 1,9-nonanediol | 160.3 | mass parts | | | | | | | | | | |
| | | | mol % | | | | | | | | | | |
| | 1,12-dodecanediol | 202.3 | mass parts | | | | | | | | | | |
| | | | mol % | | | | | | | | | | |
| | 1,16-hexadecanediol | 258.4 | mass parts | | | 400.0 | 400.0 | | | | | 400.0 | |
| | | | mol % | | | 100.0 | 100.0 | | | | | 100.0 | |
| | 1,17-heptadecanediol | 272.5 | mass parts | | | | | | | | | | |
| | | | mol % | | | | | | | | | | |
| Aromatic diol | Bisphenol A-PO adduct (2.0 mole adduct) | 274.0 | mass parts | | | | | | | | | | |
| | | | mol % | | | | | | | | | | |
| Aliphatic di-carboxylic acids | 1,2-ethanedi-carboxylic acid (succinic acid) | 118.1 | mass parts | | | | 179.1 | 456.8 | | | 233.1 | | |
| | | | mol % | | | | 98.0 | 98.0 | | | 50.0 | | |
| | 1,4-butane-dicarboxylic acid (adipic acid) | 146.1 | mass parts | 485.5 | 400.0 | | | | | 485.5 | | | |
| | | | mol % | 98.0 | 100.0 | | | | | 98.0 | | | |

TABLE 1-continued

| | | Molecular weight | Polyester resin | (1) | (2) | (3) | (4) | (5) | (6) | (7) | (8) | (9) | (10) |
|---|---|---|---|---|---|---|---|---|---|---|---|---|---|
| | 1,8-octane-dicarboxylic acid (sebacic acid) | 202.3 | mass parts | | | | | | | | | | 336.0 |
| | | | mol % | | | | | | | | | | 98.0 |
| | 1,10-decane-dicarboxylic acid (dodecanoic acid) | 230.3 | mass parts | | | | | | | | | | |
| | | | mol % | | | | | | | | | | |
| | 1,14-tetradecane dicarboxylic acid | 286.4 | mass parts | | | 434.3 | | | 369.2 | | | | |
| | | | mol % | | | 98.0 | | | 98.1 | | | | |
| | 1,15-pentadecane dicarboxylic acid | 300.4 | mass parts | | | | | | | | | | |
| | | | mol % | | | | | | | | | | |
| Trivalent carboxylic acid | Trimellitic acid | 210.1 | mass parts | | | | | | | 7.1 | | | |
| | | | mol % | | | | | | | 1.0 | | | |
| Un-saturated fatty acid | Fumaric acid | 116.1 | mass parts | | | | | | | | 219.7 | | |
| | | | mol % | | | | | | | | 48.0 | | |
| Aromatic di-carboxylic acid | Terephthalic acid | 166.1 | mass parts | | | | | | | | | 251.8 | |
| | | | mol % | | | | | | | | | 98.0 | |
| Vinylic monomers | Acrylic acid | 72.1 | mass parts | | | | | | | | | | 8.6 |
| | | | mol % | | | | | | | | | | 7.0 |
| | St | 104.2 | mass parts | | | | | | | | | | 140.0 |
| | | | mol % | | | | | | | | | | 79.4 |
| Physical properties of polyester resin | Melting point | | ° C. | 59.8 | 60.5 | 82.3 | 72.4 | 28.4 | 53.2 | 90.4 | 64.1 | 98 | 63.9 |
| | Number-average molecular weight | | Mn | 3300 | 3200 | 3400 | 3200 | 2100 | 3900 | 3700 | 3700 | 3700 | 3100 |
| | Weight-average molecular weight | | Mw | 16000 | 14000 | 19800 | 16500 | 9800 | 14500 | 162000 | 23100 | 22100 | 18000 |
| | Acid value | | mg/KOHg | 0.5 | 23.4 | 1.4 | 0.8 | 2.4 | 0.8 | 3.1 | 1.7 | 4.7 | 1.5 |
| | Hydroxyl value | | mg/KOHg | 21 | 3.1 | 31 | 15 | 20.6 | 24 | 26 | 22.8 | 18.4 | 21.6 |

TABLE 2

| | | Molecular weight | Polyester resin | (11) | (12) | A(1) | A(2) | A(3) | A(4) | A(5) | A(6) | A(7) |
|---|---|---|---|---|---|---|---|---|---|---|---|---|
| Aliphatic diols | 1,3-propanediol | 76.1 | mass parts | | | | | | Described in description | Described in description | | |
| | | | mol % | | | | | | | | | |
| | 1,4-butanediol | 90.1 | mass parts | | | | | | | | | |
| | | | mol % | | | | | | | | | |
| | 1,6-hexanediol | 118.2 | mass parts | 100.0 | | | 200.0 | | | | 100.0 | |
| | | | mol % | 55.0 | | | 100.0 | | | | 40.0 | |
| | 1,9-nonanediol | 160.3 | mass parts | | | | | | | | | |
| | | | mol % | | | | | | | | | |
| | 1,12-dodecanediol | 202.3 | mass parts | | | | | | | | | |
| | | | mol % | | | | | | | | | |
| | 1,16-hexadecanediol | 258.4 | mass parts | | | | | | | | | |
| | | | mol % | | | | | | | | | |
| | 1,17-heptadecanediol | 272.5 | mass parts | | | 400.0 | | | | | | |
| | | | mol % | | | 100.0 | | | | | | |
| Aromatic diol | Bisphenol A-PO adduct (2.0 mole adduct) | 274.0 | mass parts | 189.7 | 400.0 | | | 400.0 | | | 347.7 | 400.0 |
| | | | mol % | 45.0 | 100.0 | | | 100.0 | | | 60.0 | 100.0 |
| Aliphatic dicarboxylic acids | 1,2-ethanedicarboxylic acid (succinic acid) | 118.1 | mass parts | | | | | | | | | |
| | | | mol % | | | | | | | | | |
| | 1,4-butanedicarboxylic acid (adipic acid) | 146.1 | mass parts | | | | | | | | | |
| | | | mol % | | | | | | | | | |
| | 1,8-octanedicarboxylic acid (sebacic acid) | 202.3 | mass parts | | 147.7 | 290.9 | | | | | | 118.1 |
| | | | mol % | | 50.0 | 98.0 | | | | | | 40.0 |
| | 1,10-decanedicarboxylic acid (dodecanoic acid) | 230.3 | mass parts | | | | | | | | | |
| | | | mol % | | | | | | | | | |
| | 1,14-tetradecane dicarboxylic acid | 286.4 | mass parts | | | | | | | | | |
| | | | mol % | | | | | | | | | |
| | 1,15-pentadecane dicarboxylic acid | 300.4 | mass parts | | | | 499.0 | | | | | |
| | | | mol % | | | | 98.0 | | | | | |
| Trivalent carboxylic acid | Trimellitic acid | 210.1 | mass parts | | | | | | | | | |
| | | | mol % | | | | | | | | | |
| Unsaturated fatty acid | Fumaric acid | 116.1 | mass parts | | | | | | | | | |
| | | | mol % | | | | | | | | | |

TABLE 2-continued

| | | Molecular weight | Polyester resin | (11) | (12) | A(1) | A(2) | A(3) | A(4) | A(5) | A(6) | A(7) |
|---|---|---|---|---|---|---|---|---|---|---|---|---|
| Aromatic dicarboxylic acid | Terephthalic acid | 166.1 | mass parts | 250.4 | 116.4 | | | 166.0 | | | 344.3 | 140.6 |
| | | | mol % | 98.0 | 48.0 | | | 98.0 | | | 98.0 | 58.0 |
| Vinylic monomers | Acrylic acid | 72.1 | mass parts | | | | | | | | | |
| | | | mol % | | | | | | | | | |
| | St | 104.2 | mass parts | | | | | | | | | |
| | | | mol % | | | | | | | | | |
| Physical properties of polyester resin | Melting point | | ° C. | 60.4 | 60.3 | 74.6 | 76.8 | — | — | — | 58.7 | 59.4 |
| | Number-average molecular weight | | Mn | 4500 | 3600 | 3600 | 3900 | 3200 | 3080 | 6000 | 4200 | 3400 |
| | Weight-average molecular weight | | Mw | 18000 | 15800 | 21000 | 22000 | 24000 | 24300 | 53600 | 16400 | 16200 |
| | Acid value | | mg/KOHg | 0.9 | 0.7 | 1.9 | 1.6 | 2.5 | 2.5 | 14.3 | 1.3 | 1.2 |
| | Hydroxyl value | | mg/KOHg | 24.2 | 24.1 | 33.4 | 30 | 24.3 | 24.3 | 24.1 | 22.4 | 21.6 |

TABLE 3

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| | Toner particle | | 1 | 2 | 3 | 4 | 5 | 6 | 7 | 8 | 9 | 10 |
| Monomer | Styrene | mass parts | 74.0 | 74.0 | 74.0 | 74.0 | 74.0 | 74.0 | 74.0 | 74.0 | 74.0 | 74.0 |
| | n-butyl acrylate | mass parts | 26.0 | 26.0 | 26.0 | 26.0 | 26.0 | 26.0 | 26.0 | 26.0 | 26.0 | 26.0 |
| | Silane | Silane1 | Methyl tri ethoxy silane | Phenyl tri methoxy silane | Ethyl tri ethoxy silane | n-propyl tri ethoxy silane | n-butyl tri ethoxy silane | Methyl tri ethoxy silane | Methyl tri methoxy silane | Methyl di ethoxy chloro silane | Methyl tri ethoxy silane | Methyl tri ethoxy silane |
| | | Silane1 mass parts | 5.0 | 5.0 | 5.0 | 5.0 | 5.0 | 4.0 | 5.0 | 5.0 | 30.0 | 2.5 |
| | | Silane2 | — | — | — | — | — | Methyl trichloro silane | — | — | — | — |
| | | Silane2 mass parts | — | — | — | — | — | 1.0 | — | — | — | — |
| | | Silane3 | — | — | — | — | — | — | — | — | — | — |
| | | Silane3 mass parts | — | — | — | — | — | — | — | — | — | — |
| Solvent | Toluene | mass parts | 0.0 | 0.0 | 0.0 | 0.0 | 0.0 | 0.0 | 0.0 | 0.0 | 0.0 | 0.0 |
| Polyester resin | | Type | (1) | (1) | (1) | (1) | (1) | (1) | (1) | (1) | (1) | (1) |
| | | mass parts | 10.0 | 10.0 | 10.0 | 10.0 | 10.0 | 10.0 | 10.0 | 10.0 | 10.0 | 10.0 |
| Release agent | | Type | Fischer Tropsch wax | Fischer Tropsch wax | Fischer Tropsch wax | Fischer Tropsch wax | Fischer Tropsch wax | Fischer Tropsch wax | Fischer Tropsch wax | Fischer Tropsch wax | Fischer Tropsch wax | Fischer Tropsch wax |
| | | mass parts | 10.0 | 10.0 | 10.0 | 10.0 | 10.0 | 10.0 | 10.0 | 10.0 | 10.0 | 10.0 |
| | | Melting point (° C.) | 77.1 | 77.1 | 77.1 | 77.1 | 77.1 | 77.1 | 77.1 | 77.1 | 77.1 | 77.1 |
| | | Endo thermic quantity (J/g) | 209.6 | 209.6 | 209.6 | 209.6 | 209.6 | 209.6 | 209.6 | 209.6 | 209.6 | 209.6 |
| Colorant | | Colorant type | Copper phthalo cyanine | Copper phthalo cyanine | Copper phthalo cyanine | Copper phthalo cyanine | Copper phthalo cyanine | Copper phthalo cyanine | Copper phthalo cyanine | Copper phthalo cyanine | Copper phthalo cyanine | Copper phthalo cyanine |
| | | mass parts | 6.5 | 6.5 | 6.5 | 6.5 | 6.5 | 6.5 | 6.5 | 6.5 | 6.5 | 6.5 |
| Negative charge control agent | Charge control resin1 | mass parts | 0.4 | 0.4 | 0.4 | 0.4 | 0.4 | 0.4 | 0.4 | 0.4 | 0.4 | 0.4 |
| | Charge control agent1 | mass parts | 0.5 | 0.5 | 0.5 | 0.5 | 0.5 | 0.5 | 0.5 | 0.5 | 0.5 | 0.5 |
| Lipo soluble initiator | Type | | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate |
| | Amt. added | mass parts | 16.0 | 16.0 | 16.0 | 16.0 | 16.0 | 16.0 | 16.0 | 16.0 | 16.0 | 16.0 |
| Polymerization conditions | Reaction1 | Temp. | 70 | 70 | 70 | 70 | 70 | 70 | 70 | 70 | 70 | 70 |
| | | Holding time (hr) | 4 h | 4 h | 4 h | 4 h | 4 h | 4 h | 4 h | 4 h | 4 h | 4 h |
| | | pH | 5.1 | 5.1 | 5.1 | 5.1 | 5.1 | 5.1 | 5.1 | 5.1 | 5.1 | 5.1 |
| | Reaction2 | Temp. | 90 | 90 | 90 | 90 | 90 | 90 | 90 | 90 | 90 | 90 |
| | | Holding time (hr) | 1.5 h | 1.5 h | 1.5 h | 1.5 h | 1.5 h | 1.5 h | 1.5 h | 1.5 h | 1.5 h | 1.5 h |
| | | pH | 8.0 | 8.0 | 8.0 | 8.0 | 8.0 | 8.0 | 8.0 | 8.0 | 8.0 | 8.0 |

TABLE 3-continued

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| | Reaction3 | Temp. | 100 | 100 | 100 | 100 | 100 | 100 | 100 | 100 | 100 | 100 |
| | | Holding time (hr) | 5 h | 5 h | 5 h | 5 h | 5 h | 5 h | 5 h | 5 h | 5 h | 5 h |
| | | pH | 5.1 | 5.1 | 5.1 | 5.1 | 5.1 | 5.1 | 5.1 | 5.1 | 5.1 | 5.1 |
| | Reaction4 | Temp. | 65 | 65 | 65 | 65 | 65 | 65 | 65 | 65 | 65 | 65 |
| | | Holding time (hr) | 2 h | 2 h | 2 h | 2 h | 2 h | 2 h | 2 h | 2 h | 2 h | 2 h |
| | | pH | 5.1 | 5.1 | 5.1 | 5.1 | 5.1 | 5.1 | 5.1 | 5.1 | 5.1 | 5.1 |

TABLE 4

| | | | Example | | | | | | | | | |
|---|---|---|---|---|---|---|---|---|---|---|---|---|
| | | | 11 | 12 | 13 | 14 | 15 | 16 | 17 | 18 | 19 | 20 |
| | Toner particle | | 11 | 12 | 13 | 14 | 15 | 16 | 17 | 18 | 19 | 20 |
| Monomer | Styrene | mass parts | 74.0 | 74.0 | 74.0 | 74.0 | 74.0 | 29.6 | 74.0 | 74.0 | 74.0 | 74.0 |
| | n-butyl acrylate | mass parts | 26.0 | 26.0 | 26.0 | 26.0 | 26.0 | 10.4 | 26.0 | 26.0 | 26.0 | 26.0 |
| | Silane | Silane1 | Methyl tri ethoxy silane | Methyl tri ethoxy silane | Methyl tri ethoxy silane | Methyl tri ethoxy silane | Methyl tri ethoxy silane | Methyl tri ethoxy silane | Methyl tri ethoxy silane | Methyl tri ethoxy silane | Methyl tri ethoxy silane | Methyl tri ethoxy silane |
| | | Silane1 mass parts | 1.5 | 5.0 | 1.0 | 3.0 | 5.0 | 5.0 | 5.0 | 5.0 | 5.0 | 5.0 |
| | | Silane2 | — | — | Dimethyl diethoxy silane | Tetra ethoxy silane | — | — | — | — | — | — |
| | | Silane2 mass parts | — | — | 6.5 | 2.0 | — | — | — | — | — | — |
| | | Silane3 | — | — | — | — | — | — | — | — | — | — |
| | | Silane3 mass parts | — | — | — | — | — | — | — | — | — | — |
| Solvent | Toluene | mass parts | 0.0 | 0.0 | 0.0 | 0.0 | 0.0 | 60.0 | 0.0 | 0.0 | 0.0 | 0.0 |
| Polyester resin | | Type | (1) | (1) | (1) | (1) | (2) | (1) | (1) | (3) | (4) | (5) |
| | | mass parts | 10.0 | 10.0 | 10.0 | 10.0 | 10.0 | 70.0 | 1.4 | 10.0 | 10.0 | 10.0 |
| Release agent | | Type | Fischer Tropsch wax | Fischer Tropsch wax | Fischer Tropsch wax | Fischer Tropsch wax | Fischer Tropsch wax | Fischer Tropsch wax | Fischer Tropsch wax | Fischer Tropsch wax | Fischer Tropsch wax | Fischer Tropsch wax |
| | | mass parts | 10.0 | 10.0 | 10.0 | 10.0 | 10.0 | 10.0 | 10.0 | 10.0 | 10.0 | 10.0 |
| | | Melting point (° C.) | 77.1 | 77.1 | 77.1 | 77.1 | 77.1 | 77.1 | 77.1 | 77.1 | 77.1 | 77.1 |
| | | Endo thermic quantity (J/g) | 209.6 | 209.6 | 209.6 | 209.6 | 209.6 | 209.6 | 209.6 | 209.6 | 209.6 | 209.6 |
| Colorant | | Colorant type | Copper phthalo cyanine | Copper phthalo cyanine | Copper phthalo cyanine | Copper phthalo cyanine | Copper phthalo cyanine | Copper phthalo cyanine | Copper phthalo cyanine | Copper phthalo cyanine | Copper phthalo cyanine | Copper phthalo cyanine |
| | | mass parts | 6.5 | 6.5 | 6.5 | 6.5 | 6.5 | 6.5 | 6.5 | 6.5 | 6.5 | 6.5 |
| Negative charge control agent | Charge control resin1 | mass parts | 0.4 | 0.4 | 0.4 | 0.4 | 0.4 | 0.4 | 0.4 | 0.4 | 0.4 | 0.4 |
| | Charge control agent1 | mass parts | 0.5 | 0.5 | 0.5 | 0.5 | 0.5 | 0.5 | 0.5 | 0.5 | 0.5 | 0.5 |
| Lipo soluble initiator | Type | | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate |
| | Amt. added | mass parts | 16.0 | 16.0 | 16.0 | 16.0 | 16.0 | 16.0 | 16.0 | 16.0 | 16.0 | 16.0 |
| Polymer-ization conditions | Reaction1 | Temp. | 70 | 70 | 70 | 70 | 70 | 70 | 70 | 70 | 70 | 70 |
| | | Holding time (hr) | 4 h | 4 h | 4 h | 4 h | 4 h | 4 h | 4 h | 4 h | 4 h | 4 h |
| | | pH | 5.1 | 5.1 | 5.1 | 5.1 | 5.1 | 5.1 | 5.1 | 5.1 | 5.1 | 5.1 |
| | Reaction2 | Temp. | 90 | 90 | 90 | 90 | 90 | 90 | 90 | 90 | 90 | 90 |
| | | Holding time (hr) | 1.5 h | 1.5 h | 1.5 h | 1.5 h | 1.5 h | 1.5 h | 1.5 h | 1.5 h | 1.5 h | 1.5 h |
| | | pH | 8.0 | 10.0 | 8.0 | 8.0 | 8.0 | 8.0 | 8.0 | 8.0 | 8.0 | 8.0 |
| | Reaction3 | Temp. | 100 | 100 | 100 | 100 | 100 | 100 | 100 | 100 | 100 | 100 |
| | | Holding time (hr) | 5 h | 5 h | 5 h | 5 h | 5 h | 5 h | 5 h | 5 h | 5 h | 5 h |
| | | pH | 5.1 | 8.0 | 5.1 | 5.1 | 5.1 | 5.1 | 5.1 | 5.1 | 5.1 | 5.1 |

TABLE 4-continued

| | | | Example | | | | | | | | | |
|---|---|---|---|---|---|---|---|---|---|---|---|---|
| | | | 11 | 12 | 13 | 14 | 15 | 16 | 17 | 18 | 19 | 20 |
| | Reaction4 | Temp. | 65 | 65 | 65 | 65 | 65 | 65 | 65 | 65 | 65 | 65 |
| | | Holding time (hr) | 2 h | 2 h | 2 h | 2 h | 2 h | 2 h | 2 h | 2 h | 2 h | 2 h |
| | | pH | 5.1 | 8.0 | 5.1 | 5.1 | 5.1 | 5.1 | 5.1 | 5.1 | 5.1 | 5.1 |

TABLE 5

| | | | Example | | | | | | | | | |
|---|---|---|---|---|---|---|---|---|---|---|---|---|
| | | | 21 | 22 | 23 | 24 | 25 | 26 | 27 | 28 | 29 | 30 |
| | Toner particle | | 21 | 22 | 23 | 24 | 25 | 26 | 27 | 28 | 29 | 30 |
| Monomer | Styrene | mass parts | 74.0 | 74.0 | 74.0 | 74.0 | 74.0 | Described in description | Described in description | Described in description | Described in description | 74.0 |
| | n-butyl acrylate | mass parts | 26.0 | 26.0 | 26.0 | 26.0 | 26.0 | | | | | 26.0 |
| | Silane | Silane1 | Methyl tri ethoxy silane | Methyl tri ethoxy silane | Methyl tri ethoxy silane | Methyl tri ethoxy silane | Methyl tri ethoxy silane | | | | | Methyl tri ethoxy silane |
| | | Silane1 mass parts | 5.0 | 5.0 | 5.0 | 5.0 | 5.0 | | | | | 5.0 |
| | | Silane2 | — | — | — | — | — | | | | | — |
| | | Silane2 mass parts | — | — | — | — | — | | | | | — |
| | | Silane3 | — | — | — | — | — | | | | | — |
| | | Silane3 mass parts | — | — | — | — | — | | | | | — |
| Solvent | Toluene | mass parts | 0.0 | 0.0 | 0.0 | 0.0 | 0.0 | | | | | 0.0 |
| Polyester resin | | Type | (6) | (7) | (8) | (9) | (10) | | | | | (1) |
| | | mass parts | 10.0 | 10.0 | 10.0 | 10.0 | 10.0 | | | | | 10.0 |
| Release agent | | Type | Fischer Tropsch wax | Fischer Tropsch wax | Fischer Tropsch wax | Fischer Tropsch wax | Fischer Tropsch wax | | | | | Fischer Tropsch wax |
| | | mass parts | 10.0 | 10.0 | 10.0 | 10.0 | 10.0 | | | | | 10.0 |
| | | Melting point (° C.) | 77.1 | 77.1 | 77.1 | 77.1 | 77.1 | | | | | 77.1 |
| | | Endo thermic quantity (J/g) | 209.6 | 209.6 | 209.6 | 209.6 | 209.6 | | | | | 209.6 |
| Colorant | | Colorant type | Copper phthalo cyanine | Copper phthalo cyanine | Copper phthalo cyanine | Copper phthalo cyanine | Copper phthalo cyanine | | | | | Carbon black |
| | | mass parts | 6.5 | 6.5 | 6.5 | 6.5 | 6.5 | | | | | 10.0 |
| Negative charge control agent | Charge control resin1 | mass parts | 0.4 | 0.4 | 0.4 | 0.4 | 0.4 | | | | | 0.4 |
| | Charge control agent1 | mass parts | 0.5 | 0.5 | 0.5 | 0.5 | 0.5 | | | | | 0.5 |
| Lipo soluble initiator | Type | | t-butyl peroxy pivalate | t-butyl peroxy pivalate | t-butyl peroxy pivalate | t-butyl peroxy pivalate | t-butyl peroxy pivalate | | | | | t-butyl peroxy pivalate |
| | Amt. added | mass parts | 16.0 | 16.0 | 16.0 | 16.0 | 16.0 | | | | | 16.0 |
| Polymer-ization conditions | Reaction1 | Temp. | 70 | 70 | 70 | 70 | 70 | | | | | 70 |
| | | Holding time (hr) | 4 h | 4 h | 4 h | 4 h | 4 h | | | | | 4 h |
| | | pH | 5.1 | 5.1 | 5.1 | 5.1 | 5.1 | | | | | 5.1 |
| | Reaction2 | Temp. | 90 | 90 | 90 | 90 | 90 | | | | | 90 |
| | | Holding time (hr) | 1.5 h | 1.5 h | 1.5 h | 1.5 h | 1.5 h | | | | | 1.5 h |
| | | pH | 8.0 | 8.0 | 8.0 | 8.0 | 8.0 | | | | | 8.0 |
| | Reaction3 | Temp. | 100 | 100 | 100 | 100 | 100 | | | | | 100 |
| | | Holding time (hr) | 5 h | 5 h | 5 h | 5 h | 5 h | | | | | 5 h |
| | | pH | 5.1 | 5.1 | 5.1 | 5.1 | 5.1 | | | | | 5.1 |
| | Reaction4 | Temp. | 65 | 65 | 65 | 65 | 65 | | | | | 65 |
| | | Holding time (hr) | 2 h | 2 h | 2 h | 2 h | 2 h | | | | | 2 h |
| | | pH | 5.1 | 5.1 | 5.1 | 5.1 | 5.1 | | | | | 5.1 |

TABLE 6

| | | | Example | | | | |
|---|---|---|---|---|---|---|---|
| | | | 31 | 32 | 33 | 34 | 35 |
| Toner particle | | | 31 | 32 | 33 | 34 | 35 |
| Monomer | Styrene | mass parts | 63.0 | 74.0 | 74.0 | 74.0 | 74.0 |
| | n-butyl acrylate | mass parts | 37.0 | 26.0 | 26.0 | 26.0 | 26.0 |
| | Silane | Silane1 | Methyl tri ethoxy silane | Methyl tri ethoxy silane | Methyl tri ethoxy silane | Methyl tri ethoxy silane | Methyl tri ethoxy silane |
| | | Silane1 mass parts | 4.0 | 5.0 | 5.0 | 5.0 | 5.0 |
| | | Silane2 | Titanium tetra-n-butoxide | — | — | — | — |
| | | Silane2 mass parts | 1.0 | — | — | — | — |
| | | Silane3 | — | — | — | — | — |
| | | Silane3 mass parts | — | — | — | — | — |
| Solvent | Toluene | mass parts | 0.0 | 0.0 | 0.0 | 0.0 | 0.0 |
| Polyester resin | | Type | (1) | (1) | (1) | (11) | (12) |
| | | mass parts | 10.0 | 10.0 | 10.0 | 10.0 | 10.0 |
| Release agent | | Type | Fischer Tropsch wax | Fischer Tropsch wax | Fischer Tropsch wax | Fischer Tropsch wax | Fischer Tropsch wax |
| | | mass parts | 10.0 | 10.0 | 10.0 | 10.0 | 10.0 |
| | | Melting point (° C.) | 77.1 | 77.1 | 77.1 | 77.1 | 77.1 |
| | | Endo thermic quantity (J/g) | 209.6 | 209.6 | 209.6 | 209.6 | 209.6 |
| Colorant | | Colorant type | Copper phthalo cyanine | P.R.122 | P.Y.155 | Copper phthalo cyanine | Copper phthalo cyanine |
| | | mass parts | 6.5 | 8.0 | 6.0 | 6.5 | 6.5 |
| Negative charge control agent | Charge control resin1 | mass parts | 0.4 | 0.4 | 0.4 | 0.4 | 0.4 |
| | Charge control agent1 | mass parts | 0.5 | 0.5 | 0.5 | 0.5 | 0.5 |
| Lipo soluble initiator | Type | | t-butyl peroxy pivalate | t-butyl peroxy pivalate | t-butyl peroxy pivalate | t-butyl peroxy pivalate | t-butyl peroxy pivalate |
| | Amt. added | mass parts | 16.0 | 16.0 | 16.0 | 16.0 | 16.0 |
| Polymerization conditions | Reaction1 | Temp. | 70 | 70 | 70 | 70 | 70 |
| | | Holding time (hr) | 4 h | 4 h | 4 h | 4 h | 4 h |
| | | pH | 5.1 | 5.1 | 5.1 | 5.1 | 5.1 |
| | Reaction2 | Temp. | 90 | 90 | 90 | 90 | 90 |
| | | Holding time (hr) | 1.5 h | 1.5 h | 1.5 h | 1.5 h | 1.5 h |
| | | pH | 5.1 | 5.1 | 5.1 | 5.1 | 5.1 |
| | Reaction3 | Temp. | 100 | 100 | 100 | 100 | 100 |
| | | Holding time (hr) | 5 h | 5 h | 5 h | 5 h | 5 h |
| | | pH | 5.1 | 5.1 | 5.1 | 5.1 | 5.1 |
| | Reaction4 | Temp. | 65 | 65 | 65 | 65 | 65 |
| | | Holding time (hr) | 2 h | 2 h | 2 h | 2 h | 2 h |
| | | pH | 5.1 | 5.1 | 5.1 | 5.1 | 5.1 |

TABLE 7

| | | | Comparative Example | | | | | |
|---|---|---|---|---|---|---|---|---|
| | | | 1 | 2 | 3 | 4 | 5 | 6 |
| Comparative toner particle | | | 1 | 2 | 3 | 4 | 5 | 6 |
| Monomer | Styrene | mass parts | 74.0 | 74.0 | 74.0 | 74.0 | 74.0 | 74.0 |
| | n-butyl acrylate | mass parts | 26.0 | 26.0 | 26.0 | 26.0 | 26.0 | 26.0 |
| | Silane | Silane1 | — | — | Tetra ethoxy silane | 3-methacryloxy propyl tri ethoxy silane | Methyl tri ethoxy silane | Methyl tri methoxy silane |
| | | Silane1 mass parts | — | — | 5.0 | 5.0 | 5.0 | 5.0 |
| | | Silane2 | — | — | — | — | — | — |
| | | Silane2 mass parts | — | — | — | — | — | — |

TABLE 7-continued

| | | | | | | | | |
|---|---|---|---|---|---|---|---|---|
| | | Silane3 | — | — | — | — | — | — |
| | | Silane3 mass parts | — | — | — | — | — | — |
| Solvent | Toluene | mass parts | 0.0 | 0.0 | 0.0 | 0.0 | 0.0 | 0.0 |
| Polyester resin | | Type | (1) | — | (1) | (1) | A(1) | A(2) |
| | | mass parts | 10.0 | — | 10.0 | 10.0 | 10.0 | 10.0 |
| Release agent | | Type | Fischer Tropsch wax | Fischer Tropsch wax | Fischer Tropsch wax | Fischer Tropsch wax | Fischer Tropsch wax | Fischer Tropsch wax |
| | | mass parts | 10.0 | 10.0 | 10.0 | 10.0 | 10.0 | 10.0 |
| | | Melting point (° C.) | 77.1 | 77.1 | 77.1 | 77.1 | 77.1 | 77.1 |
| | | Endo thermic quantity (J/g) | 209.6 | 209.6 | 209.6 | 209.6 | 209.6 | 209.6 |
| Colorant | | Colorant type | Copper phthalo cyanine | Copper phthalo cyanine | Copper phthalo cyanine | Copper phthalo cyanine | Copper phthalo cyanine | Copper phthalo cyanine |
| | | mass parts | 6.5 | 6.5 | 6.5 | 6.5 | 6.5 | 6.5 |
| Negative charge control agent | Charge control resin1 | mass parts | 0.4 | 0.4 | 0.4 | 0.4 | 0.4 | 0.4 |
| | Charge control agent1 | mass parts | 0.5 | 0.5 | 0.5 | 0.5 | 0.5 | 0.5 |
| Lipo soluble initiator | Type | | t-butyl peroxy pivalate | t-butyl peroxy pivalate | t-butyl peroxy pivalate | t-butyl peroxy pivalate | t-butyl peroxy pivalate | t-butyl peroxy pivalate |
| | Amt. added | mass parts | 16.0 | 16.0 | 16.0 | 16.0 | 16.0 | 16.0 |
| Polymerization conditions | Reaction1 | Temp. | 70 | 70 | 70 | 70 | 70 | 70 |
| | | Holding time (hr) | 4 h | 4 h | 4 h | 4 h | 4 h | 4 h |
| | | pH | 5.1 | 5.1 | 5.1 | 5.1 | 5.1 | 5.1 |
| | Reaction2 | Temp. | 90 | 90 | 90 | 90 | 90 | 90 |
| | | Holding time (hr) | 1.5 h | 1.5 h | 1.5 h | 1.5 h | 1.5 h | 1.5 h |
| | | pH | 8.0 | 8.0 | 8.0 | 8.0 | 8.0 | 8.0 |
| | Reaction3 | Temp. | 100 | 100 | 100 | 100 | 100 | 100 |
| | | Holding time (hr) | 5 h | 5 h | 5 h | 5 h | 5 h | 5 h |
| | | pH | 5.1 | 5.1 | 5.1 | 5.1 | 5.1 | 5.1 |
| | Reaction4 | Temp. | 65 | 65 | 65 | 65 | 65 | 65 |
| | | Holding time (hr) | 2 h | 2 h | 2 h | 2 h | 2 h | 2 h |
| | | pH | 5.1 | 5.1 | 5.1 | 5.1 | 5.1 | 5.1 |

| | | | Comparative Example | | | | | |
|---|---|---|---|---|---|---|---|---|
| | | | 7 | 8 | 9 | 10 | 11 | 12 |
| Comparative toner particle | | | 7 | 8 | 9 | 10 | 11 | 12 |
| Monomer | Styrene | mass parts | 74.0 | 74.0 | 74.0 | 74.0 | 74.0 | 74.0 |
| | n-butyl acrylate | mass parts | 26.0 | 26.0 | 26.0 | 26.0 | 26.0 | 26.0 |
| | Silane | Silane1 | — | — | — | n-butyl tri-t-butoxy silane | Methyl tri ethoxy silane | Methyl tri ethoxy silane |
| | | Silane1 mass parts | — | — | — | 2.5 | 5.0 | 5.0 |
| | | Silane2 | — | — | — | — | — | — |
| | | Silane2 mass parts | — | — | — | — | — | — |
| | | Silane3 | — | — | — | — | — | — |
| | | Silane3 mass parts | — | — | — | — | — | — |
| Solvent | Toluene | mass parts | 0.0 | 0.0 | 0.0 | 0.0 | 0.0 | 0.0 |
| Polyester resin | | Type | (9) | (10) | A(3) | A(3) | A(6) | A(7) |
| | | mass parts | 10.0 | 10.0 | 10.0 | 10.0 | 10.0 | 10.0 |
| Release agent | | Type | Fischer Tropsch wax | Fischer Tropsch wax | Fischer Tropsch wax | Fischer Tropsch wax | Fischer Tropsch wax | Fischer Tropsch wax |
| | | mass parts | 10.0 | 10.0 | 10.0 | 10.0 | 10.0 | 10.0 |
| | | Melting point (° C.) | 77.1 | 77.1 | 77.1 | 77.1 | 77.1 | 77.1 |
| | | Endo thermic quantity (J/g) | 209.6 | 209.6 | 209.6 | 209.6 | 209.6 | 209.6 |
| Colorant | | Colorant type | Copper phthalo cyanine | Copper phthalo cyanine | Copper phthalo cyanine | Copper phthalo cyanine | Copper phthalo cyanine | Copper phthalo cyanine |
| | | mass parts | 6.5 | 6.5 | 6.5 | 6.5 | 6.5 | 6.5 |

TABLE 7-continued

| | | | | | | | | |
|---|---|---|---|---|---|---|---|---|
| Negative charge control agent | Charge control resin1 | mass parts | 0.4 | 0.4 | 0.4 | 0.4 | 0.4 | 0.4 |
| | Charge control agent1 | mass parts | 0.5 | 0.5 | 0.5 | 0.5 | 0.5 | 0.5 |
| Lipo soluble initiator | Type | | t-butyl peroxy pivalate | t-butyl peroxy pivalate | t-butyl peroxy pivalate | t-butyl peroxy pivalate | t-butyl peroxy pivalate | t-butyl peroxy pivalate |
| | Amt. added | mass parts | 16.0 | 16.0 | 16.0 | 16.0 | 16.0 | 16.0 |
| Polymerization conditions | Reaction1 | Temp. | 70 | 70 | 70 | 70 | 70 | 70 |
| | | Holding time (hr) | 4 h | 4 h | 4 h | 4 h | 4 h | 4 h |
| | | pH | 5.1 | 5.1 | 5.1 | 5.1 | 5.1 | 5.1 |
| | Reaction2 | Temp. | 90 | 90 | 90 | 90 | 90 | 90 |
| | | Holding time (hr) | 1.5 h | 1.5 h | 1.5 h | 1.5 h | 1.5 h | 1.5 h |
| | | pH | 8.0 | 8.0 | 8.0 | 8.0 | 8.0 | 8.0 |
| | Reaction3 | Temp. | 100 | 100 | 100 | 100 | 100 | 100 |
| | | Holding time (hr) | 5 h | 5 h | 5 h | 5 h | 5 h | 5 h |
| | | pH | 5.1 | 5.1 | 5.1 | 5.1 | 5.1 | 5.1 |
| | Reaction4 | Temp. | 65 | 65 | 65 | 65 | 65 | 65 |
| | | Holding time (hr) | 2 h | 2 h | 2 h | 2 h | 2 h | 2 h |
| | | pH | 5.1 | 5.1 | 5.1 | 5.1 | 5.1 | 5.1 |

TABLE 8

| | | Example | | | | | | | | | |
|---|---|---|---|---|---|---|---|---|---|---|---|
| | | 1 | 2 | 3 | 4 | 5 | 6 | 7 | 8 | 9 | 10 |
| | Toner Particle | 1 | 2 | 3 | 4 | 5 | 6 | 7 | 8 | 9 | 10 |
| Toner Physical Properties | THF-insoluble matter (%) | 0.9 | 9.4 | 1.2 | 1.2 | 1.3 | 29.7 | 1.3 | 1.4 | 1.2 | 1.3 |
| | Average circularity | 0.980 | 0.976 | 0.983 | 0.982 | 0.982 | 0.981 | 0.983 | 0.982 | 0.982 | 0.981 |
| | Mode circularity | 1.00 | 1.00 | 1.00 | 1.00 | 1.00 | 1.00 | 1.00 | 1.00 | 1.00 | 1.00 |
| | Toner particle weight-average molecular weight | 24000 | 24100 | 24300 | 24300 | 24500 | 27800 | 23900 | 25100 | 22100 | 24700 |
| | Toner particle weight average molecular weight/number average molecular weight | 8.1 | 8.6 | 8.4 | 8.6 | 8.1 | 12.1 | 8.2 | 8.3 | 8.1 | 8.4 |
| | Circle-equivalent diameter Dtem (μm) | 5.6 | 5.7 | 5.7 | 5.7 | 5.7 | 5.7 | 5.7 | 5.7 | 5.7 | 5.8 |
| | Weight-average particle diameter (μm) | 5.6 | 5.6 | 5.6 | 5.6 | 5.6 | 5.7 | 5.6 | 5.6 | 5.6 | 5.6 |
| | Number-average particle diameter (μm) | 5.3 | 5.3 | 5.3 | 5.3 | 5.3 | 5.3 | 5.3 | 5.3 | 5.3 | 5.3 |
| | Endothermic main peak temperature (° C.) | 74.2 | 74.2 | 74.2 | 74.2 | 74.2 | 74.2 | 74.2 | 74.2 | 74.2 | 74.2 |
| | Calorimetric integral value (J/g) | 26.2 | 26.0 | 25.8 | 25.9 | 26.1 | 26.2 | 26.4 | 26.1 | 25.8 | 26.4 |
| | Glass transition temperature (° C.) | 49.7 | 50.4 | 51.2 | 52.0 | 52.2 | 48.6 | 51.7 | 49.9 | 50.1 | 50.2 |
| | Flow tester 80° C. viscosity (Pa · s) | 13800 | 18400 | 16200 | 16200 | 16300 | 17500 | 15600 | 15300 | 13400 | 13600 |

TABLE 9

| | | Example | | | | | | | | | |
|---|---|---|---|---|---|---|---|---|---|---|---|
| | | 11 | 12 | 13 | 14 | 15 | 16 | 17 | 18 | 19 | 20 |
| | Toner Particle | 11 | 12 | 13 | 14 | 15 | 16 | 17 | 18 | 19 | 20 |
| Toner Physical Properties | THF-insoluble matter (%) | 1.3 | 1.2 | 1.1 | 1.3 | 1.3 | 1.2 | 1.3 | 1.2 | 1.2 | 1.4 |
| | Average circularity | 0.982 | 0.982 | 0.978 | 0.981 | 0.982 | 0.980 | 0.981 | 0.981 | 0.981 | 0.982 |

TABLE 9-continued

| | Example | | | | | | | | | |
|---|---|---|---|---|---|---|---|---|---|---|
| | 11 | 12 | 13 | 14 | 15 | 16 | 17 | 18 | 19 | 20 |
| Mode circularity | 1.00 | 1.00 | 1.00 | 1.00 | 1.00 | 1.00 | 1.00 | 1.00 | 1.00 | 1.00 |
| Toner particle weight-average molecular weight | 24500 | 22800 | 23800 | 24000 | 26100 | 23900 | 25200 | 23200 | 24100 | 23100 |
| Toner particle weight average molecular weight/number average molecular weight | 8.6 | 8.1 | 8.4 | 8.3 | 8.1 | 8.3 | 8.2 | 8.4 | 8.0 | 8.2 |
| Circle-equivalent diameter Dtem (μm) | 5.7 | 5.7 | 5.6 | 5.7 | 5.7 | 5.7 | 5.7 | 5.7 | 5.7 | 5.7 |
| Weight-average particle diameter (μm) | 5.6 | 5.7 | 5.5 | 5.7 | 5.6 | 5.7 | 5.7 | 5.6 | 5.6 | 5.6 |
| Number-average particle diameter (μm) | 5.3 | 5.3 | 5.3 | 5.3 | 5.3 | 5.3 | 5.3 | 5.3 | 5.3 | 5.4 |
| Endothermic main peak temperature (° C.) | 74.2 | 74.2 | 74.2 | 74.2 | 74.2 | 74.2 | 74.2 | 74.2 | 74.2 | 74.2 |
| Calorimetric integral value (J/g) | 25.8 | 25.6 | 26.1 | 25.9 | 25.8 | 47.6 | 22.4 | 26.1 | 26.0 | 26.1 |
| Glass transition temperature (° C.) | 50.1 | 50.2 | 48.6 | 50.3 | 50.2 | 50.4 | 50.6 | 50.8 | 50.2 | 50.3 |
| Flow tester 80° C. viscosity (Pa · s) | 13900 | 15400 | 14600 | 13900 | 23000 | 8900 | 16400 | 16200 | 16400 | 15200 |

TABLE 10

| | | Example | | | | | |
|---|---|---|---|---|---|---|---|
| | | 21 | 22 | 23 | 24 | 25 | 26 |
| | | Toner Particle | | | | | |
| | | 21 | 22 | 23 | 24 | 25 | 26 |
| Toner Physical Properties | THF-insoluble matter (%) | 1.5 | 1.2 | 1.0 | 1.1 | 1.1 | 1.1 |
| | Average circularity | 0.982 | 0.981 | 0.981 | 0.982 | 0.982 | 0.973 |
| | Mode circularity | 1.00 | 1.00 | 1.00 | 1.00 | 1.00 | 0.98 |
| | Toner particle weight-average molecular weight | 22600 | 23100 | 23400 | 23900 | 23900 | 13100 |
| | Toner particle weight average molecular weight/number average molecular weight | 8.1 | 8.2 | 8.4 | 8.4 | 8.4 | 8.6 |
| | Circle-equivalent diameter Dtem(μm) | 5.6 | 5.7 | 5.7 | 5.7 | 5.7 | 5.6 |
| | Weight-average particle diameter (μm) | 5.6 | 5.7 | 5.6 | 5.6 | 5.6 | 5.6 |
| | Number-average particle diameter (μm) | 5.4 | 5.3 | 5.3 | 5.3 | 5.3 | 5.3 |
| | Endothermic main peak temperature (° C.) | 74.2 | 74.2 | 74.2 | 74.2 | 74.2 | 74.2 |
| | Calorimetric integral value (J/g) | 26.3 | 26.1 | 26.0 | 26.0 | 25.9 | 26.3 |
| | Glass transition temperature (° C.) | 50.1 | 50.3 | 50.1 | 50.1 | 50.4 | 50.1 |
| | Flow tester 80° C. viscosity (Pa · s) | 15300 | 15600 | 15300 | 15200 | 15300 | 12400 |

TABLE 10-continued

| | | | Example | | | |
|---|---|---|---|---|---|---|
| | | | 27 | 28 | 29 | 30 |
| | | | Toner Particle | | | |
| | | | 27 | 28 | 29 | 30 |
| Toner Physical Properties | | THF-insoluble matter (%) | 1.2 | 0.8 | 1.1 | 1.1 |
| | | Average circularity | 0.971 | 0.964 | 0.981 | 0.980 |
| | | Mode circularity | 0.98 | 0.97 | 1.00 | 1.00 |
| | | Toner particle weight-average molecular weight | 13200 | 52200 | 34000 | 19300 |
| | | Toner particle weight average molecular weight/number average molecular weight | 8.1 | 8.0 | 8.3 | 8.1 |
| | | Circle-equivalent diameter Dtem(μm) | 5.6 | 5.7 | 5.7 | 5.6 |
| | | Weight-average particle diameter (μm) | 5.6 | 5.6 | 5.6 | 5.6 |
| | | Number-average particle diameter (μm) | 5.3 | 5.3 | 5.4 | 5.3 |
| | | Endothermic main peak temperature (° C.) | 74.2 | 74.2 | 74.2 | 74.2 |
| | | Calorimetric integral value (J/g) | 26.4 | 25.6 | 25.8 | 25.9 |
| | | Glass transition temperature (° C.) | 50.3 | 50.2 | 50.1 | 50.3 |
| | Flow tester | 80° C. viscosity (Pa · s) | 22900 | 15300 | 15300 | 15600 |

TABLE 11

| | | Example | | | | |
|---|---|---|---|---|---|---|
| | | 31 | 32 | 33 | 34 | 35 |
| | | Toner Particle | | | | |
| | | 31 | 32 | 33 | 34 | 35 |
| Toner Physical Properties | THF-insoluble matter (%) | 1.0 | 1.1 | 1.0 | 1.1 | 0.9 |
| | Average circularity | 0.980 | 0.980 | 0.980 | 0.978 | 0.980 |
| | Mode circularity | 1.00 | 1.00 | 1.00 | 1.00 | 1.00 |
| | Toner particle weight-average molecular weight | 29800 | 28200 | 22300 | 23500 | 24000 |
| | Toner particle weight average molecular weight/number average molecular weight | 8.1 | 8.2 | 8.3 | 8.2 | 8.1 |
| | Circle-equivalent diameter Dtem(μm) | 5.6 | 5.7 | 5.7 | 5.6 | 5.6 |
| | Weight-average particle diameter (μm) | 5.6 | 5.6 | 5.6 | 5.6 | 5.6 |
| | Number-average particle diameter (μm) | 5.4 | 5.4 | 5.3 | 5.3 | 5.3 |
| | Endothermic main peak temperature (° C.) | 74.2 | 74.2 | 74.2 | 74.2 | 74.2 |
| | Calorimetric integral value (J/g) | 25.4 | 25.3 | 25.6 | 22.4 | 21.2 |
| | Glass transition temperature (° C.) | 50.1 | 50.2 | 50.2 | 51.4 | 52.2 |
| | Flow tester 80° C. viscosity (Pa · s) | 15400 | 17200 | 14900 | 13400 | 13600 |

TABLE 12

| | | Comparative Example | | | | | | |
|---|---|---|---|---|---|---|---|---|
| | | 1 | 2 | 3 | 4 | 5 | 6 | 7 |
| | | Comparative toner particle | | | | | | |
| | | 1 | 2 | 3 | 4 | 5 | 6 | 7 |
| Toner Physical Properties | THF-insoluble matter (%) | 1.2 | 1.2 | 1.2 | 1.5 | 1.4 | 1.1 | 1.3 |
| | Average circularity | 0.975 | 0.976 | 0.976 | 0.977 | 0.982 | 0.980 | 0.981 |
| | Mode circularity | 1.00 | 1.00 | 1.00 | 1.00 | 1.00 | 1.00 | 1.00 |
| | Toner particle weight-average molecular weight | 22300 | 24100 | 22100 | 23200 | 23100 | 23100 | 24000 |
| | Toner particle weight average molecular weight/number average molecular weight | 8.2 | 8.2 | 8.1 | 11.0 | 8.1 | 8.0 | 8.0 |
| | Circle-equivalent diameter Dtem(μm) | 5.7 | 5.7 | 5.7 | 5.7 | 5.7 | 5.7 | 5.7 |
| | Weight-average particle diameter (μm) | 5.7 | 5.7 | 5.7 | 5.7 | 5.7 | 5.7 | 5.7 |
| | Number-average particle diameter (μm) | 5.3 | 5.3 | 5.3 | 5.4 | 5.3 | 5.4 | 5.3 |
| | Endothermic main peak temperature (° C.) | 74.2 | 74.2 | 74.2 | 74.2 | 74.2 | 74.2 | 74.2 |
| | Calorimetric integral value (J/g) | 24.6 | 24.3 | 24.3 | 24.2 | 24.1 | 24.6 | 24.5 |
| | Glass transition temperature (° C.) | 50.4 | 50.2 | 50.3 | 50.3 | 50.1 | 50.1 | 50.2 |
| | Flow tester 80° C. viscosity (Pa · s) | 16100 | 18200 | 17200 | 24200 | 16200 | 16200 | 16200 |

| | | Comparative Example | | | | |
|---|---|---|---|---|---|---|
| | | 8 | 9 | 10 | 11 | 12 |
| | | Comparative toner particle | | | | |
| | | 8 | 9 | 10 | 11 | 12 |
| Toner Physical Properties | THF-insoluble matter (%) | 1.4 | 1.2 | 1.1 | 1.0 | 0.9 |
| | Average circularity | 0.977 | 0.980 | 0.980 | 0.981 | 0.980 |
| | Mode circularity | 1.00 | 1.00 | 1.00 | 1.00 | 1.00 |
| | Toner particle weight-average molecular weight | 23800 | 23600 | 21900 | 23600 | 24000 |
| | Toner particle weight average molecular weight/number average molecular weight | 8.1 | 8.1 | 8.0 | 8.1 | 8.2 |
| | Circle-equivalent diameter Dtem(μm) | 5.7 | 5.7 | 5.7 | 5.6 | 5.6 |
| | Weight-average particle diameter (μm) | 5.7 | 5.6 | 5.7 | 5.6 | 5.6 |
| | Number-average particle diameter (μm) | 5.3 | 5.3 | 5.3 | 5.3 | 5.3 |
| | Endothermic main peak temperature (° C.) | 74.2 | 74.2 | 74.1 | 74.2 | 74.2 |
| | Calorimetric integral value (J/g) | 24.2 | 24.3 | 24.2 | 20.4 | 20.8 |
| | Glass transition temperature (° C.) | 50.3 | 50.1 | 50.1 | 52.3 | 53.1 |
| | Flow tester 80° C. viscosity (Pa · s) | 16300 | 16200 | 16400 | 13600 | 13800 |

TABLE 13

| | | Toner | | | | | |
|---|---|---|---|---|---|---|---|
| | | 1 | 2 | 3 | 4 | 5 | 6 |
| Formula (T3) | Formula (T3) structure | present | present | present | present | present | present |
| | ST3 % | 69.0 | 41.2 | 58.1 | 50.1 | 40.3 | 42.4 |
| | No. of carbons of Rf in formula (T3) | 1 | 6 | 2 | 3 | 4 | 1 |

TABLE 13-continued

| | | | | | | | | |
|---|---|---|---|---|---|---|---|---|
| | R2, R3, R4 of formula (Z) | | Ethoxy group | Methoxy group | Ethoxy group | Ethoxy group | Ethoxy group | Chloro group, ethoxy group |
| Polyester resin | Polyester type | | (1) | (1) | (1) | (1) | (1) | (1) |
| | Alcohol component 1 | | Aliphatic | Aliphatic | Aliphatic | Aliphatic | Aliphatic | Aliphatic |
| | | No. of carbons | 6 | 6 | 6 | 6 | 6 | 6 |
| | | mol % | 100 | 100 | 100 | 100 | 100 | 100 |
| | Alcohol component 2 | | — | — | — | — | — | — |
| | | No. of carbons | — | — | — | — | — | — |
| | | mol % | — | — | — | — | — | — |
| | Carboxylic acid component 1 | | Aliphatic | Aliphatic | Aliphatic | Aliphatic | Aliphatic | Aliphatic |
| | | No. of carbons | 6 | 6 | 6 | 6 | 6 | 6 |
| | | mol % | 98 | 98 | 98 | 98 | 98 | 98 |
| | Carboxylic acid component 2 | | — | — | — | — | — | — |
| | | | — | — | — | — | — | — |
| | | | — | — | — | — | — | — |
| | Polyester melting point | ° C. | 59.8 | 59.8 | 59.8 | 59.8 | 59.8 | 59.8 |
| | Amt. of unsaturated dicarboxylic acid in aliphatic dicarboxylic acid | mol % | 0.0 | 0.0 | 0.0 | 0.0 | 0.0 | 0.0 |
| Polyester resin A | Polyester type | | — | — | — | — | — | — |
| Amt. of surface layer silicon | dSi/[dC + dO + dSi + dS] | atom % | 20.4 | 5.4 | 14.8 | 12.4 | 10.3 | 16.4 |
| | dSi/dC | | 1.15 | 0.91 | 1.05 | 1.02 | 0.91 | 1.02 |
| | Average thickness of toner particle surface layer Dav. | nm | 13.2 | 5.1 | 9.8 | 7.4 | 5.2 | 13.0 |
| Production method No. | | | 1 | 1 | 1 | 1 | 1 | 1 |

| | | | | Toner | | | |
|---|---|---|---|---|---|---|---|
| | | | | 7 | 8 | 9 | 10 |
| | Formula (T3) | Formula (T3) structure | | present | present | present | present |
| | | ST3 | % | 68.2 | 70.1 | 68.4 | 68.3 |
| | | No. of carbons of Rf in formula (T3) | | 1 | 1 | 1 | 1 |
| | | R2, R3, R4 of formula (Z) | | Methoxy group | Chloro group, ethoxy group | Ethoxy group | Ethoxy group |
| | Polyester resin | Polyester type | | (1) | (1) | (1) | (1) |
| | | Alcohol component 1 | | Aliphatic | Aliphatic | Aliphatic | Aliphatic |
| | | | No. of carbons | 6 | 6 | 6 | 6 |
| | | | mol % | 100 | 100 | 100 | 100 |
| | | Alcohol component 2 | | — | — | — | — |
| | | | No. of carbons | — | — | — | — |
| | | | mol % | — | — | — | — |
| | | Carboxylic acid component 1 | | Aliphatic | Aliphatic | Aliphatic | Aliphatic |
| | | | No. of carbons | 6 | 6 | 6 | 6 |
| | | | mol % | 98 | 98 | 98 | 98 |
| | | Carboxylic acid component 2 | | — | — | — | — |
| | | | | — | — | — | — |
| | | | | — | — | — | — |
| | | Polyester melting point | ° C. | 59.8 | 59.8 | 59.8 | 59.8 |
| | | Amt. of unsaturated dicarboxylic acid in aliphatic dicarboxylic acid | mol % | 0.0 | 0.0 | 0.0 | 0.0 |

TABLE 13-continued

| | | | | | | |
|---|---|---|---|---|---|---|
| Polyester resin A | Polyester type | | — | — | — | — |
| Amt. of surface layer silicon | dSi/[dC + dO + dSi + dS] | atom % | 19.8 | 19.7 | 23.7 | 7.3 |
| | dSi/dC | | 1.03 | 1.01 | 1.12 | 0.41 |
| | Average thickness of toner particle surface layer Dav. | nm | 12.8 | 12.6 | 43.5 | 5.6 |
| Production method No. | | | 1 | 1 | 1 | 1 |

TABLE 14

| | | | Toner | | | | | |
|---|---|---|---|---|---|---|---|---|
| | | | 11 | 12 | 13 | 14 | 15 | 16 |
| Formula (T3) | Formula (T3) structure | | present | present | present | present | present | present |
| | ST3 | % | 68.3 | 67.4 | 7.3 | 40.2 | 68.4 | 67.2 |
| | No. of carbons of Rf in formula (T3) | | 1 | 1 | 1 | 1 | 1 | 1 |
| | R2, R3, R4 of formula (Z) | | Ethoxy group | Ethoxy group | Ethoxy group | Ethoxy group | Ethoxy group | Ethoxy group |
| Polyester resin | Polyester type | | (1) | (1) | (1) | (1) | (2) | (1) |
| | Alcohol component 1 | | Aliphatic | Aliphatic | Aliphatic | Aliphatic | Aliphatic | Aliphatic |
| | | No. of carbons | 6 | 6 | 6 | 6 | 6 | 6 |
| | | mol % | 100 | 100 | 100 | 100 | 105 | 100 |
| | Alcohol component 2 | | — | — | — | — | — | — |
| | | No. of carbons | — | — | — | — | — | — |
| | | mol % | — | — | — | — | — | — |
| | Carboxylic acid component 1 | | Aliphatic | Aliphatic | Aliphatic | Aliphatic | Aliphatic | Aliphatic |
| | | No. of carbons | 6 | 6 | 6 | 6 | 6 | 6 |
| | | mol % | 98 | 98 | 98 | 98 | 100 | 98 |
| | Carboxylic acid component 2 | | — | — | — | — | — | — |
| | | | — | — | — | — | — | — |
| | | | — | — | — | — | — | — |
| | Polyester melting point | ° C. | 59.8 | 59.8 | 59.8 | 59.8 | 60.5 | 59.8 |
| | Amt. of unsaturated dicarboxylic acid in aliphatic dicarboxylic acid | mol % | 0.0 | 0.0 | 0.0 | 0.0 | 0.0 | 0.0 |
| Polyester resin A | Polyester type | | — | — | — | — | — | — |
| Amt. of surface layer silicon | dSi/[dC + dO + dSi + dS] | atom % | 4.3 | 19.8 | 16.2 | 19.7 | 19.7 | 18.4 |
| | dSi/dC | | 0.31 | 1.01 | 0.92 | 0.63 | 1.01 | 1.01 |
| | Average thickness of toner particle surface layer Dav. | nm | 3.4 | 12.4 | 8.7 | 12.9 | 12.8 | 13.1 |
| Production method No. | | | 1 | 1 | 1 | 1 | 1 | 1 |

| | | | | Toner | | | |
|---|---|---|---|---|---|---|---|
| | | | | 17 | 18 | 19 | 20 |
| Formula (T3) | Formula (T3) structure | | | present | present | present | present |
| | ST3 | % | | 68.7 | 67.4 | 68.2 | 67.1 |
| | No. of carbons of Rf in formula (T3) | | | 1 | 1 | 1 | 1 |
| | R2, R3, R4 of formula (Z) | | | Ethoxy group | Ethoxy group | Ethoxy group | Ethoxy group |

TABLE 14-continued

| | | | | | | | |
|---|---|---|---|---|---|---|---|
| | Polyester resin | Polyester type | | (1) | (3) | (4) | (5) |
| | | Alcohol component 1 | | Aliphatic | Aliphatic | Aliphatic | Aliphatic |
| | | | No. of carbons | 6 | 16 | 16 | 3 |
| | | | mol % | 100 | 100 | 100 | 100 |
| | | Alcohol component 2 | | — | — | — | — |
| | | | No. of carbons | — | — | — | — |
| | | | mol % | — | — | — | — |
| | | Carboxylic acid component 1 | | Aliphatic | Aliphatic | Aliphatic | Aliphatic |
| | | | No. of carbons | 6 | 16 | 4 | 4 |
| | | | mol % | 98 | 98 | 98 | 98 |
| | | Carboxylic acid component 2 | | — | — | — | — |
| | | | | — | — | — | — |
| | | | | — | — | — | — |
| | | Polyester melting point | ° C. | 59.8 | 82.3 | 72.4 | 28.4 |
| | | Amt. of unsaturated dicarboxylic acid in aliphatic dicarboxylic acid | mol % | 0.0 | 0.0 | 0.0 | 0.0 |
| | Polyester resin A | Polyester type | | — | — | — | — |
| | Amt. of surface layer silicon | dSi/[dC + dO + dSi + dS] | atom % | 20.3 | 20.4 | 21.2 | 23.4 |
| | | dSi/dC | | 1.02 | 1.01 | 0.99 | 1.01 |
| | | Average thickness of toner particle surface layer Dav. | nm | 13.2 | 12.8 | 12.3 | 12.9 |
| | Production method No. | | | 1 | 1 | 1 | 1 |

TABLE 15

| | | | Toner | | | | | |
|---|---|---|---|---|---|---|---|---|
| | | | 21 | 22 | 23 | 24 | 25 | 26 |
| Formula (T3) | Formula (T3) structure | | present | present | present | present | present | present |
| | ST3 | % | 68.1 | 68.2 | 67.2 | 68.3 | 68.1 | 69.1 |
| | No. of carbons of Rf in formula (T3) | | 1 | 1 | 1 | 1 | 1 | 1 |
| | R2, R3, R4 of formula (Z) | | Ethoxy group | Ethoxy group | Ethoxy group | Ethoxy group | Ethoxy group | Ethoxy group |
| Polyester resin | Polyester type | | (6) | (7) | (8) | (9) | (10) | (1) |
| | Alcohol component 1 | | Aliphatic | Aliphatic | Aliphatic | Aliphatic | Aliphatic | Aliphatic |
| | | No. of carbons | 3 | 6 | 3 | 16 | 6 | 6 |
| | | mol % | 100 | 100 | 100 | 100 | 100 | 100 |
| | Alcohol component 2 | | — | — | — | — | — | — |
| | | No. of carbons | — | — | — | — | — | — |
| | | mol % | — | — | — | — | — | — |
| | Carboxylic acid component 1 | | Aliphatic | Aliphatic | Unsaturated aliphatic | Aromatic | Aliphatic | Aliphatic |
| | | No. of carbons | 16 | 6 | 4 | 8 | 10 | 6 |
| | | mol % | 98 | 98 | 48 | 98 | 98 | 98 |
| | Carboxylic acid component 2 | | — | Trimellitic acid | Succinic acid | — | — | — |
| | | | — | 9 | 4 | — | — | — |
| | | | — | 1 | 50 | — | — | — |
| | Polyester melting point | ° C. | 53.2 | 90.4 | 64.1 | 98.0 | 63.9 | 59.8 |
| | Amt. of unsaturated dicarboxylic acid in aliphatic dicarboxylic acid | mol % | 0.0 | 0.0 | 49.0 | 0.0 | 0.0 | 0.0 |

TABLE 15-continued

| | | | | | | | | |
|---|---|---|---|---|---|---|---|---|
| Polyester resin A | Polyester type | | — | — | — | — | — | — |
| Amt. of surface layer silicon | dSi/[dC + dO + dSi + dS] | atom % | 23.2 | 18.2 | 23.3 | 23.4 | 23.4 | 18.9 |
| | dSi/dC | | 0.99 | 1.00 | 1.01 | 1.02 | 1.01 | 0.95 |
| | Average thickness of toner particle surface layer Dav. | nm | 12.4 | 12.6 | 12.7 | 12.4 | 12.3 | 10.4 |
| Production method No. | | | 1 | 1 | 1 | 1 | 1 | 2 |

| | | | | Toner | | | |
|---|---|---|---|---|---|---|---|
| | | | | 27 | 28 | 29 | 30 |
| Formula (T3) | Formula (T3) structure | | | present | present | present | present |
| | ST3 | | % | 68.2 | 68.1 | 68.2 | 68.1 |
| | No. of carbons of Rf in formula (T3) | | | 1 | 1 | 1 | 1 |
| | R2, R3, R4 of formula (Z) | | | Ethoxy group | Ethoxy group | Ethoxy group | Ethoxy group |
| Polyester resin | Polyester type | | | (1) | (1) | (1) | (1) |
| | Alcohol component 1 | | | Aliphatic | Aliphatic | Aliphatic | Aliphatic |
| | | No. of carbons | | 6 | 6 | 6 | 6 |
| | | | mol % | 100 | 100 | 100 | 100 |
| | Alcohol component 2 | | | — | — | — | — |
| | | No. of carbons | | — | — | — | — |
| | | | mol % | — | — | — | — |
| | Carboxylic acid component 1 | | | Aliphatic | Aliphatic | Aliphatic | Aliphatic |
| | | No. of carbons | | 6 | 6 | 6 | 6 |
| | | | mol % | 98 | 98 | 98 | 98 |
| | Carboxylic acid component 2 | | | — | — | — | — |
| | | | | — | — | — | — |
| | | | | — | — | — | — |
| | Polyester melting point | | ° C. | 59.8 | 59.8 | 59.8 | 59.8 |
| | Amt. of unsaturated dicarboxylic acid in aliphatic dicarboxylic acid | | mol % | 0.0 | 0.0 | 0.0 | 0.0 |
| Polyester resin A | Polyester type | | | — | — | — | — |
| Amt. of surface layer silicon | dSi/[dC + dO + dSi + dS] | | atom % | 19.4 | 19.3 | 2.4 | 23.1 |
| | dSi/dC | | | 0.93 | 0.94 | 0.94 | 1.01 |
| | Average thickness of toner particle surface layer Dav. | | nm | 10.2 | 10.1 | 9.8 | 12.8 |
| Production method No. | | | | 3 | 4 | 5 | 1 |

TABLE 16

| | | | Toner | | | | |
|---|---|---|---|---|---|---|---|
| | | | 31 | 32 | 33 | 34 | 35 |
| Formula (T3) | Formula (T3) structure | | present | present | present | present | present |
| | ST3 | % | 69.3 | 70.1 | 67.2 | 69.1 | 69.2 |
| | No. of carbons of Rf in formula (T3) | | 1 | 1 | 1 | 1 | 1 |
| | R2, R3, R4 of formula (Z) | | Ethoxy group | Ethoxy group | Ethoxy group | Ethoxy group | Ethoxy group |

TABLE 16-continued

| | | | Toner | | | | |
|---|---|---|---|---|---|---|---|
| | | | 31 | 32 | 33 | 34 | 35 |
| Polyester resin | Polyester type | | (1) | (1) | (1) | (11) | (12) |
| | Alcohol component 1 | | Aliphatic | Aliphatic | Aliphatic | Aliphatic | Aromatic |
| | | No. of carbons | 6 | 6 | 6 | 6 | 21 |
| | | mol % | 100 | 100 | 100 | 55 | 100 |
| | Alcohol component 2 | | — | — | — | Aromatic | — |
| | | No. of carbons | — | — | — | 21 | — |
| | | mol % | — | — | — | 45 | — |
| | Carboxylic acid component 1 | | Aliphatic | Aliphatic | Aliphatic | Aromatic | Aliphatic |
| | | No. of carbons | 6 | 6 | 6 | 8 | 10 |
| | | mol % | 98 | 98 | 98 | 98 | 50 |
| | Carboxylic acid component 2 | | — | — | — | — | Aromatic |
| | | | — | — | — | — | 8 |
| | | | — | — | — | — | 48 |
| | Polyester melting point | ° C. | 59.8 | 59.8 | 59.8 | 60.4 | 60.3 |
| | Amt. of unsaturated dicarboxylic acid in aliphatic dicarboxylic acid | mol % | 0.0 | 0.0 | 0.0 | 0.0 | 0.0 |
| Polyester resin A | Polyester type | | — | — | — | — | — |
| Amt. of surface layer silicon | dSi/[dC + dO + dSi + dS] | atom % | 22.4 | 22.9 | 22.6 | 18.4 | 18.2 |
| | dSi/dC | | 0.98 | 1.01 | 1.00 | 1.02 | 1.01 |
| | Average thickness of toner particle surface layer Dav. | nm | 13.1 | 12.9 | 12.8 | 20.4 | 20.3 |
| Production method No. | | | 1 | 1 | 1 | 1 | 1 |

TABLE 17

| | | | Comparative toner | | | | | | |
|---|---|---|---|---|---|---|---|---|---|
| | | | 1 | 2 | 3 | 4 | 5 | 6 | 7 |
| Formula (T3) | Formula (T3) structure | | Absent | Absent | Absent | Absent | present | present | Absent |
| | ST3 | % | — | — | — | — | 64.2 | 63.1 | — |
| | No. of carbons of Rf in formula (T3) | | — | — | — | — | 1 | 1 | — |
| | R2, R3, R4 of formula (Z) | | — | — | — | Ethoxy group | Ethoxy group | Methoxy group | — |
| Polyester resin | Polyester type | | (1) | — | (1) | (1) | — | — | (9) |
| | Alcohol component 1 | | Aliphatic | — | Aliphatic | Aliphatic | — | — | Aliphatic |
| | | No. of carbons | 6 | — | 6 | 6 | — | — | 16 |
| | | mol % | 100 | — | 100 | 100 | — | — | 100 |
| | Alcohol component 2 | | — | — | — | — | — | — | — |
| | | No. of carbons | — | — | — | — | — | — | — |
| | | mol % | — | — | — | — | — | — | — |
| | Carboxylic acid component 1 | | Aliphatic | — | Aliphatic | Aliphatic | — | — | Aromatic |
| | | No. of carbons | 6 | — | 6 | 6 | — | — | 8 |
| | | mol % | 98 | — | 98 | 98 | — | — | 98 |
| | Carboxylic acid component 2 | | — | — | — | — | — | — | — |
| | | | — | — | — | — | — | — | — |
| | | | — | — | — | — | — | — | — |
| | Polyester melting point | ° C. | 59.8 | — | 59.8 | 59.8 | — | — | 98.0 |
| | Amt. of unsaturated dicarboxylic acid in aliphatic dicarboxylic acid | mol % | 0.0 | — | 0.0 | 0.0 | — | — | 0.0 |

TABLE 17-continued

| | | | | | | | | | |
|---|---|---|---|---|---|---|---|---|---|
| Polyester resin A | Polyester type | | — | — | — | — | A(1) | A(2) | — |
| Amt. of surface layer silicon | dSi/[dC + dO + dSi + dS] | atom % | 0.0 | 0.0 | 3.5 | 1.2 | 18.2 | 18.3 | 0.0 |
| | dSi/dC | | 0.00 | 0.00 | 0.32 | 0.03 | 0.94 | 0.93 | 0.00 |
| | Average thickness of toner particle surface layer Dav. | nm | 0.0 | 0.0 | 2.5 | 2.3 | 12.3 | 12.5 | 2.2 |
| Production method No. | | | 1 | 1 | 1 | 1 | 1 | 1 | 1 |

| | | | | Comparative toner | | | | |
|---|---|---|---|---|---|---|---|---|
| | | | | 8 | 9 | 10 | 11 | 12 |
| Formula (T3) | Formula (T3) structure | | | Absent | Absent | present | present | present |
| | ST3 | | % | — | — | 3.2 | 68.4 | 68.8 |
| | No. of carbons of Rf in formula (T3) | | | — | — | 4 | 1 | 1 |
| | R2, R3, R4 of formula (Z) | | | | | t-butoxy group | Ethoxy group | Ethoxy group |
| Polyester resin | Polyester type | | | (10) | — | — | — | — |
| | Alcohol component 1 | | | Aliphatic | — | — | — | — |
| | | No. of carbons | | 6 | — | — | — | — |
| | | mol % | | 100 | — | — | — | — |
| | Alcohol component 2 | | | — | — | — | — | — |
| | | No. of carbons | | — | — | — | — | — |
| | | mol % | | — | — | — | — | — |
| | Carboxylic acid component 1 | | | Aliphatic | — | — | — | — |
| | | No. of carbons | | 10 | — | — | — | — |
| | | mol % | | 98 | — | — | — | — |
| | Carboxylic acid component 2 | | | — | — | — | — | — |
| | | | | — | — | — | — | — |
| | | | | — | — | — | — | — |
| | Polyester melting point | | ° C. | 63.9 | — | — | — | — |
| | Amt. of unsaturated dicarboxylic acid in aliphatic dicarboxylic acid | | mol % | 0.0 | — | — | — | — |
| Polyester resin A | Polyester type | | | — | A(3) | A(3) | A(6) | A(7) |
| Amt. of surface layer silicon | dSi/[dC + dO + dSi + dS] | | atom % | 0.0 | 0.0 | 3.1 | 19.4 | 19.8 |
| | dSi/dC | | | 0.00 | 0.00 | 0.81 | 0.93 | 0.92 |
| | Average thickness of toner particle surface layer Dav. | | nm | 2.2 | 4.7 | 1.3 | 26.4 | 24.2 |
| Production method No. | | | | 1 | 1 | 1 | 1 | 1 |

TABLE 18

| | | Example | | | | | |
|---|---|---|---|---|---|---|---|
| | | 1 | 2 | 3 | 4 | 5 | 6 |
| Toner | | 1 | 2 | 3 | 4 | 5 | 6 |
| Storage stability | Storability (50° C./15 days) | A | A | A | B | C | B |
| | Long-term storability (45° C./95%/3 months) | A | A | B | C | C | B |

TABLE 18-continued

| | | | | | | | | | | | | | | | |
|---|---|---|---|---|---|---|---|---|---|---|---|---|---|---|---|
| Environ-mental stability | NN | Initial | Tribo (mC/kg) | −39.4 | | −38.2 | | −37.0 | | −37.4 | | −37.0 | | −40.3 | |
| | | | NN Fogging | 0.2 | A | 0.4 | A | 0.4 | A | 0.5 | A | 0.6 | A | 0.3 | A |
| | | | Density | 1.50 | A | 1.47 | A | 1.47 | A | 1.46 | A | 1.45 | A | 1.49 | A |
| | | Durability after 15,000 prints | NN Fogging | 0.3 | A | 0.6 | A | 0.8 | A | 1.1 | B | 1.7 | C | 0.4 | A |
| | | | Density | 1.50 | A | 1.43 | B | 1.46 | A | 1.44 | B | 1.43 | B | 1.49 | A |
| | | | Member contami-nation | A | | A | | A | | A | | A | | A | |
| | LL | Initial | Tribo (mC/kg) | −42.4 | | −43.9 | | −45.1 | | −46.1 | | −46.8 | | −43.2 | |
| | | | LL Fogging | 0.3 | A | 0.5 | A | 0.9 | A | 1.2 | B | 1.6 | C | 0.4 | A |
| | | | Density | 1.50 | A | 1.43 | B | 1.47 | A | 1.40 | B | 1.42 | B | 1.49 | A |
| | | Durability after 15,000 prints | LL Fogging | 0.4 | A | 0.7 | A | 0.9 | A | 1.5 | C | 1.8 | C | 0.5 | A |
| | | | Density | 1.48 | A | 1.39 | C | 1.47 | A | 1.42 | B | 1.39 | C | 1.47 | A |
| | | | Member contami-nation | A | | A | | A | | A | | B | | A | |
| | HH | Initial | Tribo (mC/kg) | −39.2 | | −36.4 | | −33.0 | | −30.8 | | −30.1 | | −36.4 | |
| | | | HH Fogging | 0.3 | A | 0.6 | A | 0.9 | A | 1.3 | B | 1.6 | C | 0.6 | A |
| | | | Density | 1.47 | A | 1.42 | B | 1.41 | B | 1.40 | B | 1.39 | C | 1.49 | A |
| | | Durability after 15,000 prints | HH Fogging | 0.4 | A | 0.8 | A | 1.0 | B | 1.4 | B | 1.8 | C | 0.7 | A |
| | | | Density | 1.45 | A | 1.38 | C | 1.42 | B | 1.38 | C | 1.36 | C | 1.47 | A |
| | | | Member contami-nation | A | | A | | A | | A | | B | | A | |
| | After standing for 168 hours in harsh environ-ment SHH | Initial | Tribo (mC/kg) | −36.7 | | −34.2 | | −26.5 | | −25.3 | | −20.1 | | −34.6 | |
| | | | SHH Fogging | 0.4 | A | 0.8 | A | 1.0 | B | 1.6 | C | 1.9 | C | 0.6 | A |
| | | | Density | 1.46 | A | 1.41 | B | 1.39 | C | 1.39 | C | 1.36 | C | 1.45 | A |
| | | Durability after 15,000 prints | SHH Fogging | 0.5 | A | 1.0 | B | 1.0 | B | 1.8 | C | 1.9 | C | 0.7 | A |
| | | | Density | 1.44 | B | 1.32 | C | 1.39 | C | 1.34 | C | 1.34 | C | 1.43 | B |
| | | | Member contami-nation | A | | A | | A | | B | | C | | B | |
| Cold offset completion Temp. (° C.) | | | | 110 | | 110 | | 110 | | 110 | | 110 | | 110 | |

| | | | | | | | | | | | | | | | |
|---|---|---|---|---|---|---|---|---|---|---|---|---|---|---|---|
| | | | | | | | | Example | | | | | | | |
| | | | | | | | | 7 | | 8 | | 9 | | 10 | |
| | | | Toner | | | | | 7 | | 8 | | 9 | | 10 | |
| | | Storage stability | | | | Storability (50° C./15 days) | | A | | A | | A | | A | |
| | | | | | | Long-term storability (45° C./95%/3 months) | | A | | A | | A | | A | |
| | Environ-mental stability | NN | Initial | | | Tribo (mC/kg) | | −39.2 | | −38.4 | | −42.4 | | −34.2 | |
| | | | | | | NN Fogging | | 0.3 | A | 0.3 | A | 0.3 | A | 0.8 | A |
| | | | | | | Density | | 1.49 | A | 1.49 | A | 1.49 | A | 1.46 | A |
| | | | Durability after 15,000 prints | | | NN Fogging | | 0.3 | A | 0.4 | A | 0.4 | A | 1.0 | B |
| | | | | | | Density | | 1.49 | A | 1.47 | A | 1.47 | A | 1.42 | B |
| | | | | | | Member contami-nation | | A | | A | | A | | A | |
| | | LL | Initial | | | Tribo (mC/kg) | | −43.1 | | −42.8 | | −44.6 | | −36.7 | |
| | | | | | | LL Fogging | | 0.3 | A | 0.4 | A | 0.4 | A | 0.9 | A |
| | | | | | | Density | | 1.48 | A | 1.48 | A | 1.48 | A | 1.44 | B |

TABLE 18-continued

| | | | | | | | | | | | | | | |
|---|---|---|---|---|---|---|---|---|---|---|---|---|---|---|
| | | | Durability after 15,000 prints | LL Fogging | 0.3 | A | 0.5 | A | 0.6 | A | 1.1 | B |
| | | | | Density | 1.48 | A | 1.48 | A | 1.49 | A | 1.41 | B |
| | | | | Member contamination | A | | A | | A | | A | |
| | | HH | Initial | Tribo (mC/kg) | −38.1 | | −38.2 | | −41.3 | | −32.3 | |
| | | | | HH Fogging | 0.5 | A | 0.5 | A | 0.4 | A | 1.0 | B |
| | | | | Density | 1.48 | A | 1.48 | A | 1.49 | A | 1.42 | B |
| | | | Durability after 15,000 prints | HH Fogging | 0.7 | A | 0.7 | A | 0.6 | A | 1.2 | B |
| | | | | Density | 1.46 | A | 1.46 | A | 1.49 | A | 1.36 | C |
| | | | | Member contamination | A | | A | | A | | A | |
| | | After standing for 168 hours in harsh environment SHH | Initial | Tribo (mC/kg) | −36.8 | | −34.2 | | −38.9 | | −30.6 | |
| | | | | SHH Fogging | 0.7 | A | 1.0 | B | 0.5 | A | 1.2 | B |
| | | | | Density | 1.45 | A | 1.38 | C | 1.48 | A | 1.39 | C |
| | | | Durability after 15,000 prints | SHH Fogging | 0.8 | A | 1.1 | B | 0.6 | A | 1.4 | B |
| | | | | Density | 1.42 | B | 1.38 | C | 1.45 | A | 1.36 | C |
| | | | | Member contamination | A | | B | | A | | A | |
| Cold offset completion Temp. (° C.) | | | | | 110 | | 110 | | 120 | | 110 | |

TABLE 19

| | | | | Example | | | | | | | | | | | |
|---|---|---|---|---|---|---|---|---|---|---|---|---|---|---|---|
| | | | | 11 | | 12 | | 13 | | 14 | | 15 | | 16 | |
| Toner | | | | 11 | | 12 | | 13 | | 14 | | 15 | | 16 | |
| Storage stability | | | Storability (50° C./15 days) | C | | A | | C | | A | | A | | A | |
| | | | Long-term storability (45° C./95%/3 months) | C | | A | | C | | A | | A | | A | |
| Environmental stability | NN | Initial | Tribo (mC/kg) | −32.4 | | −40.1 | | −32.1 | | −39.8 | | −40.1 | | −38.4 | |
| | | | NN Fogging | 1.0 | B | 0.2 | A | 0.8 | A | 0.2 | A | 0.3 | A | 0.3 | A |
| | | | Density | 1.45 | A | 1.51 | A | 1.43 | B | 1.49 | A | 1.50 | A | 1.48 | A |
| | | Durability after 15,000 prints | NN Fogging | 1.1 | B | 0.3 | A | 0.9 | A | 0.3 | A | 0.4 | A | 0.5 | A |
| | | | Density | 1.41 | B | 1.51 | A | 1.40 | B | 1.49 | A | 1.50 | A | 1.45 | A |
| | | | Member contamination | A | | A | | A | | A | | A | | A | |
| | LL | Initial | Tribo (mC/kg) | −34.6 | | −42.3 | | −35.2 | | −40.4 | | −42.7 | | −43.5 | |
| | | | LL Fogging | 1.1 | B | 0.3 | A | 0.9 | A | 0.3 | A | 0.4 | A | 0.5 | A |
| | | | Density | 1.42 | B | 1.50 | A | 1.41 | B | 1.48 | A | 1.48 | A | 1.46 | A |
| | | Durability after 15,000 prints | LL Fogging | 1.2 | B | 0.4 | A | 1.1 | B | 0.3 | A | 0.4 | A | 0.7 | A |
| | | | Density | 1.38 | C | 1.48 | A | 1.39 | C | 1.48 | A | 1.48 | A | 1.42 | B |
| | | | Member contamination | A | | A | | A | | A | | A | | A | |
| | HH | Initial | Tribo (mC/kg) | −31.0 | | −38.7 | | −31.9 | | −39.0 | | −39.3 | | −39.0 | |
| | | | HH Fogging | 1.1 | B | 0.3 | A | 1.0 | B | 0.4 | A | 0.4 | A | 0.4 | A |
| | | | Density | 1.41 | B | 1.48 | A | 1.41 | B | 1.46 | A | 1.47 | A | 1.44 | B |
| | | Durability after 15,000 prints | HH Fogging | 1.2 | B | 0.4 | A | 1.1 | B | 0.4 | A | 0.4 | A | 0.6 | A |
| | | | Density | 1.38 | C | 1.46 | A | 1.38 | C | 1.46 | A | 1.47 | A | 1.42 | B |
| | | | Member contamination | A | | A | | A | | A | | A | | A | |

TABLE 19-continued

| | | | | | | | | | | | | | | | | | | | |
|---|---|---|---|---|---|---|---|---|---|---|---|---|---|---|---|---|---|---|---|
| After standing for 168 hours in harsh environment SHH | Initial | Tribo (mC/kg) | −28.8 | | −36.8 | | −29.6 | | −37.4 | | −37.4 | | −35.7 | |
| | | SHH Fogging | 1.4 | B | 0.4 | A | 1.2 | B | 0.7 | A | 0.6 | A | 0.6 | A |
| | | Density | 1.36 | C | 1.47 | A | 1.37 | C | 1.45 | A | 1.45 | A | 1.43 | B |
| | Durability after 15,000 prints | SHH Fogging | 1.6 | C | 0.5 | A | 1.4 | B | 0.7 | A | 0.6 | A | 0.8 | A |
| | | Density | 1.32 | C | 1.46 | A | 1.34 | C | 1.45 | A | 1.45 | A | 1.42 | B |
| | | Member contamination | B | | A | | B | | A | | A | | A | |
| Cold offset completion Temp. (° C.) | | | 110 | | 110 | | 110 | | 110 | | 110 | | 95 | |

| | | | | | Example | | | | | | | |
|---|---|---|---|---|---|---|---|---|---|---|---|---|
| | | | | | 17 | | 18 | | 19 | | 20 | |
| Toner | | | | | 17 | | 18 | | 19 | | 20 | |
| Storage stability | | | Storability (50° C./15 days) | | A | | A | | A | | A | |
| | | | Long-term storability (45° C./95%/3 months) | | A | | A | | A | | A | |
| Environmental stability | NN | Initial | Tribo (mC/kg) | | −40.3 | | −39.2 | | −39.0 | | −40.1 | |
| | | | NN Fogging | | 0.3 | A | 0.5 | A | 0.6 | A | 0.6 | A |
| | | | Density | | 1.50 | A | 1.47 | A | 1.46 | A | 1.50 | A |
| | | Durability after 15,000 prints | NN Fogging | | 0.3 | A | 0.6 | A | 0.7 | A | 0.7 | A |
| | | | Density | | 1.49 | A | 1.45 | A | 1.45 | A | 1.49 | A |
| | | | Member contamination | | A | | A | | A | | A | |
| | LL | Initial | Tribo (mC/kg) | | −41.3 | | −40.9 | | −42.6 | | −43.2 | |
| | | | LL Fogging | | 0.4 | A | 0.6 | A | 0.7 | A | 0.8 | A |
| | | | Density | | 1.49 | A | 1.44 | B | 1.42 | B | 1.43 | B |
| | | Durability after 15,000 prints | LL Fogging | | 0.4 | A | 0.7 | A | 0.8 | A | 1.0 | B |
| | | | Density | | 1.48 | A | 1.41 | B | 1.41 | B | 1.41 | B |
| | | | Member contamination | | A | | A | | A | | A | |
| | HH | Initial | Tribo (mC/kg) | | −39.7 | | −38.4 | | −38.2 | | −38.1 | |
| | | | HH Fogging | | 0.5 | A | 0.8 | A | 0.8 | A | 0.6 | A |
| | | | Density | | 1.47 | A | 1.45 | A | 1.44 | B | 1.43 | B |
| | | Durability after 15,000 prints | HH Fogging | | 0.5 | A | 0.9 | A | 0.9 | A | 0.8 | A |
| | | | Density | | 1.45 | A | 1.43 | B | 1.43 | B | 1.41 | B |
| | | | Member contamination | | A | | A | | A | | A | |
| | After standing for 168 hours in harsh environment SHH | Initial | Tribo (mC/kg) | | −38.6 | | −36.2 | | −34.6 | | −34.2 | |
| | | | SHH Fogging | | 0.5 | A | 0.8 | A | 0.8 | A | 0.9 | A |
| | | | Density | | 1.47 | A | 1.43 | B | 1.43 | B | 1.38 | C |
| | | Durability after 15,000 prints | SHH Fogging | | 0.6 | A | 0.9 | A | 1.8 | C | 1.6 | C |
| | | | Density | | 1.46 | A | 1.42 | B | 1.41 | B | 1.36 | C |
| | | | Member contamination | | A | | A | | A | | B | |
| Cold offset completion Temp. (° C.) | | | | | 120 | | 115 | | 110 | | 105 | |

TABLE 20

| | | | | Example | | | | | | | | | | | |
|---|---|---|---|---|---|---|---|---|---|---|---|---|---|---|---|
| | | | | 21 | | 22 | | 23 | | 24 | | 25 | | 26 | |
| Toner | | | | 21 | | 22 | | 23 | | 24 | | 25 | | 26 | |
| Storage stability | | | Storability (50° C./15 days) | A | | A | | A | | A | | A | | A | |
| | | | Long-term storability (45° C./95%/3 months) | A | | A | | A | | A | | A | | A | |
| Environ-mental stability | NN | Initial | Tribo (mC/kg) | −40.2 | | −41.5 | | −39.8 | | −40.1 | | −41.5 | | −37.4 | |
| | | | NN Fogging | 0.3 | A | 0.4 | A | 0.3 | A | 0.2 | A | 0.3 | A | 0.5 | A |
| | | | Density | 1.50 | A | 1.49 | A | 1.48 | A | 1.51 | A | 1.50 | A | 1.43 | B |
| | | Durability after 15,000 prints | NN Fogging | 0.4 | A | 0.5 | A | 0.4 | A | 0.2 | A | 0.4 | A | 0.7 | A |
| | | | Density | 1.50 | A | 1.46 | A | 1.46 | A | 1.49 | A | 1.48 | A | 1.41 | B |
| | | | Member contami-nation | A | | A | | A | | A | | A | | A | |
| | LL | Initial | Tribo (mC/kg) | −42.0 | | −43.5 | | −41.1 | | −41.2 | | −40.6 | | −38.2 | |
| | | | LL Fogging | 0.3 | A | 0.5 | A | 0.4 | A | 0.3 | A | 0.4 | A | 0.6 | A |
| | | | Density | 1.49 | A | 1.46 | A | 1.48 | A | 1.48 | A | 1.49 | A | 1.41 | B |
| | | Durability after 15,000 prints | LL Fogging | 0.3 | A | 0.6 | A | 0.6 | A | 0.3 | A | 0.5 | A | 0.9 | A |
| | | | Density | 1.47 | A | 1.43 | B | 1.46 | A | 1.48 | A | 1.47 | A | 1.39 | C |
| | | | Member contami-nation | A | | A | | A | | A | | A | | A | |
| | HH | Initial | Tribo (mC/kg) | −39.4 | | −39.6 | | −39.4 | | −39.8 | | −39.6 | | −37.3 | |
| | | | HH Fogging | 0.4 | A | 0.6 | A | 0.5 | A | 0.4 | A | 0.5 | A | 0.8 | A |
| | | | Density | 1.48 | A | 1.44 | B | 1.45 | A | 1.48 | A | 1.47 | A | 1.38 | C |
| | | Durability after 15,000 prints | HH Fogging | 0.6 | A | 0.8 | A | 0.8 | A | 0.5 | A | 0.7 | A | 1.2 | B |
| | | | Density | 1.44 | B | 1.42 | B | 1.43 | B | 1.47 | A | 1.44 | B | 1.36 | C |
| | | | Member contami-nation | A | | A | | A | | A | | A | | A | |
| | After standing for 168 hours in harsh environ-ment SHH | Initial | Tribo (mC/kg) | −37.6 | | −37.8 | | −37.7 | | −38.4 | | −38.4 | | −35.3 | |
| | | | SHH Fogging | 0.5 | A | 0.7 | A | 0.8 | A | 0.5 | A | 0.7 | A | 1.0 | B |
| | | | Density | 1.46 | A | 1.42 | B | 1.43 | B | 1.46 | A | 1.45 | A | 1.36 | C |
| | | Durability after 15,000 prints | SHH Fogging | 0.7 | A | 0.9 | A | 0.9 | A | 0.7 | A | 0.9 | A | 1.5 | C |
| | | | Density | 1.43 | B | 1.40 | B | 1.42 | B | 1.44 | B | 1.43 | B | 1.33 | C |
| | | | Member contami-nation | A | | A | | A | | A | | A | | B | |
| Cold offset completion Temp. (° C.) | | | | 110 | | 115 | | 110 | | 115 | | 110 | | 110 | |

| | | | | Example | | | | | | | |
|---|---|---|---|---|---|---|---|---|---|---|---|
| | | | | 27 | | 28 | | 29 | | 30 | |
| Toner | | | | 27 | | 28 | | 29 | | 30 | |
| Storage stability | | | Storability (50° C./15 days) | A | | A | | A | | A | |
| | | | Long-term storability (45° C./95%/3 months) | A | | A | | A | | A | |
| Environ-mental stability | NN | Initial | Tribo (mC/kg) | −38.3 | | −39.2 | | −38.1 | | −39.8 | |
| | | | NN Fogging | 0.5 | A | 0.6 | A | 0.6 | A | 0.3 | A |
| | | | Density | 1.48 | A | 1.48 | A | 1.44 | B | 1.51 | A |

TABLE 20-continued

| | | | | | | | | | | | | |
|---|---|---|---|---|---|---|---|---|---|---|---|---|
| | | Durability after 15,000 prints | NN Fogging | 0.7 | A | 0.8 | A | 0.8 | A | 0.4 | A |
| | | | Density | 1.43 | B | 1.43 | B | 1.42 | B | 1.49 | A |
| | | | Member contamination | A | | A | | A | | A | |
| | LL | Initial | Tribo (mC/kg) | −40.1 | | −40.2 | | −39.4 | | −42.3 | |
| | | | LL Fogging | 0.5 | A | 0.5 | A | 0.7 | A | 0.3 | A |
| | | | Density | 1.44 | B | 1.44 | B | 1.43 | B | 1.50 | A |
| | | Durability after 15,000 prints | LL Fogging | 0.7 | A | 0.7 | A | 0.9 | A | 0.4 | A |
| | | | Density | 1.43 | B | 1.42 | B | 1.42 | B | 1.49 | A |
| | | | Member contamination | A | | A | | A | | A | |
| | HH | Initial | Tribo (mC/kg) | −37.2 | | −36.1 | | −36.0 | | −39.1 | |
| | | | HH Fogging | 0.8 | A | 0.9 | A | 0.9 | A | 0.3 | A |
| | | | Density | 1.42 | B | 1.43 | B | 1.38 | C | 1.48 | A |
| | | Durability after 15,000 prints | HH Fogging | 1.2 | B | 1.2 | B | 1.2 | B | 0.4 | A |
| | | | Density | 1.38 | C | 1.42 | B | 1.36 | C | 1.46 | A |
| | | | Member contamination | A | | A | | A | | A | |
| | After standing for 168 hours in harsh environment SHH | Initial | Tribo (mC/kg) | −36.4 | | −36.2 | | −34.2 | | −37.4 | |
| | | | SHH Fogging | 0.9 | A | 0.9 | A | 1.1 | B | 0.4 | A |
| | | | Density | 1.37 | C | 1.37 | C | 1.37 | C | 1.47 | A |
| | | Durability after 15,000 prints | SHH Fogging | 1.2 | B | 1.2 | B | 1.5 | C | 0.5 | A |
| | | | Density | 1.36 | C | 1.36 | C | 1.33 | C | 1.45 | A |
| | | | Member contamination | B | | B | | B | | A | |
| Cold offset completion Temp. (° C.) | | | | 110 | | 110 | | 110 | | 110 | |

TABLE 21

| | | | | Example | | | | | | | | | | | |
|---|---|---|---|---|---|---|---|---|---|---|---|---|---|---|---|
| | | | | 31 | | 32 | | 33 | | 34 | | 35 | | 36 | |
| Toner | | | | 31 | | 32 | | 33 | | 34 | | 35 | | Toner particle 1 | |
| Storage stability | | | Storability (50° C./15 days) | A | | A | | A | | A | | A | | A | |
| | | | Long-term storability (45° C./95%/3 months) | A | | A | | A | | A | | A | | A | |
| Environmental stability | NN | Initial | Tribo (mC/kg) | −39.7 | | −40.4 | | −39.1 | | −39.2 | | −39.4 | | −40.4 | |
| | | | NN Fogging | 0.3 | A | 0.2 | A | 0.3 | A | 0.2 | A | 0.2 | A | 0.2 | A |
| | | | Density | 1.50 | A | 1.51 | A | 1.51 | A | 1.49 | A | 1.49 | A | 1.50 | A |
| | | Durability after 15,000 prints | NN Fogging | 0.3 | A | 0.2 | A | 0.3 | A | 0.4 | A | 0.4 | A | 0.2 | A |
| | | | Density | 1.50 | A | 1.50 | A | 1.49 | A | 1.50 | A | 1.50 | A | 1.50 | A |
| | | | Member contamination | A | | A | | A | | A | | A | | A | |
| | LL | Initial | Tribo (mC/kg) | −43.4 | | −42.4 | | −41.2 | | −42.2 | | −42.2 | | −43.4 | |
| | | | LL Fogging | 0.3 | A | 0.3 | A | 0.4 | A | 0.4 | A | 0.4 | A | 0.3 | A |
| | | | Density | 1.50 | A | 1.50 | A | 1.50 | A | 1.49 | A | 1.49 | A | 1.49 | A |

TABLE 21-continued

| | | | Example | | | | | | | | | | | |
|---|---|---|---|---|---|---|---|---|---|---|---|---|---|---|
| | | | 31 | | 32 | | 33 | | 34 | | 35 | | 36 | |
| | Durability after 15,000 prints | LL Fogging | 0.4 | A | 0.3 | A | 0.4 | A | 0.5 | A | 0.5 | A | 0.4 | A |
| | | Density | 1.49 | A | 1.49 | A | 1.48 | A | 1.48 | A | 1.49 | A | 1.48 | A |
| | | Member contamination | A | | A | | A | | A | | A | | A | |
| HH | Initial | Tribo (mC/kg) | −39.7 | | −39.1 | | −38.7 | | −39.4 | | −39.6 | | −39.2 | |
| | | HH Fogging | 0.3 | A | 0.3 | A | 0.4 | A | 0.4 | A | 0.5 | A | 0.3 | A |
| | | Density | 1.46 | A | 1.48 | A | 1.47 | A | 1.47 | A | 1.47 | A | 1.47 | A |
| | Durability after 15,000 prints | HH Fogging | 0.4 | A | 0.4 | A | 0.5 | A | 0.6 | A | 0.6 | A | 0.4 | A |
| | | Density | 1.44 | B | 1.47 | A | 1.44 | B | 1.45 | A | 1.46 | A | 1.45 | A |
| | | Member contamination | A | | A | | A | | A | | A | | A | |
| After standing for 168 hours in harsh environment SHH | Initial | Tribo (mC/kg) | −36.2 | | −37.8 | | −36.9 | | −36.9 | | −36.8 | | −37.4 | |
| | | SHH Fogging | 0.4 | A | 0.3 | A | 0.5 | A | 0.4 | A | 0.4 | A | 0.4 | A |
| | | Density | 1.45 | A | 1.47 | A | 1.46 | A | 1.46 | A | 1.45 | A | 1.45 | A |
| | Durability after 15,000 prints | SHH Fogging | 0.5 | A | 0.4 | A | 0.6 | A | 0.5 | A | 0.6 | A | 0.5 | A |
| | | Density | 1.43 | B | 1.45 | A | 1.43 | B | 1.43 | B | 1.43 | B | 1.44 | B |
| | | Member contamination | A | | A | | A | | A | | A | | A | |
| Cold offset completion Temp. (° C.) | | | 110 | | 110 | | 110 | | 125 | | 125 | | 110 | |

TABLE 22

| | | | | Comparative Example | | | | | | | | | | | |
|---|---|---|---|---|---|---|---|---|---|---|---|---|---|---|---|
| | | | | 1 | | 2 | | 3 | | 4 | | 5 | | 6 | |
| Comparative toner | | | | 1 | | 2 | | 3 | | 4 | | 5 | | 6 | |
| Storage stability | | | Storability (50° C./15 days) | E | | D | | D | | D | | C | | C | |
| | | | Long-term storability (45° C./95%/3 months) | E | | D | | D | | D | | C | | C | |
| Environmental stability | NN | Initial | Tribo (mC/kg) | −34.2 | | −38.4 | | −44.3 | | −38.7 | | −38.2 | | −38.4 | |
| | | | NN Fogging | 0.8 | A | 0.4 | A | 1.1 | B | 0.9 | A | 0.7 | A | 0.7 | A |
| | | | Density | 1.38 | C | 1.46 | A | 1.37 | C | 1.42 | B | 1.46 | A | 1.46 | A |
| | | Durability after 15,000 prints | NN Fogging | 1.3 | B | 0.6 | A | 1.2 | B | 1.0 | B | 0.9 | A | 0.9 | A |
| | | | Density | 1.32 | C | 1.42 | B | 1.32 | C | 1.36 | C | 1.42 | B | 1.42 | B |
| | | | Member contamination | B | | A | | A | | A | | A | | A | |
| | LL | Initial | Tribo (mC/kg) | −54.2 | | −42.3 | | −53.1 | | −43.2 | | −43.5 | | −43.1 | |
| | | | LL Fogging | 1.4 | B | 0.6 | A | 1.6 | C | 1.0 | B | 0.8 | A | 0.8 | A |
| | | | Density | 1.29 | D | 1.45 | A | 1.38 | C | 1.38 | C | 1.43 | B | 1.44 | B |
| | | Durability after 15,000 prints | LL Fogging | 1.8 | C | 0.8 | A | 1.9 | C | 1.3 | B | 1.1 | B | 1.2 | B |
| | | | Density | 1.15 | F | 1.43 | B | 1.34 | C | 1.32 | C | 1.38 | C | 1.39 | C |
| | | | Member contamination | B | | A | | B | | B | | B | | B | |
| | HH | Initial | Tribo (mC/kg) | −29.4 | | −38.4 | | −30.2 | | −32.1 | | −36.4 | | −37.4 | |
| | | | HH Fogging | 1.6 | C | 0.8 | A | 2.2 | D | 1.5 | C | 1.0 | B | 1.0 | B |
| | | | Density | 1.30 | C | 1.43 | B | 1.26 | D | 1.34 | C | 1.39 | C | 1.38 | C |
| | | Durability after 15,000 prints | HH Fogging | 1.8 | C | 1.2 | B | 2.6 | E | 1.9 | C | 1.3 | B | 1.3 | B |
| | | | Density | 1.23 | E | 1.40 | B | 1.23 | E | 1.30 | C | 1.36 | C | 1.35 | C |
| | | | Member contamination | B | | B | | B | | B | | B | | B | |

TABLE 22-continued

| | | | | | | | | | | | | | | |
|---|---|---|---|---|---|---|---|---|---|---|---|---|---|---|
| | After standing for 168 hours in harsh environment SHH | Initial | Tribo (mC/kg) | −19.3 | | −34.5 | | −19.3 | | −19.8 | | −32.4 | | −32.1 | |
| | | | SHH Fogging | 2.5 | E | 1.2 | B | 2.4 | D | 2.2 | D | 1.2 | B | 1.2 | B |
| | | | Density | 1.15 | F | 1.38 | C | 1.18 | F | 1.19 | F | 1.34 | C | 1.35 | C |
| | | Durability after 15,000 prints | SHH Fogging | 2.8 | E | 1.4 | B | 3.1 | F | 2.6 | E | 1.5 | C | 1.5 | C |
| | | | Density | 1.10 | F | 1.35 | C | 1.10 | F | 1.12 | F | 1.25 | D | 1.26 | D |
| | | | Member contamination | D | | C | | D | | D | | D | | D | |
| Cold offset completion Temp. (° C.) | | | | 110 | | 145 | | 115 | | 120 | | 120 | | 120 | |

| | | | | Comparative Example | | | | | | | | | | | |
|---|---|---|---|---|---|---|---|---|---|---|---|---|---|---|---|
| | | | | 7 | | 8 | | 9 | | 10 | | 11 | | 12 | |
| | Comparative toner | | | 7 | | 8 | | 9 | | 10 | | 11 | | 12 | |
| | Storage stability | | Storability (50° C./15 days) | D | | D | | C | | B | | A | | A | |
| | | | Long-term storability (45° C./95%/3 months) | D | | E | | C | | C | | B | | B | |
| Environmental stability | NN | Initial | Tribo (mC/kg) | −42.4 | | −42.8 | | −41.2 | | −40.8 | | −38.8 | | −38.9 | |
| | | | NN Fogging | 0.8 | A | 0.9 | A | 0.4 | A | 0.3 | A | 0.2 | A | 0.2 | A |
| | | | Density | 1.45 | A | 1.46 | A | 1.52 | A | 1.51 | A | 1.51 | A | 1.51 | A |
| | | Durability after 15,000 prints | NN Fogging | 1.2 | B | 1.2 | B | 0.5 | A | 0.4 | A | 0.3 | A | 0.3 | A |
| | | | Density | 1.38 | C | 1.39 | C | 1.49 | A | 1.49 | A | 1.50 | A | 1.50 | A |
| | | | Member contamination | A | | A | | A | | A | | A | | A | |
| | LL | Initial | Tribo (mC/kg) | −46.2 | | −46.3 | | −43.2 | | −42.6 | | −42.3 | | −41.2 | |
| | | | LL Fogging | 1.2 | B | 1.2 | B | 0.6 | A | 0.3 | A | 0.3 | A | 0.3 | A |
| | | | Density | 1.43 | B | 1.42 | B | 1.45 | A | 1.48 | A | 1.51 | A | 1.51 | A |
| | | Durability after 15,000 prints | LL Fogging | 1.8 | C | 1.9 | C | 0.8 | A | 0.4 | A | 0.4 | A | 0.4 | A |
| | | | Density | 1.40 | B | 1.38 | C | 1.43 | B | 1.46 | A | 1.49 | A | 1.49 | A |
| | | | Member contamination | B | | B | | B | | A | | A | | A | |
| | HH | Initial | Tribo (mC/kg) | −32.4 | | −32.1 | | −32.3 | | −36.4 | | −31.6 | | −32.4 | |
| | | | HH Fogging | 1.5 | C | 1.6 | C | 1.4 | B | 0.8 | A | 1.5 | C | 1.4 | B |
| | | | Density | 1.34 | C | 1.32 | C | 1.39 | C | 1.40 | B | 1.38 | C | 1.38 | C |
| | | Durability after 15,000 prints | HH Fogging | 2.3 | D | 2.3 | D | 1.7 | C | 1.0 | B | 1.9 | C | 1.8 | C |
| | | | Density | 1.27 | D | 1.26 | D | 1.36 | C | 1.38 | C | 1.35 | C | 1.34 | C |
| | | | Member contamination | C | | C | | B | | A | | B | | B | |
| | After standing for 168 hours in harsh environment SHH | Initial | Tribo (mC/kg) | −15.2 | | −13.4 | | −30.2 | | −30.2 | | −29.7 | | −29.4 | |
| | | | SHH Fogging | 2.1 | D | 2.3 | D | 1.5 | C | 1.5 | C | 1.7 | C | 1.7 | C |
| | | | Density | 1.08 | F | 1.09 | F | 1.34 | C | 1.35 | C | 1.32 | C | 1.31 | C |
| | | Durability after 15,000 prints | SHH Fogging | 2.6 | E | 2.7 | E | 1.7 | C | 1.7 | C | 2.1 | D | 2.1 | D |
| | | | Density | 1.07 | F | 1.08 | F | 1.32 | C | 1.33 | C | 1.29 | D | 1.27 | D |
| | | | Member contamination | E | | E | | D | | C | | D | | D | |
| Cold offset completion Temp. (° C.) | | | | 115 | | 110 | | 145 | | 145 | | 140 | | 140 | |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-212259, filed Oct. 9, 2013, which is hereby incorporated by reference herein in its entirety.

What is claimed is:

1. A toner comprising a toner particle that comprises:

a binder resin;

an organic silicon polymer other than the binder resin, the organic silicon polymer being contained in a surface layer of the toner particle, and having a structure represented by formula (T3)

$$Rf—SiO_{3/2} \quad (T3)$$

in which Rf represents a hydrocarbon group having from 1 to 6 carbon atoms or an aryl group, and a proportion of the structure represented by the formula (T3) to the number of a silicon atom in the organic silicon polymer is at least 5.0% calculated from Si-NMR chart; and a polyester resin other than the binder resin, the polyester resin being contained in the toner particle in an amount of from at least 1.0% by mass to less than 80% by mass, the polyester resin has a melting point, wherein dSi/(dC+dO+dSi+dS) is at least 2.5 atom % when measuring densities of carbon atom, oxygen atom, silicon atom, and sulfur atom in the surface layer with X-ray photoelectron spectroscopic analysis (Electron Spectroscopy for Chemical Analysis (ESCA)), and resultant carbon atom density is defined as dC,
resultant oxygen atom density is defined as dO,
resultant silicon atom density is defined as dSi, and
resultant sulfur atom density is defined as dS.

2. The toner according to claim 1, wherein the melting point of the polyester resin is from 20.0° C. to 90.0° C.

3. The toner according to claim 1, wherein the Rf represents a methyl group.

4. A toner comprising a toner particle that comprises:

a binder system containing at least two different polymers, said binder system comprising (i) a binder resin and (ii) a polyester resin other than the binder resin, the polyester resin being contained in the toner particle in an amount of from at least 1.0% by mass to less than 80% by mass, and being at least one member selected from the group consisting of a condensate "a", a condensate "b" and a condensate "c", the condensate "a" being a condensate of an aliphatic diol having from 2 to 16 carbon atoms and an aliphatic dicarboxylic acid having from 2 to 16 carbon atoms, a content of a unit derived from the aliphatic diol being at least 50.0 mol % based on total units derived from an alcohol component in the condensate "a", and a content of a unit derived from the aliphatic dicarboxylic acid being at least 50.0 mol % based on all units derived from a carboxylic acid component in the condensate "a", the condensate "b" being a condensate of an aliphatic diol having from 2 to 16 carbon atoms and an aromatic dicarboxylic acid having from 2 to 16 carbon atoms, a content of a unit derived from the aliphatic diol being at least 50.0 mol % based on all units derived from an alcohol component in the condensate "b", and a content of a unit derived from the aromatic dicarboxylic acid being at least 50.0 mol % based on all units derived from a carboxylic acid component in the condensate "b", the condensate "c" being a condensate of an aromatic diol and an aliphatic dicarboxylic acid having from 2 to 16 carbon atoms, a content of a unit derived from the aromatic diol being at least 50.0 mol % based on all units derived from an alcohol component in the condensate "c", and a content of a unit derived from the aliphatic dicarboxylic acid being at least 50.0 mol % based on all units derived from a carboxylic acid component in the condensate "c", dSi/(dC+dO+dSi+dS) is at least 2.5 atom % when measuring densities of carbon atom, oxygen atom, silicon atom, and sulfur atom in the surface layer with X-ray photoelectron spectroscopic analysis (Electron Spectroscopy for Chemical Analysis (ESCA)), and resultant carbon atom density is defined as dC,
resultant oxygen atom density is defined as dO,
resultant silicon atom density is defined as dSi, and
resultant sulfur atom density is defined as dS;

said toner particle further comprising an organic silicon polymer other than said binder resin and said polyester resin, the organic silicon polymer being contained in a surface layer of the toner particle, and having a structure represented by formula (T3)

$$Rf—SiO_{3/2} \quad (T3)$$

in which Rf represents a hydrocarbon group having from 1 to 6 carbon atoms or an aryl group, and a proportion of the structure represented by the formula (T3) to the number of a silicon atom in the organic silicon polymer is at least 5.0% calculated from Si-NMR chart.

5. The toner according to claim 4, wherein the Rf represents a hydrocarbon group having from 1 to 3 carbon atoms.

6. The toner according to claim 4, wherein the Rf represents a methyl group, ethyl group, propyl group or phenyl group.

7. The toner according to claim 4, wherein the proportion of the structure represented by the formula (T3) to the number of the silicon atom in the organic silicon polymer is not more than 100.0%.

8. The toner according to claim 4, wherein the polyester resin is a polyester resin having a melting point.

9. The toner according to claim 8, wherein the melting point of the polyester resin is from 20.0° C. to 90.0° C.

10. The toner according to claim 4, wherein the carboxylic acid component contains an unsaturated aliphatic dicarboxylic acid having 2 to 16 carbon atoms of less than 50.0 mol %.

11. The toner according to claim 4, wherein the toner particle is produced by forming, in an aqueous medium, a particle of a polymerizable monomer composition comprising an organic silicon compound for obtaining the organic silicon polymer, a polymerizable monomer for forming the binder resin, and the polyester resin, and by polymerizing the polymerizable monomer.

12. The toner according to claim 4, wherein the organic silicon polymer is an organic silicon polymer obtained by polymerizing an organic silicon compound having a structure represented by formula (Z):

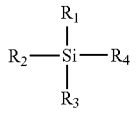

(Z)

in which $R_1$ represents a hydrocarbon group having from 1 to 6 carbon atoms or aryl group, and $R_2$, $R_3$, and $R_4$ independently represent a halogen atom, hydroxyl group, acetoxy group or alkoxy group.

13. The toner according to claim 5, wherein the organic silicon polymer is an organic silicon polymer obtained by polymerizing an organic silicon compound having a structure represented by formula (Z):

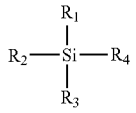

(Z)

in which $R_1$ represents a hydrocarbon group having from 1 to 3 carbon atoms, and $R_2$, $R_3$, and $R_4$ independently represent a halogen atom, hydroxyl group, acetoxy group or alkoxy group.

14. The toner according to claim 6, wherein the organic silicon polymer is an organic silicon polymer obtained by polymerizing an organic silicon compound having a structure represented by formula (Z):

(Z)

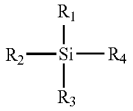

in which $R_1$ represents a methyl group, ethyl group, propyl group or phenyl group, and $R_2$, $R_3$, and $R_4$ independently represent a halogen atom, hydroxyl group, acetoxy group and alkoxy group.

15. The toner according to claim 4, wherein dSi/(dC+dO+dSi+dS) is at least 5.0 atom %.

16. The toner according to claim 4, wherein dSi/(dC+dO+dSi+dS) is at least 15.0 atom %.

17. The toner according to claim 4, wherein the Rf represents a methyl group.

18. The toner according to claim 17, wherein the organic silicon polymer is an organic silicon polymer obtained by polymerizing an organic silicon compound having a structure represented by formula (Z):

(Z)

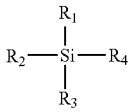

in which $R_1$ represents a methyl group, and $R_2$, $R_3$, and $R_4$ independently represent a halogen atom, hydroxyl group, acetoxy group or alkoxy group.

* * * * *